US007519311B2

(12) United States Patent
Murakami et al.

(10) Patent No.: US 7,519,311 B2
(45) Date of Patent: Apr. 14, 2009

(54) DEVELOPING APPARATUS, PROCESS CARTRIDGE, IMAGE FORMING APPARATUS, AND ASSEMBLYING METHOD FOR DEVELOPING APPARATUS

(75) Inventors: Ryuta Murakami, Shizuoka-ken (JP); Hideshi Kawaguchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 199 days.

(21) Appl. No.: 11/608,047

(22) Filed: Dec. 7, 2006

(65) Prior Publication Data

US 2007/0248378 A1 Oct. 25, 2007

(30) Foreign Application Priority Data

Apr. 19, 2006 (JP) ..... 2006-115611
Apr. 19, 2006 (JP) ..... 2006-115612

(51) Int. Cl.
*G03G 21/18* (2006.01)

(52) U.S. Cl. ..... 399/111; 399/113

(58) Field of Classification Search ..... 399/107, 399/109, 110, 111, 112, 113, 114, 119, 120; 29/402.03, 426.6, 469
See application file for complete search history.

(56) References Cited

U.S. PATENT DOCUMENTS 5,208,634 A * 5/1993 Ikemoto et al. ..... 399/111
5,809,374 A 9/1998 Tsuda et al. ..... 399/111
6,118,961 A * 9/2000 Nomura et al. ..... 399/113
6,272,300 B1 * 8/2001 Fujiwara et al. ..... 399/113
6,654,575 B2 * 11/2003 Miura et al. ..... 399/102
6,826,373 B2 * 11/2004 Nomura ..... 399/12
7,054,575 B1 * 5/2006 Michlin ..... 399/106

FOREIGN PATENT DOCUMENTS

JP 2003-076144 3/2003

* cited by examiner

*Primary Examiner*—Hoan H Tran
(74) *Attorney, Agent, or Firm*—Fitzpatrick, Cella, Harper & Scinto

(57) ABSTRACT

A developing apparatus usable with an electrophotographic image forming apparatus for forming an image on a recording material, includes a developer carrying member for developing a latent image formed on an electrophotographic photosensitive member with a developer; a first frame for accommodating the developer, the first frame including a first opening for supplying the developer and a first connecting portion provided around first opening; a second frame containing the developer carrying member, a second opening for receiving supply of the developer from the first opening and a second connecting portion provided around the second opening; an elastomer for connecting the first connecting portion and the second connecting portion with each other with the first opening and the second opening being opposed to each other so as to permit movement of the first frame and the second frame and so as to prevent the developer from leaking between the first connecting portion and the second connecting portion.

36 Claims, 32 Drawing Sheets

"E" (ENLARGED)

"I"(ENLARGED)

DEVELOPING APPARATUS, PROCESS CARTRIDGE, IMAGE FORMING APPARATUS, AND ASSEMBLYING METHOD FOR DEVELOPING APPARATUS

FIELD OF THE INVENTION AND RELATED ART

The present invention relates to a developing apparatus, a process cartridge, an electrophotographic image forming apparatus, and a method for assembling developing apparatus.

Here, an electrophotographic image forming apparatus means an apparatus which forms an image on recording medium (for example, recording paper, OHP sheet, etc.) with the use of an electrophotographic image formation process. As examples of an electrophotographic image forming apparatus, an electrophotographic copying machine, an electrophotographic printer (for example, laser printer, LED printer, etc.), a facsimile machine, a wordprocessor, a multifunction printer, etc., may be included.

A process cartridge means a cartridge in which at least a developing means as a processing means, and an electrophotographic photosensitive member, are integrally disposed so that they can be removably mountable in the main assembly of an electrophotographic image forming apparatus.

A developing apparatus means an apparatus having a developer storage frame in which developer is stored, a developer bearing member, a developing means frame, which supports the developer bearing member. It is employed by an electrophotographic image forming apparatus.

The image forming operation of an electrophotographic image forming apparatus which uses an electrophotographic image formation process is as follows: An electrophotographic photosensitive member, which is in the form of a drum (which hereafter will be referred to simply as photosensitive drum), is uniformly charged by a charging means. Then, numerous points on the charged peripheral surface of the photosensitive drum are selectively exposed in accordance with picture formation information. As a result, an electrophotographic latent is formed on the peripheral surface of the photosensitive drum. This latent image is developed with the combination of a developer bearing member and toner (developer), into an image formed of toner (developer), which hereafter will be referred to as toner (developer) image. Then, the toner image is transferred onto recording medium. Then, the toner image on the recording medium is fixed to the recording medium by applying heat and pressure to the toner image, effecting thereby a permanent toner image on the recording medium. The toner remaining on the peripheral surface of the photosensitive drum after the toner image transfer is removed by a cleaning means so that the cleaned area of the photosensitive drum is used for the subsequent image forming operation.

Some process cartridges are made up of a development unit (developing apparatus) and a photosensitive member unit, which are integrally joined. The development unit is made up of a toner storage frame and developing means frame, which are integrally attached to each other. The toner storage frame stores toner, and the developing means frame supports a development roller (developer bearing member). The photosensitive member unit is made up of a photosensitive drum, a charging means, a cleaning means, and cleaning means frame by which the photosensitive drum, charging means, and cleaning means are supported. A process cartridge is made up of the development unit and a photosensitive member unit, which are integrally joined by their developing means frame and cleaning means frame, respectively.

In some development units, the developing means frame is movably supported so that it can be moved relative to the toner storage frame (Patent Document 1). More specifically, in these development units, the lengthwise end portions of the development roller are fitted with a pair of spacer rings, one for one. Thus, as the development roller is kept pressed upon the peripheral surface of the photosensitive drum, the pair of spacer rings remain in contact with the peripheral surface of the photosensitive drum 1, maintaining thereby a preset amount of gap between the peripheral surface of the photosensitive drum and peripheral surface of the development roller. Further, some development units are provided with a foamed polyurethane seal, which is provided for sealing between the developing means frame and toner storage frame to prevent toner from leaking the development units through the joint between the developing means and toner storage frame (Japanese Laid-open Patent Application 2003-76144).

However, in order to ensure that the abovementioned joint remains perfectly sealed with the use of the above described prior art, the foamed urethane seal must be compressed by a large amount, making it possible that the amount of the force applied to the developing means frame will become excessive, which in turns will make unnecessarily large the amount of force applied from the development roller to the photosensitive drum.

SUMMARY OF THE INVENTION

Thus, the primary object of the present invention is to provide a developing apparatus capable of keeping satisfactorily sealed the joint between the first frame which stores developer, and the second frame which supports the developer bearing member, while controlling the amount of force applied from the first frame to the second frame.

Another object of the present invention is to provide a process cartridge which is capable of keeping satisfactorily sealed the joint between the first frame which stores developer, and the second frame which supports the developer bearing member, while controlling the amount of force applied from the first frame to the second frame.

Another object of the present invention is to provide an electrophotographic image forming apparatus in which the above-described process cartridge is removably mountable.

Another object of the present invention is to provide an assemblying method for such a developing apparatus and such a process cartridge.

Another object of the present invention is to simplify the method for assembling the above described process cartridge.

According to an aspect of the present invention, there is provided a developing apparatus usable with an electrophotographic image forming apparatus for forming an image on a recording material, said developing apparatus comprising a developer carrying member for developing a latent image formed on an electrophotographic photosensitive member with a developer; a first frame for accommodating the developer, said first frame including a first opening for supplying the developer and a first connecting portion provided around first opening; a second frame containing said developer carrying member, a second opening for receiving supply of the developer from said first opening and a second connecting portion provided around said second opening; an elastomer for connecting said first connecting portion and said second connecting portion with each other with said first opening and said second opening being opposed to each other so as to permit movement of said first frame and said second frame and so as to prevent the developer from leaking between said first connecting portion and said second connecting portion.

According to another aspect of the present invention, there is provided a developing apparatus usable with an electrophotographic image forming apparatus for forming an image on a recording material, said developing apparatus comprising a developer carrying member for developing a latent image formed on an electrophotographic photosensitive member with a developer; a first frame for accommodating the developer, said first frame including a first opening for supplying the developer and a first connecting portion provided around first opening; a second frame containing said developer carrying member, a second opening for receiving supply of the developer from said first opening and a second connecting portion provided around said second opening; an elastic member in the form of a sheet provided on one of said first connecting portion and said second connecting portion; an elastomer for connecting one of said first connecting portion and said second connecting portion with said elastic member with said first opening and said second opening being opposed to each other so as to permit movement of said first frame and said second frame and so as to prevent the developer from leaking between said first connecting portion and said second connecting portion; an urging member provided on said one of said first connecting portion and said second connecting portion, said urging member urging said elastic member toward a stepped portion of said elastomer.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereafter, the preferred embodiments of the present invention will be described in detail with reference to the appended drawings.

Embodiment 1

(1) Structure of Entirety of Electrophotographic Image Forming Apparatus

Figure 2:
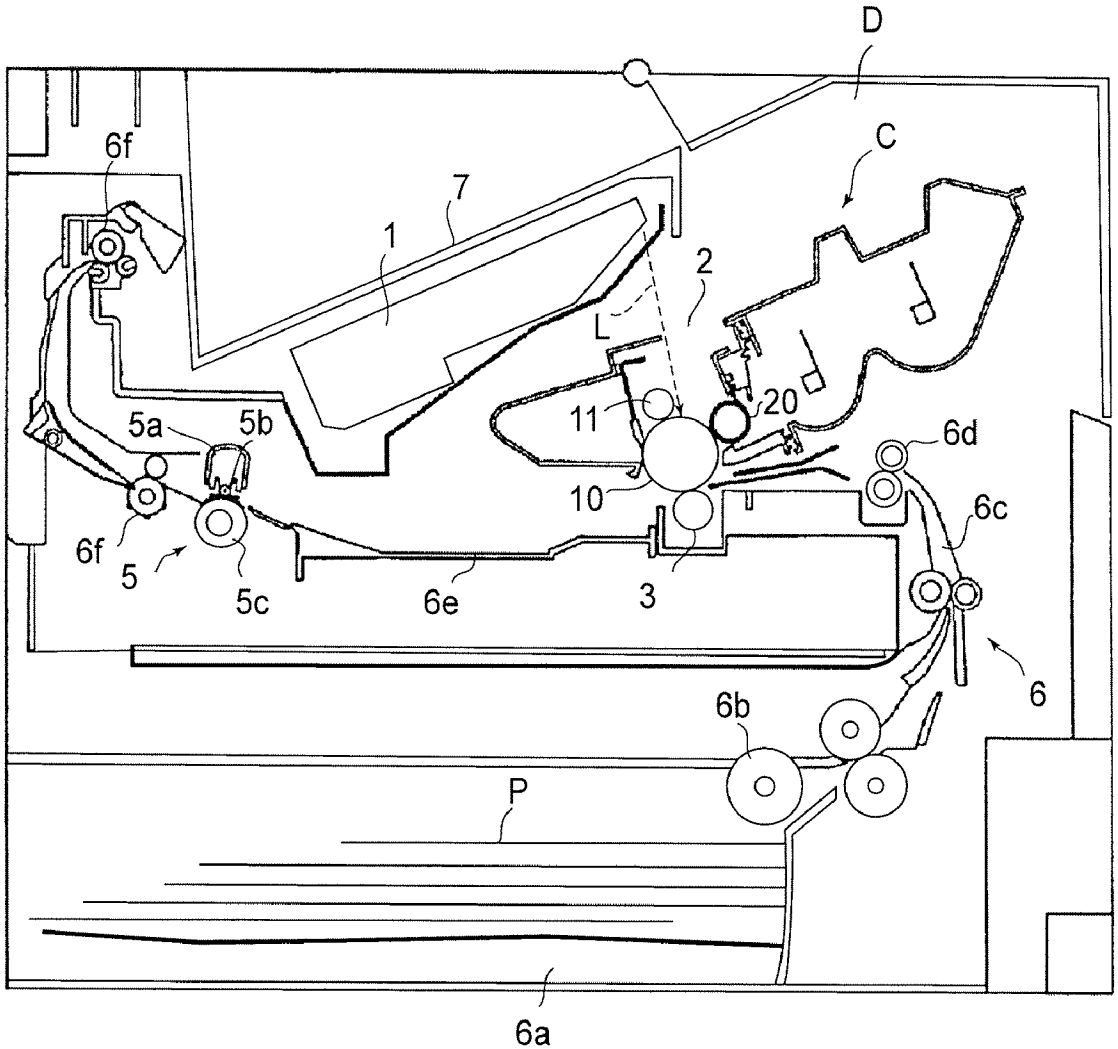
FIG. 2 is a schematic drawing of an example of an electrophotographic image forming apparatus, showing the general structure thereof.

FIG. 2 is a schematic drawing of an example of an electrophotographic image forming apparatus, showing the general structure thereof. This electrophotographic image forming an apparatus (which hereafter will be referred to simply as image forming apparatus) is a laser printer which forms an image on recording medium (for example, recording paper, OHP sheet, fabric, etc.) with the use of an electrophotographic process.

In the image forming apparatus, an electrophotographic photosensitive member in the form of a drum 10 (which hereafter will be referred to as a "photosensitive drum") is rotated in the direction indicated by an arrow mark at a preset peripheral velocity (process speed). The peripheral surface (surface) of the photosensitive drum 10 is uniformly charged by a charging means 11. The charged area of the peripheral surface of the photosensitive drum 10 is exposed to a beam of laser light L projected from an exposing means 1 (exposing apparatus) while being modulated with picture information. As a result, an electrostatic latent image is formed on the peripheral surface of the photosensitive drum 10. This electrostatic latent image is developed by the combination of the developing means 13 and toner (developer). As a result, a toner image which reflects the picture information is formed on the peripheral surface of the photosensitive drum 10.

In synchronization with the formation of the toner image, recording mediums P are fed, while being separated one by one, from a feeder cassette 6*a* by a pickup roller 6*b* into the main assembly of the image forming apparatus. Then, each recording medium P is conveyed along a conveyance guide 6*c* to a pair of registration rollers 6*d*, which sends the delivered recording medium P to the interface between the photosensitive drum 10 and a transferring means 3. The transferring means 3 transfers the toner image on the photosensitive drum 10 onto the recording medium P. After the recording medium P receives the toner image, it is conveyed along a conveyance guide 6*e* to a fixing apparatus 5 as a fixing means.

The fixing apparatus 5 has a pressure roller 5*c* and a fixation roller 5*b*. The fixation roller 5*b* contains a heater 5*a*. The recording medium P is conveyed through the nip (fixation nip) between the pressure roller 5*c* and fixation roller 5*b* while remaining pinched by the two rollers 5*c* and 5*b*. While the recording medium P is conveyed through the fixation nip, heat and pressure are applied to the recording medium P and the unfixed toner image thereon. As a result, the unfixed toner image is fixed to the surface of the recording medium P. After coming out of the fixing apparatus 5, the recording medium P is discharged by a discharge toiler 6*f* onto a delivery tray 7, which is a part of the top surface of the main assembly D of the image forming apparatus.

After the transfer of the toner image, the adherent residues on the peripheral surface of the photosensitive drum 10, such as the toner remaining on the peripheral surface of the photosensitive drum 10 after the toner image transfer, are removed by a cleaning means 14. Then, the cleaned area of the peripheral surface of the photosensitive drum 10 is used for the subsequent image forming operation.

The above-mentioned photosensitive drum 10, charging means 8, developing means, 13, and cleaning means 14 are integrally disposed in a cartridge, making up a process cartridge C, which is removably mountable in the apparatus main assembly D.

Designated by a reference numeral 6 is a conveying means for conveying the recording medium P. The conveying means 6 is made up of the pickup roller 6*b*, pair of conveyance guides 6*c* and 6*e*, registration roller pair 6*d*, discharge roller 6*f*, etc.

(2) Structure of Cartridge C

In the following description of the structure of the cartridge C, the "widthwise direction" of the cartridge C or the components thereof means the direction in which the cartridge C is mounted into, or removed from, the apparatus main assembly D, unless specifically noted. Similarly, the "lengthwise direction" means the direction perpendicular (intersectional) to the direction in which the cartridge C is mounted into, or removed from, the apparatus main assembly D. It also means the direction parallel with the axial line of the photosensitive drum 10. Further, the front surface of the cartridge C means the surface of the cartridge C, which is on the side from which the cartridge C is mounted into, or removed from the apparatus main assembly D. The rear surface of the cartridge C means the opposite surface of the cartridge C from the front surface of the cartridge C. The left- and right-hand sides of the cartridge C means the left- and right-hand sides of the cartridge C as seen from the front side of the cartridge C. The top surface of the cartridge C means the surface of the cartridge C, which is on the top side after the cartridge C is properly positioned in the apparatus main assembly D, and the bottom surface of the cartridge C means the surface of the cartridge C, which is on the bottom side after the cartridge C is properly positioned in the apparatus main assembly D.

Figure 3:
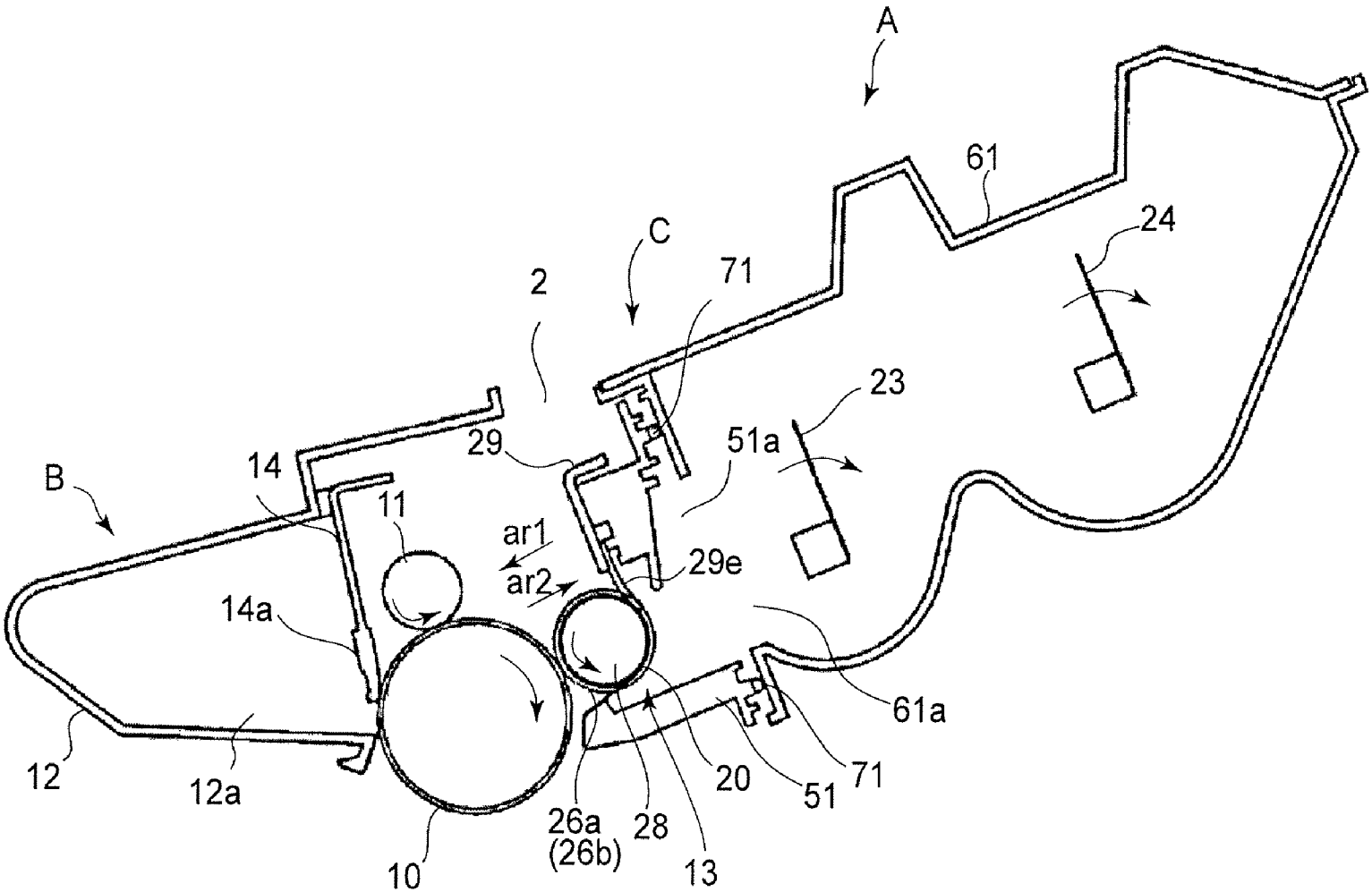
FIG. 3 is a schematic drawing of an example of a process cartridge, showing the general structure thereof.
Figure 5:
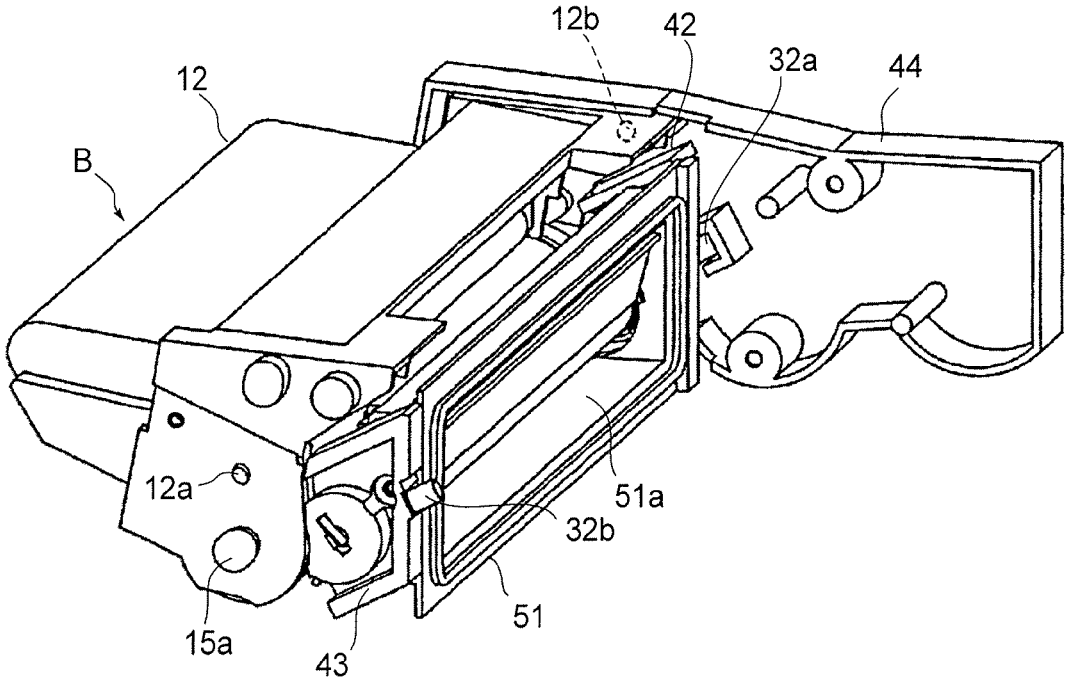
FIG. 5 is a perspective view of the photosensitive member unit, developing means frame of the development unit, and side cover, showing their relationship.
Figure 6:
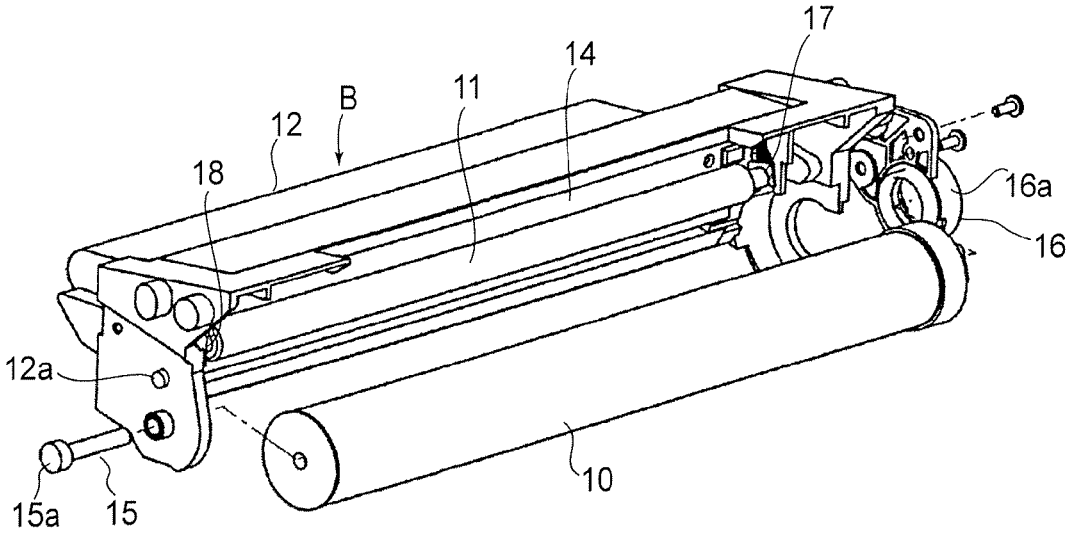
FIG. 6 is an exploded perspective view of the photosensitive member unit.

FIG. 3 is a schematic drawing of an example of the cartridge C, showing the structure thereof. FIG. 5 is a perspective view of the photosensitive member unit B, developing means frame 51 of the development unit A, and side cover, showing their positional relationship. FIG. 6 is an exploded perspective view of the photosensitive member unit B.

Referring to FIG. 3, the development unit A (developing apparatus) is integrally attached to the photosensitive member unit B. The development unit A has a toner storage frame 61 as the first frame, a developing means 13, and a developing means frame 51 as the second frame. In the toner storage frame 61, unshown toner is stored. Designated by a reference character 61*a* is an opening (FIG. 13) with which the developer storage frame 61 is provided. It is provided for allowing the toner in the developer storage frame 61 to be supplied for development. The developing means 13 has a pair of toner sending members 23 and 24, a development roller 20 as a developer bearing member, a development blade 29, and a blowout prevention sheet 25. The toner sending members 23 and 24 are rotatably supported by the developer storage frame 61. The development roller 20 and development blade 29, and blowout prevention sheet 25 are supported by the developing means frame 51. The development roller 20 is rotatably supported by the developing means frame 51, and supplies the latent image formed on the peripheral surface of the photosensitive drum 10, with toner, by bearing the toner on its peripheral surface (surface). As the toner is supplied to the latent image by the development roller 20, a visible image is effected on the peripheral surface of the photosensitive drum 10. The development blade 29 forms a toner layer on the peripheral surface of the development roller 20 while frictionally charging the toner. The blowout prevention member sheet 25 prevents toner from leaking out from the cartridge C through the gap between the bottom side of the development roller 20 and the developing means frame 51, by sealing the gap. Designated by a reference character 51*a* is the second opening (FIG. 3). The second opening 51*a* is the opening through which the toner supplied from the developer storage frame 61 through the first opening 61*a* is guided to the development roller 20. This opening 51*a* squarely opposes the first opening 61*a*.

In the developing means 13, the toner sending members 23 and 24 rotate in the direction indicated by arrow marks, whereby the toner in the developer storage frame 61 is moved into the developing means frame 51 through the openings 61*a* and 51*a*. After being moved into the developing means frame 51, the toner is borne on the peripheral surface of the development roller 20, which contains a stationary magnet 28 and is rotating. Then, the toner borne on the peripheral surface of the development roller 20 is formed into a uniform layer of toner with a preset thickness, while being frictionally charged, by a blade 29*e*, which is an integrally molded part of the development blade 29, or bonded to the base portion of the development blade 29. The development roller 20 is provided with a pair of spacer rings 26*a* and 26*b* (FIG. 8), which are fitted around the lengthwise end portions of the development roller 20. The development roller 20 is kept pressed toward the peripheral surface of the photosensitive drum 10, with the presence of the pair of spacer rings 26*a* and 26*b* between the development roller 20 and photosensitive drum 10. Therefore, a preset amount of clearance is maintained between the peripheral surface of the development roller 20 and the peripheral surface of the photosensitive drum 10. With the provision of this setup, the toner on the development roller 20 is supplied to the area of the peripheral surface of the photosensitive drum 10, which is to be developed. As a result, a toner image which reflects the latent image is effected on the peripheral surface of the photosensitive drum 10.

The photosensitive member unit B has a cleaning means frame 12. The cleaning means frame 12 contains the photosensitive drum 10, a charge roller 11 as a charging means, and a cleaning blade 14 as a cleaning means, which are supported by the cleaning means frame 12. More specifically, the photosensitive drum 10 is rotatably supported by the cleaning means frame 12, with a shaft 15*a* and a pair of bearings 16 interposed between the photosensitive drum 10 and cleaning means frame 12 (FIG. 5). The charge roller 11 is rotatably supported by the cleaning means frame 12 with a pair of bearings 17 and 18 interposed between the charge roller 11 and cleaning means frame 12 (FIG. 5). The cleaning blade 14 is made up of a blade 14*a*, which contacts the peripheral surface of the photosensitive drum 10, and scrapes the residual toner on the peripheral surface of the photosensitive drum 10, down into a waste toner chamber 12*a*.

The cartridge C has a top opening 2, which is the photosensitive drum exposure window located between the cleaning means frame 12 and developing means frame 51. This top opening 2 allows the peripheral surface of the photosensitive drum 10 to be exposed by the beam of laser light L to form a latent image on the peripheral surface of the photosensitive drum 10.

Figure 4:
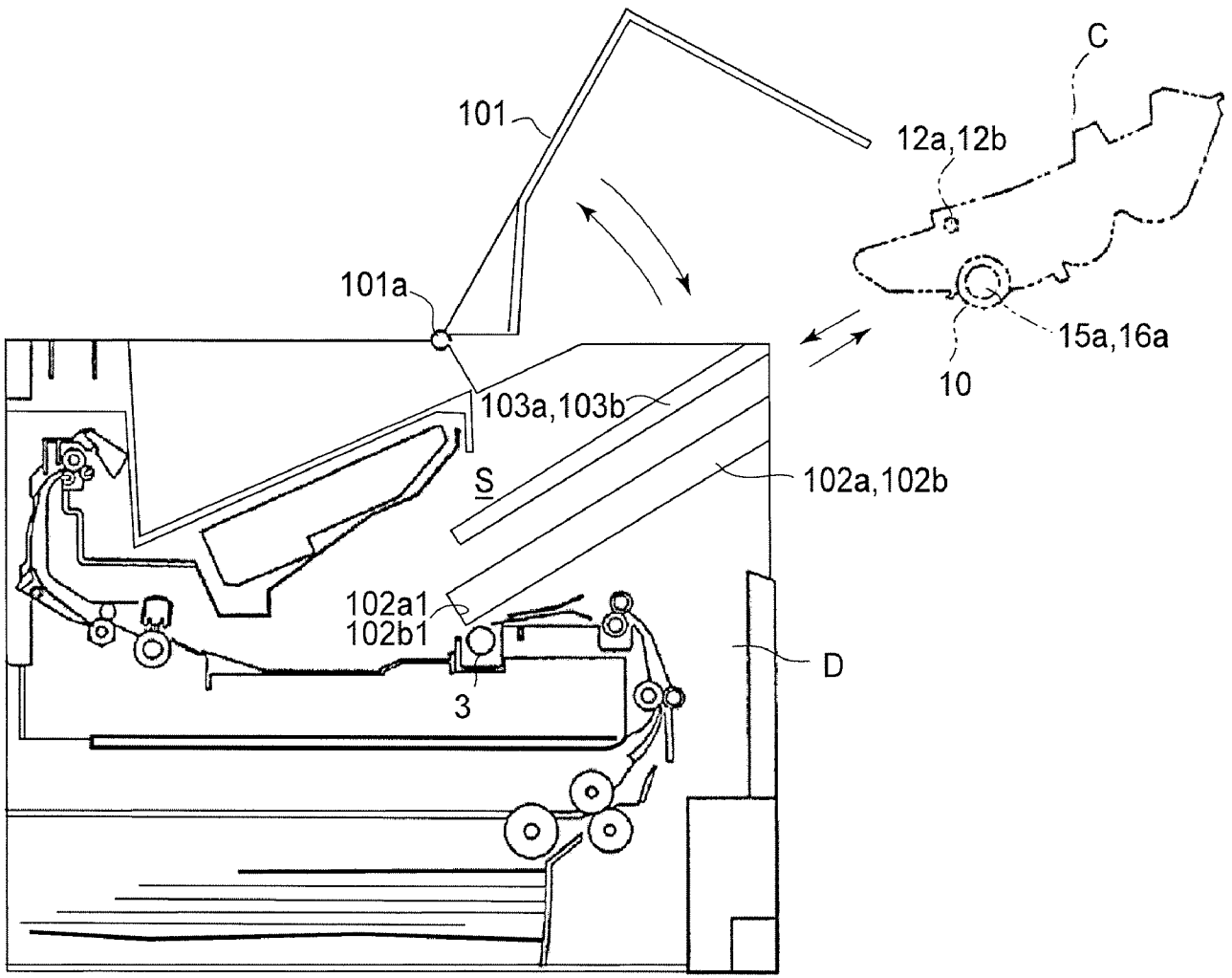
FIG. 4 is a schematic drawing showing the structure of the guide of the process cartridge, and the structure of the cartridge guide of the main assembly of the image forming apparatus.

(3) Structure of Guide of Cartridge C, and Structure of Cartridge Guide of Apparatus Main Assembly D Referring to FIG. 4, when mounting the cartridge C into the apparatus main assembly D, a lid 101 is to be rotated upward of the apparatus main assembly D about a shaft 101*a*. As the lid 101 is rotated upward, a cartridge slot S in the apparatus main assembly D is exposed. Then, an operator positions the cartridge C so that the cylindrical protrusion 15*a* of a shaft 15, which protrudes from one of the lengthwise ends of the cleaning means frame 12, and the cylindrical hollow protrusion 16*a* of a bearing 16, which protrudes from the other lengthwise end of the cleaning means frame 12, are supported by positioning guides 102*a* and 102*b*, which is in the form of a groove, and with which a pair of side plates of the apparatus main assembly D are provided one for one, and also, so that a pair of cartridge guiding projection 12*a* and 12*b* of the cleaning means frame 12, which are located above the cylindrical projections 15*a* and 16*a*, are fitted in a pair of entrance guides 103*a* and 103*b*, one for one, which is in the form of a groove, and with which the abovementioned side plates of the apparatus main assembly D, one for one. Then, the cartridge C is to be inserted into the cartridge slot S from the cleaning means frame 12 side of the cartridge C in the direction parallel with the width direction of the cartridge C. As the cartridge C is inserted, the cylindrical projections 15*a* and 16*a* come into contact with the cartridge positioning surfaces 102*a*1 and 102*b*1 of the positioning guides 102*a* and 102*b*, becoming thereby fixed in position; in other words, the cartridge C is set in its image formation position in the apparatus main assembly D. Then, the operator covers the cartridge slot S by rotating the lid 101 toward the apparatus main assembly D about the shaft 101*a*.

Toward the end of the above-described insertion of the cartridge C into the apparatus main assembly D, an unshown coupling member attached to the lengthwise end of the bearing 16 of the photosensitive drum 10 engages with the coupling member (unshown) of the bearing 16 for the photosensitive drum 10, which is rotated by a motor (unshown) with which the apparatus main assembly D is provided. As the motor is rotated, not only is the photosensitive drum 10 is rotated by the rotation of the motor, but also, the development roller 20 and developer sending members 23 and 24 are rotated by the rotation of the motor through a gear train (unshown).

Further, the electrical contacts (unshown) with which the cartridge C is provided are electrically connected to the electrical contacts (unshown) on the main assembly side. As a result, it becomes possible for a charge bias to be applied to the charge roller 11 of the cartridge C from an electric power source (unshown) of the apparatus main assembly D, and also, for a development bias to be applied to the development roller 20.

When removing the cartridge C from within the apparatus main assembly D, the above-described procedure for mounting the cartridge C is carried out in reverse.

(4) Structure of Housing of Cartridge C

Figure 7:
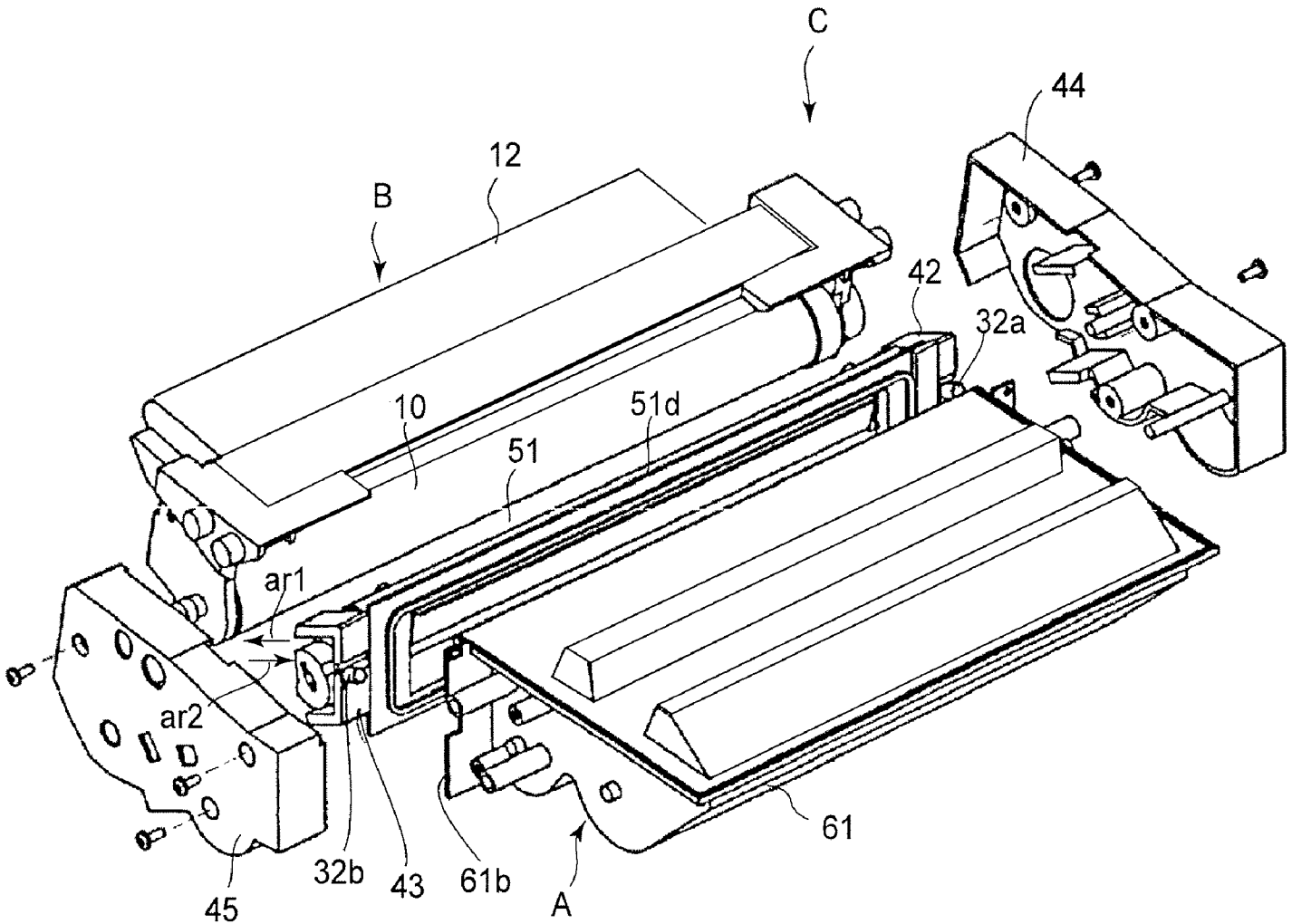
FIG. 7 is an exploded perspective view of the process cartridge, showing the housing structure thereof.

FIG. 7 is a drawing showing the structure of the housing of the cartridge C. It is an exploded perspective view of the cartridge C, showing the state of the cartridge C prior to its assembly.

The cartridge C in this embodiment is a cartridge made up of the development unit A and photosensitive member unit B, which are integrally joined. The developer storage frame 61 and cleaning means frame 12 are precisely positioned relative to each other by first and second side covers 44 and 45, which are solidly attached to the lengthwise ends of the developer storage frame 61 and cleaning means frame 12, with the use of fastening means such as screws, resinous bonding, welding, adhesive, etc. The developing means frame 51 is positioned between the developer storage frame 61 and cleaning means frame 12, and is held by the side covers 44 and 45 so that it is allowed to slide in the direction ar1, that is, toward the photosensitive drum 10, or direction ar2, that is, away from the photosensitive drum 10.

(5) Structure of Developing Means Frame 51 of Development Unit A

Figure 8:
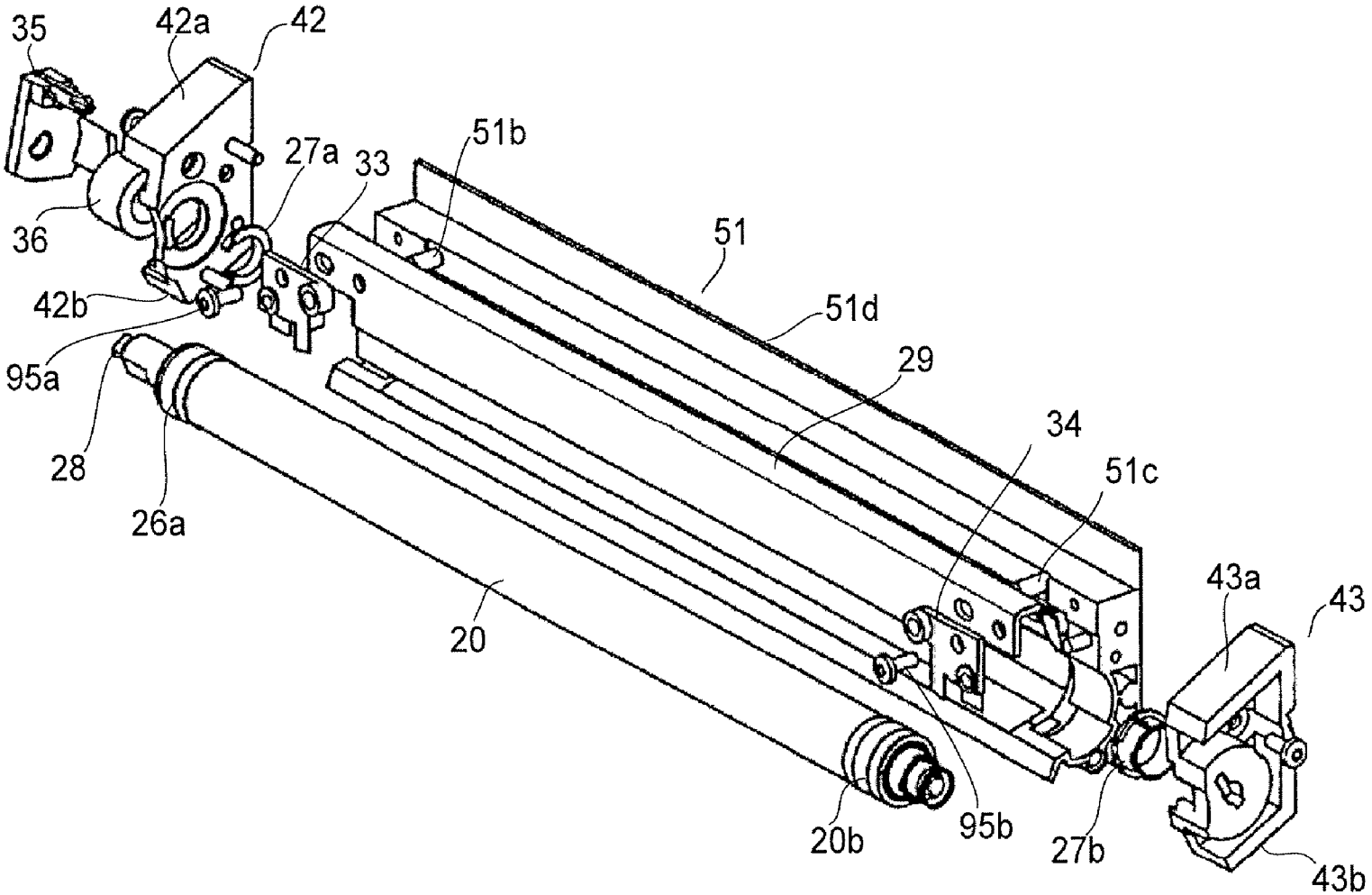
FIG. 8 is an exploded perspective view of the development unit, showing how the development roller and development blade are supported by the developing means frame.
Figure 9:
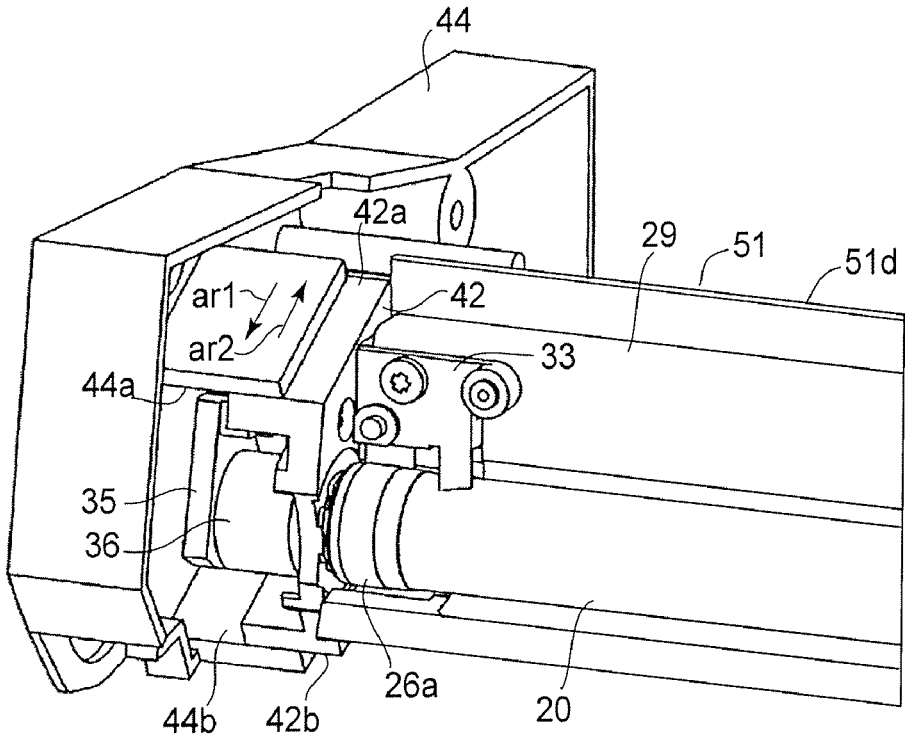
FIG. 9 is a schematic drawing showing how the developing means frame is supported by the side cover.
Figure 10:
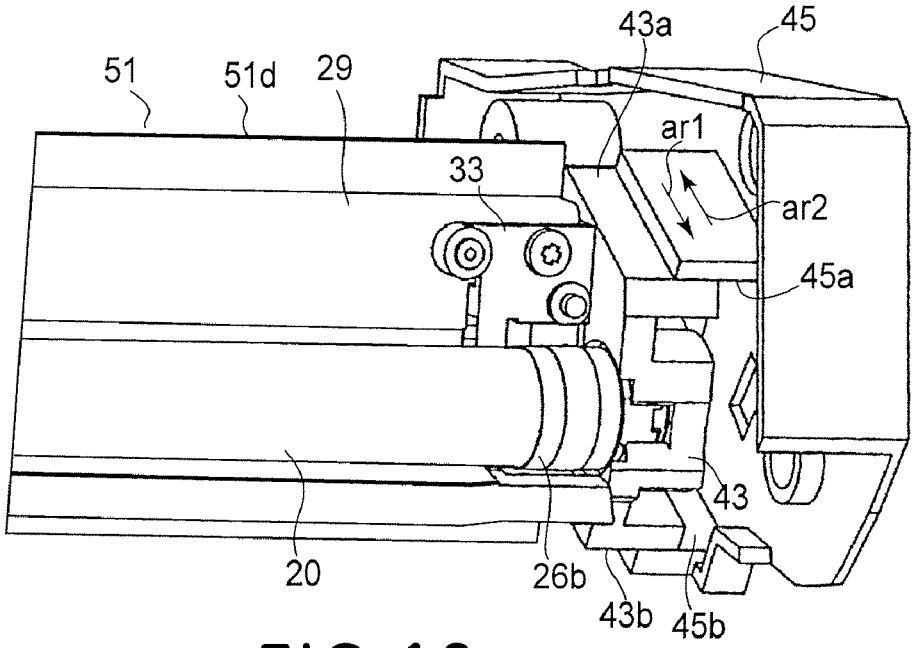
FIG. 10 is a schematic drawing showing how the developing means frame is supported by the side cover.

FIG. 8 is an exploded perspective view of the development unit A, showing how the development roller 20 and development blade 29 are supported by the developing means frame 51. FIG. 9 is a perspective view of the joint between one of the length wise ends of the development unit A and the side cover 44, showing how the developing means frame 51 is supported by the side cover 44. FIG. 10 is a perspective view of the joint between the other lengthwise end of the development unit A and the side cover 45, showing how the developing means frame 51 is supported by the side cover 45.

To one of the lengthwise ends of the developing means frame 51, a first end cover 42 is solidly attached, and to the other lengthwise end of the developing means frame 51, a second end cover 43 is solidly attached. The end covers 42 and 43 support the development roller 20 and development blade 29 by being solidly attached to the developing means frame 51. The development roller 20 is rotatably supported by the end covers 42 and 43 with a pair of bearings 27*a* and 27*b* interposed, respectively. The lengthwise end portions of the development roller 20 are fitted with a pair of rings 26*a* and 26*b*, the internal diameter of which is slightly larger than the external diameter of the development roller 20. The rings 26*a* and 26*b* are formed so that the thickness of their walls equals a size of a gap necessary between the photosensitive drum 10 and development roller 20. The development blade 29 is aligned with a pair of blade positioning bosses 51*b* and 51*c*, with which the developing means frame 51 is provided, being thereby precisely positioned, and then, is fastened to the developing means frame 51 with the use of a couple of small screws 95*a* and 95, respectively. As the development blade 29 is attached to the blade positioning bosses 51*b* and 51*c*, the blade proper 29*e* of the development blade 29 is placed in contact with the peripheral surface of the development roller 20.

To the lengthwise end of the development roller 20, which is on the end cover 42 side, a development roller gear 36 and a development roller gear retaining member 35 are attached. The development roller gear 36 transmits rotational driving force to the development roller 20. The development roller gear retaining member 35 prevents the development roller gear 36 from disengaging from the development roller 20, and also, supports the stationary magnet 28, which is inside the development roller 20.

To the lengthwise ends of the development blade 29, a pair of toner regulating members 33 and 34 are attached, one for one, which scrape the lengthwise end portions of the peripheral surface of the development roller 20 to guide the toner thereon toward the center of the development roller 20, in terms of the lengthwise direction of the development roller 20.

Referring to FIG. 8, the end covers 42 have flat surfaces 42*a* and 42*b*, which are the top and bottom surfaces of the end covers 42, by which the end cover 42 is supported by the side cover 44 so that it is allowed to slide relative to the side cover 44. The flat surfaces 42*a* and 42*b* are parallel with each other, and are inclined downwardly toward the photosensitive drum 10. Further, the end covers 43 have flat surfaces 43*a* and 43*b*, which are the top and bottom surfaces of the end covers 43, by which the end cover 43 is supported by the side cover 45 so that it is allowed to slide relative to the side cover 45. The flat surfaces 43*a* and 43*b* are parallel with each other, and are inclined downwardly toward the photosensitive drum 10. Referring to FIG. 9, the side cover 44 is provided with a pair of end cover guiding flat surfaces 44*a* and 44*b*, which oppose the flat surfaces 42*a* and 42*b*. The guiding surfaces 44*a* and 44*b* are parallel with each other and are inclined downwardly toward the photosensitive drum 10. Further, referring to FIG. 10, the side cover 45 is provided with a pair of end cover guiding flat surfaces 45*a* and 45*b*, which oppose the flat surfaces 43*a* and 43*b*. The guiding surfaces 45*a* and 45*b* are parallel with each other and are inclined downwardly toward the photosensitive drum 10. That is, the side covers 44 and 45 support the end covers 42 and 43, with the guiding surfaces 44*a* and 44*b* supporting the flat surfaces 42*a* and 42*b*, and guiding surfaces 45*a* and 45*b* supporting the flat surfaces 43*a* and 43*b*, respectively (FIGS. 9 and 10). The developing means frame 51, the lengthwise ends of which are fitted with the end covers 42 and 43, one for one, is supported by the guiding surfaces 44*a* and 44*b*, which guide the end covers 42 and 43 by their flat surfaces 42*a* and 42*b*. Therefore, the developing means frame 51 is slidable in the directions ar1 and ar2. That is, the developing means frame 51 is connected to the developer storage frame 61, with the interposition of the end covers 42 and 43, so that the developing means frame 51 is movable in the directions ar1 and ar2.

Referring to FIG. 5, the developing means frame 51 is kept pressed toward the photosensitive member unit B by a pair of springs 32*a* and 32*b* as pressure applying members, which are disposed between the end covers 42 and 43, and side covers 44 and 44, respectively. With the provision of the above-described structural arrangement, the development roller 20 is kept pressed toward the photosensitive drum 10, with a preset clearance kept between the development roller 20 and photosensitive drum 10 by the pair of rings 26*a* and 26*b*.

(6) Structural Arrangement for Forming A Seal Between Developing Means Frame 51 and Developer Storage Frame 61

Figure 11:
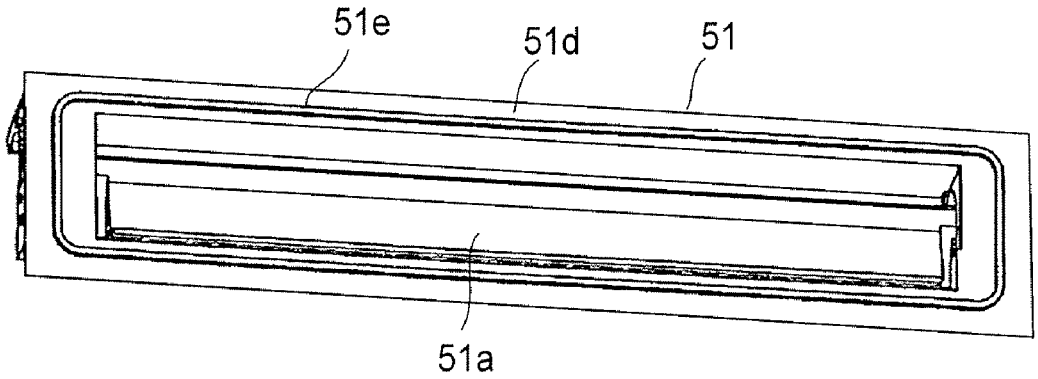
FIG. 11 is a perspective view of the developing means frame, as seen from the developer storage frame side.
Figure 12:
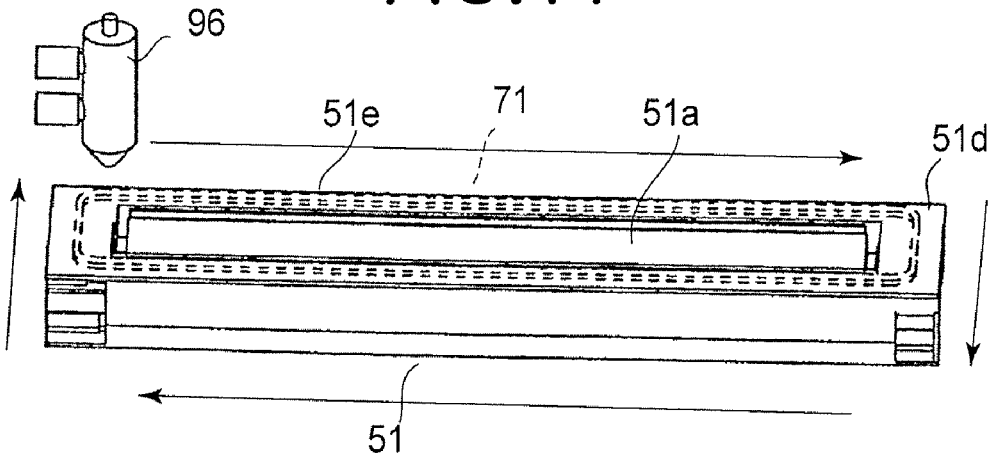
FIG. 12 is a perspective view of the developing means frame and an elastomer dispenser, showing one of the methods for applying elastomer on the developing means frame.
Figure 13:
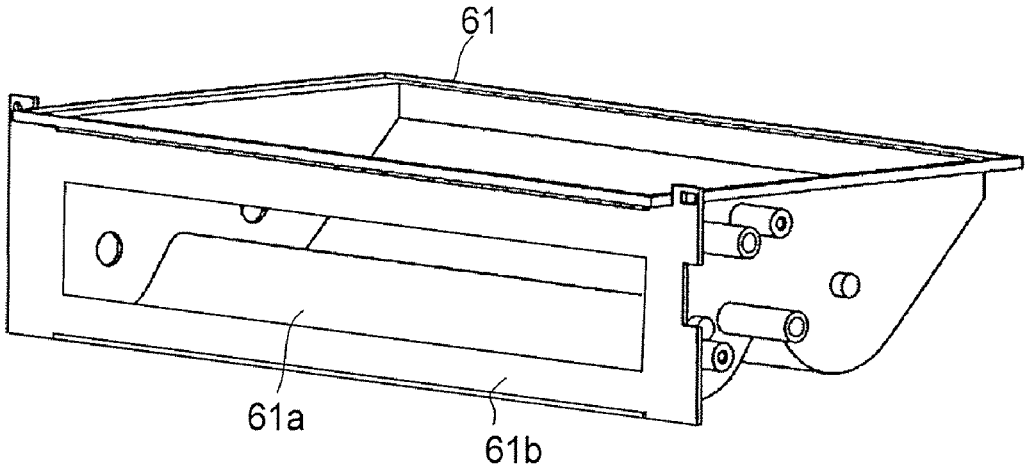
FIG. 13 is a perspective view of the developer storage frame, as seen from the developing means frame side.

FIG. 11 is a perspective view of the developing means frame 51, as seen from the developer storage frame 61 side. FIG. 12 is a perspective view of the developing means frame 51 and a dispenser 96, showing an example of the method for applying liquid elastomer 71 to the developing means frame 51. FIG. 13 a perspective view of the developer storage frame 61, as seen from the developing means frame 51 side.

Next, the method for assembling the developing means frame 51 and developer storage frame 61 will be described.

First, the developing means frame 51 shown in FIG. 11 is prepared (developing means frame preparation step). The developing means frame 51 has the second opening 51*a*, and a flange 51*d* as a second connective portion which surrounds the second opening 51*a*. Incidentally, the flange 51*d* does not need to be uniform in structure throughout its entire range around the second opening 51*a*; it may be nonuniform. The flange 51*d* is provided with an elastomer support rib 51*e* to which adhesive liquid elastomer 71 (elastic high-polymer) is applied. The elastomer support rib 51*e* is extended in a manner to surround the opening 51*a*, making up a rectangular frame. Referring to FIG. 12, the liquid elastomer 71 is applied to the elastomer support rib 51*e* by moving the dispenser 96 along the entirety of the elastomer support rib 51*e* in the direction indicated by an arrow mark, with the use of a numerically-controlled direct action unit. As the dispenser 96 is moved, the heated liquid elastomer 71 is applied to the top surface 51*e*1 of the elastomer support rib 51*e* as indicated by a chain line in the drawing (elastomer application step). Then, the applied elastomer 71 is solidified by cooling. Hereafter, the top surface 51*c*1 of the elastomer support rib 51*e* will be referred to as elastomer application surface 51*e*1. Further, the solidified elastomer 71 will be referred to simply as elastomer 71.

Next, the developer storage frame 61 shown in FIG. 13 is prepared (developer storage frame preparation step). The developer storage frame 61 has the first opening 61*a*, and a flange 61*b* as the first connective portion which surrounds the first opening 61*a*. Incidentally, it is unnecessary for the flange 61*b* to be uniform in structure through its entire range around the opening 61*a*, as is the flange 51*d* around the second opening 51*a*. The flange 61*b* is positioned so that as the developer storage frame 61 is joined with the developing means frame 51, it squarely opposes the flange 51*d* of the developing means frame 51.

Figure 1:
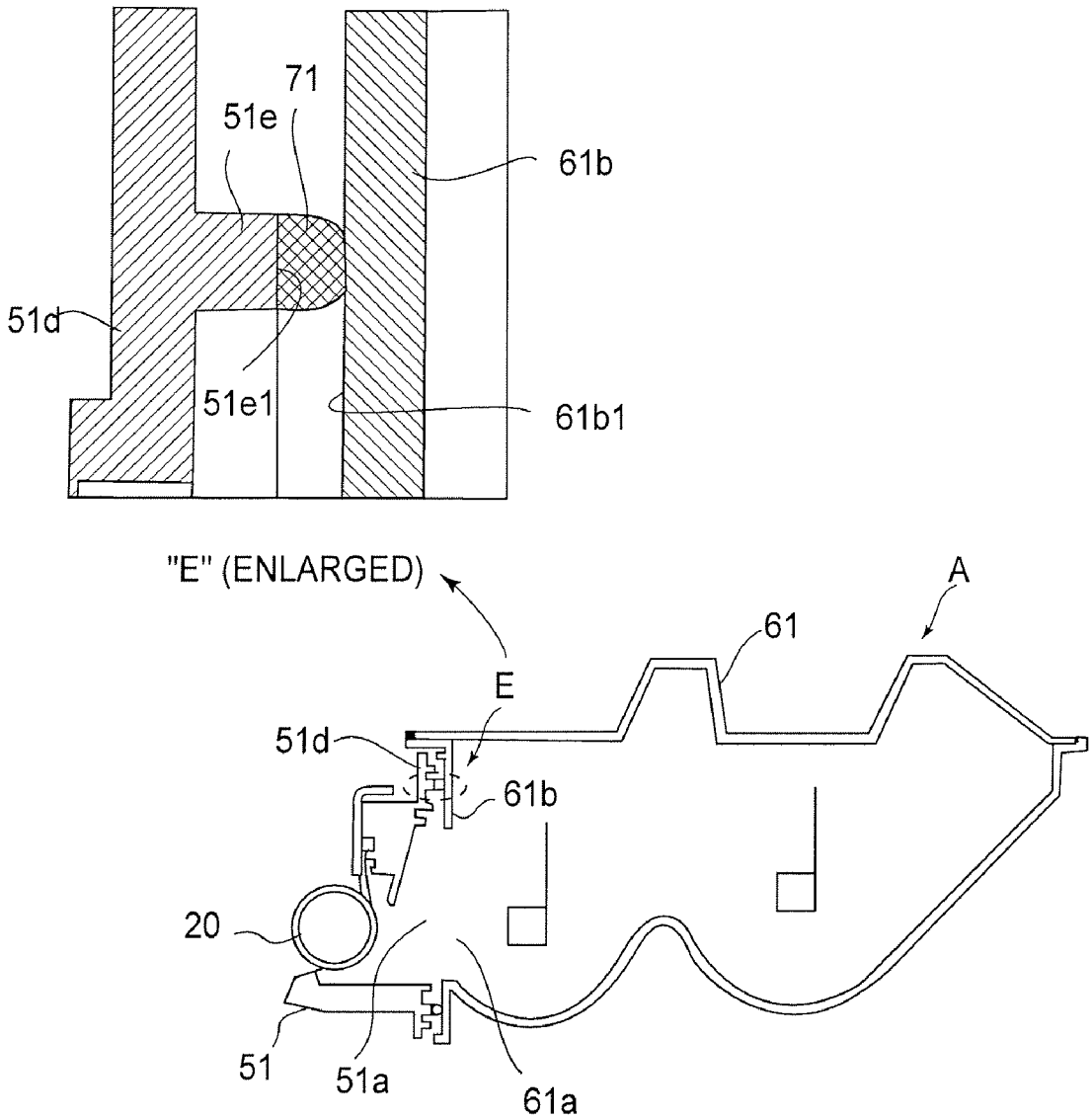
FIG. 1 is a cross-sectional view of the development unit in the first embodiment, showing the structural arrangement which allows the developing means frame joined with the developer storage frame to move relative to the developer storage frame.

FIG. 1 is a cross-sectional view of the joint, and its adjacencies, between the developing means frame 51 and developer storage frame 61 joined (connected) so that the two frames are movable relative to each other.

Referring to FIG. 1, in particular, the enlarged cross-sectional view of the joint E and its adjacencies, the developing means frame 51 and developer storage frame 61 are joined so that the elastomer 71 applied to the developing means frame 51 contacts the surface 61*b*1 of the flange 61*b* of the developer storage frame 61, so that the interface (contact area) between the elastomer 71 and surface 61*b*1 surrounds the openings 51*a* and 61*a* (frame joining step). As a result, the developing means frame 51 and developer storage frame 61 become connected to each other in such a manner that the two frames are allowed to move relative to each other, while keeping sealed the joint between the flanges 51*d* and 61*b*; toner is prevented from leaking through the joint between the flanges 51*d* and 61*b*.

The elastomer 71 is high in conformity, and therefore, the amount of pressure which needs to be applied to the elastomer 71 to make the elastomer 71 satisfactorily perform as a sealing member is relatively small. That is, the amount of pressure which needs to be applied to compress the elastomer 71 to seal the joint between the flanges 51*d* and 61*b* is relatively small. Therefore, the reactive force resulting from the pressure applied to the elastomer 71 to seal the joint between the flanges 51*d* and 61*b* is relatively small. In comparison, if foamed polyurethane is used as the material for the sealing member for sealing the joint between the flanges 51*d* and 61*b*, the sealing member (foamed polyurethane) must be compressed by a substantially larger amount than the elastomer 71 as a sealing member, in order for the polyurethane to be as effective as the elastomer 71. Thus, the amount of reactive force generated when the elastomer 71 is used is substantially smaller than that generated when foamed polyurethane is used. Therefore, using the elastomer 71 instead of a sealing member formed of foamed polyurethane can reduce the amount of pressure which is applied to the peripheral surface of the photosensitive drum 10 by the development roller 20 through the rings 26*a* and 26*b* fitted around the lengthwise ends of the development roller 20, compared to using the sealing member formed of foamed polyurethane alone. That is, this contact pressure (which hereafter will be referred to as pressure D) between the spacer rings 26*a* and 26*b* of the development roller 20, and the photosensitive drum 10 can be substantially reduced by placing the elastomer 7 to seal the joint between the flanges 51*d* and 61*b*, compared to placing a sealing member formed of foamed polyurethane.

The reduction in the pressure D reduces the amounts by which the photosensitive drum 10 is frictionally worn, the amount by which the shaft 15 which rotatably supports the photosensitive drum 10 is frictionally worn, and the amount by which the bearing 16 which rotatably supports the photosensitive drum 10 is frictionally worn. Reduction in the pressure D also reduces in the amounts by which the development roller, and the bearings 27*a* and 27*b* which rotatably support the development roller 20, are frictionally worn. It also reduces the amounts by which the rings 26*a* and 26*b* kept pressed upon the peripheral surface of the photosensitive drum 10 are frictionally worn, and the amounts by which the portions of the peripheral surface of the photosensitive drum 10, which correspond in position to the rings 26*a* and 26*b*, are frictionally worn. Thus, the reduction in the pressure D can extends the lives of the abovementioned components 10, 15, 16, 20, 26*a*, 26*b*, 27*a*, and 27*b*.

Moreover, the reduction in the pressure D reduces the amount by which heat is frictionally generated in the contact area between the photosensitive drum 10 and shaft 15, and the contact area between the photosensitive drum 10 and bearing 16, as the photosensitive drum 10 is rotated. The reduction in the pressure D also reduces the amount by which heat is frictionally generated in the contact area between the development roller 20 and bearing 27*a*, and the contact area between the development roller 20 and bearing 27*b*, as the development roller 20 is rotated. Further, it reduces the amount by which heat is generated in the contact area between the photosensitive drum 10 and development roller 20, the contact area between the peripheral surface of the photosensitive drum 10 and ring 26*a*, the contact area between the peripheral surface of the photosensitive drum 10 and ring 26*b*, as the photosensitive drum 10 and development roller 20 are rotated. Thus, the reduction in the pressure D makes it possible to reduce the number of fans necessary to be placed in the apparatus main assembly D, making it therefore possible to reduce the amount of electric power consumed by the fans.

Further, the reduction in the pressure D reduces the amount by which the development roller 20 is deformed by being kept pressed toward the photosensitive drum 10. Thus, the reduction in the pressure D makes it less likely for an image, which is nonuniform in density, to be formed due to the deformation of the development roller 20 attributable to the abovementioned contact pressure between the rings 26*a* and 26*b* of the development roller 20 and photosensitive drum 10; the reduction in the pressure D can improve the image forming apparatus in image quality.

Further, when assembling the development unit A, the developing means frame 51 and developer storage frame 61 can be connected by simply moving the developing means frame 51 and developer storage frame 61 toward each other in a straight line. Therefore, the development unit A is superior to a development unit in accordance with the prior art, in terms of assembly operation efficiency.

(7) Modified Version of Development Unit A in Embodiment 1

In this embodiment, the top surface 51*e*1 of the developing means frame 51, to which liquid elastomer 71 is applied, and the surface 61*b*1 of the developer storage frame 61 which the elastomer 71 contacts, are both perfectly flat. However, it is not mandatory that the elastomer application surface 51*e*1, and the surface 61*b*1 which the elastomer 71 contacts, be perfectly flat.

Figure 14:
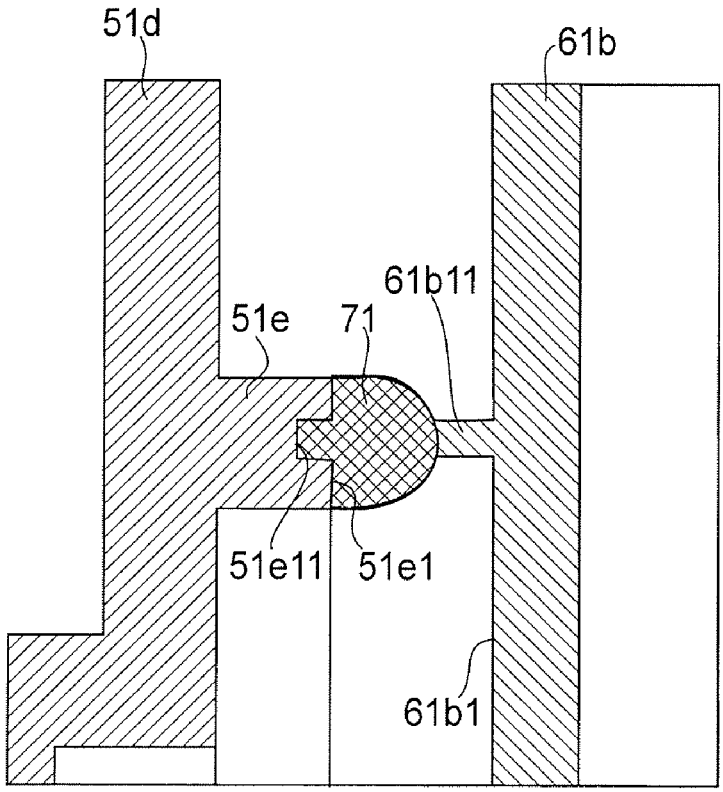
FIG. 14 is a schematic drawing of one of the modified versions of the development unit in the first embodiment.

FIG. 14 is a schematic drawing of one of the modified versions of the development unit A in this embodiment. More specifically, FIG. 14 is a schematic drawing of the joint, and its adjacencies, between the flange 51*d* of the developing means frame 51 and the flange 61*b* of the developer storage frame 61, showing the state of an airtight contact between the elastomer 71 and the rib 61*b*11 of the developer storage frame 61.

The elastomer application surface 51*e*1 is provided with a groove 51*e*11, and the surface 61*b*1 is provided with a rib 61*b*11 which the solidified elastomer 71 contacts. In this setup, as the liquid elastomer 71 is applied to the surface 51*b*1, it flows into the groove 51*c*11, increasing thereby the contact area between the elastomer 71 and the elastomer application surface 51*e*1. Therefore, this setup has a greater strength of the bond between the elastomer 71 and elastomer application surface 51*e*1. Further, in this modification, the elastomer 71 contacts only the top surface of the rib 61*b*11, instead of directly contacting the surface 61*b*1. Therefore, this modified version of development unit A in the first embodiment is smaller in the pressure D than the unmodified version of the development unit A in the first embodiment 1.

Figure 15:
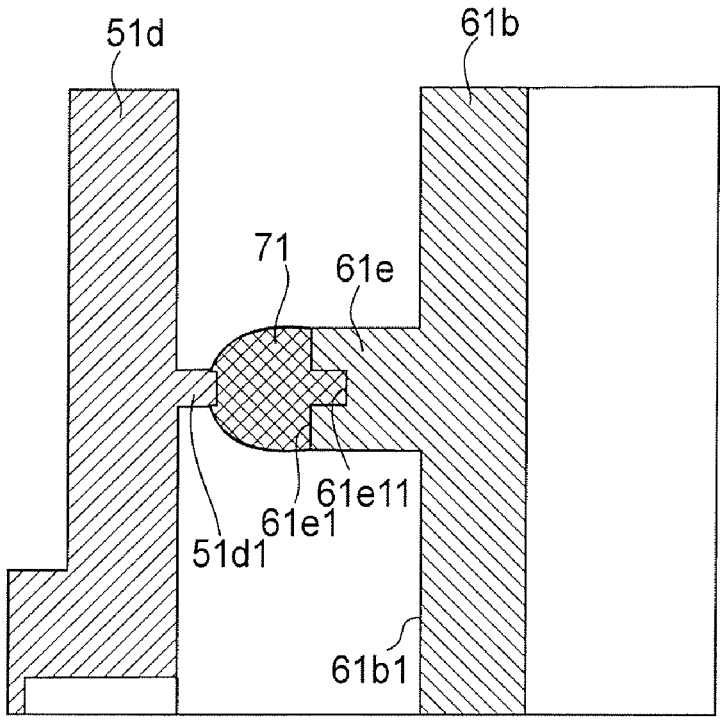
FIG. 15 is a schematic drawing of another of the modified versions of the development unit in the first embodiment.

FIG. 15 is a schematic drawing of another modified version of the development unit A in this embodiment. More specifically, FIG. 15 is a schematic drawing of the joint, and its adjacencies, between the flange 51*d* of the developing means frame 51 and the flange 61*b* of the developer storage frame 61, showing the state of an airtight contact between the elastomer 71 and the rib 51*d*1 of the developing means frame 51.

The liquid elastomer 71 may be applied to the top surface (which hereafter may be referred to liquid elastomer application surface) of the elastomer support rib 61*e* which projects from the flange 61*b* in a manner to surround the opening 61*a* of the developer storage frame 61. In this case, the elastomer application surface 61*e*1 may be provided with a groove 61*e*11 so that as the liquid elastomer 71 is applied to the surface 61*b*11, it flows into the groove 61*e*11, increasing thereby the contact area between the elastomer 71 and the elastomer application surface 61*e*1. Therefore, this modified version of the development unit A in the first embodiment has a also greater strength of the bond between the elastomer 71 and elastomer application surface 51*e*1 than the unmodified version of the development unit A in the first embodiment. Further, it is possible to provide the flange 51*d* with a rib 51*d*1, the top surface of which the elastomer 71 contacts, in order to reduce the pressure D.

Figure 16:
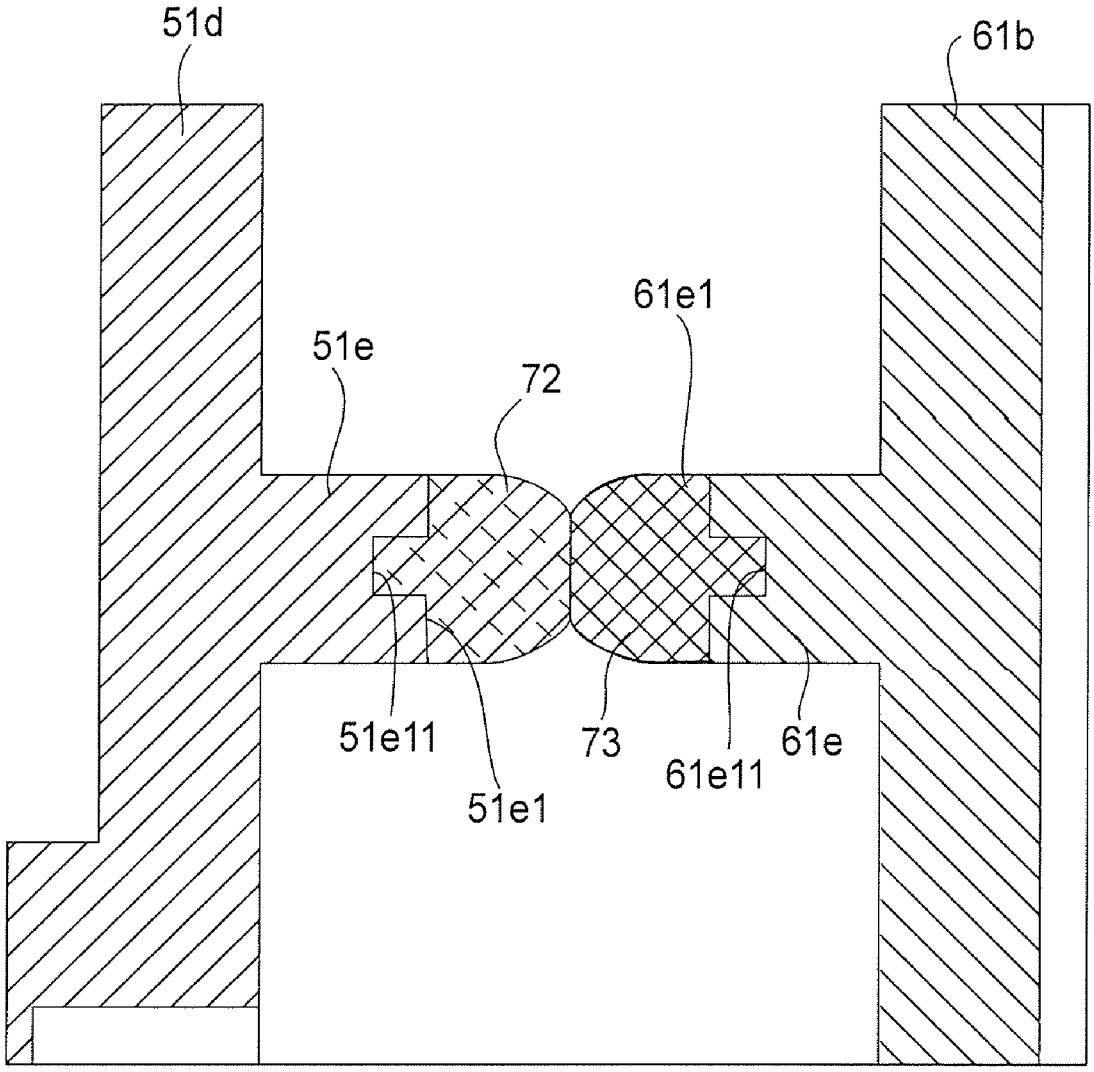
FIG. 16 is a schematic drawing of yet another of the modified versions of the development unit in the first embodiment.

FIG. 16 is a schematic drawing of yet another modified version of the development unit A in the first embodiment. More specifically, FIG. 16 is a schematic sectional view of the joint, and its adjacencies, of the flanges 51*d* and 61*b*, showing the state of (airtight) contact between the elastomer 72 attached to the developing means frame 51, and the elastomer 73 attached to the developer storage frame 61.

In this modified version of the development unit A in this embodiment, liquid elastomers (72) and (73) are applied to the elastomer application surface 51*e*1 of the elastomer support rib 51*e*, and the elastomer application surface 61*e*1 of the elastomer support rib 61*e*, respectively (elastomer application step). That is, the liquid elastomer is applied to the elastomer application surfaces 51*e*1 and 61*e*1 so that solidified elastomers 72 and 73 are formed on the elastomer application surfaces 51*e*1 and 61*e*1, respectively. Then, the developing means frame 51 and developer storage frame 61 are joined so that the two elastomers 72 and 73 are in airtight contact with each other (elastomer contact step). Therefore, this modified version of the development unit A is smaller in the amount of reactive force generated as the developing means frame 51 and developer storage frame 61 are joined and attributable to the resiliency of the solidified elastomer (elastomers 72 and 73) than the preceding modified version, which is smaller in the above-mentioned reactive force than the unmodified version of the development unit A in this embodiment; this modified version of the development unit A is much more smaller in the pressure D than those shown in FIGS. 14 and 15. Incidentally, a sealing member formed of foamed polyurethane or the like, which is elastic, may be adhered to one of the abovementioned frames so that the elastomer is in airtight contact with this sealing member formed of foamed polyurethane. Such an arrangement also can reduce the amount of the reactive force.

In this embodiment, the elastomers 71, 72, and 73 are formed by solidifying liquid elastomer by cooling. However, the method for solidifying liquid elastomer does not need to be limited to cooling. For example, instead of the liquid elastomer used in this embodiment, such liquid elastomer that solidifies as it is mixed with a specific liquid may be employed as the material for the elastomers 71, 72, or 73. Such liquid elastomer can also be used as the material for the elastomers in the second, third, and fourth preferred embodiments of the present invention, which will be described below.

Embodiment 2

Next, the development unit in another embodiment of the present invention will be described.

The components in this embodiment, which are identical to those in the first embodiment will be given the same reference numerals and characters as those given to the counterparts in the first embodiment, and will not be described in order not to repeat the same descriptions. Like the development unit A in the first embodiment, the development unit A in this embodiment also is integrally joined with the photosensitive member unit B to make up the cartridge C, and so is the cartridge C in the third embodiment.

Figure 17:
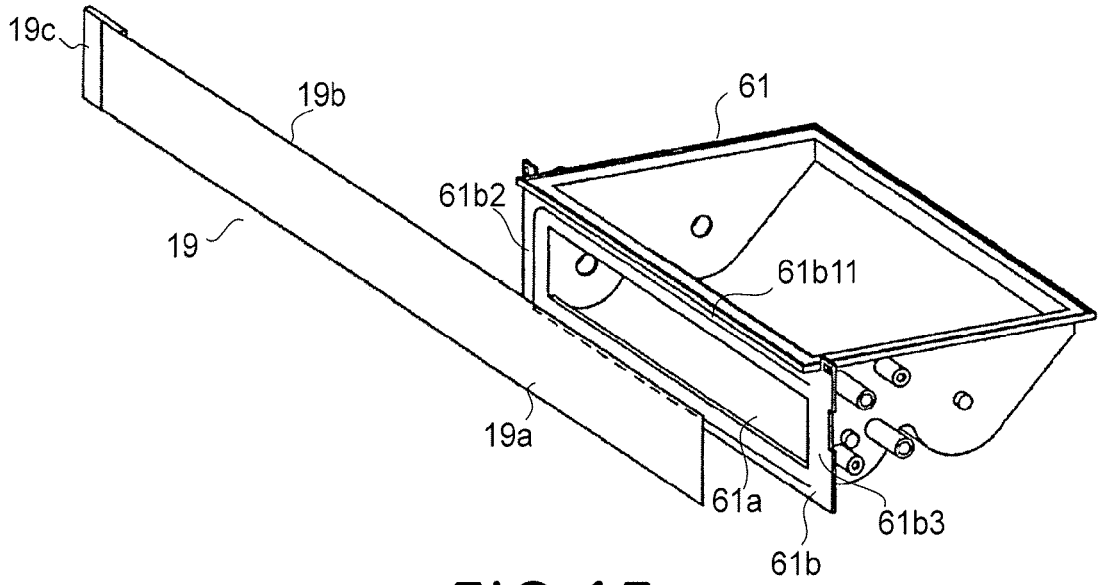
FIG. 17 is a schematic drawing of the developing unit, in the second embodiment, prior to the attachment of the toner sealing member to the developer storage frame.
Figure 18:
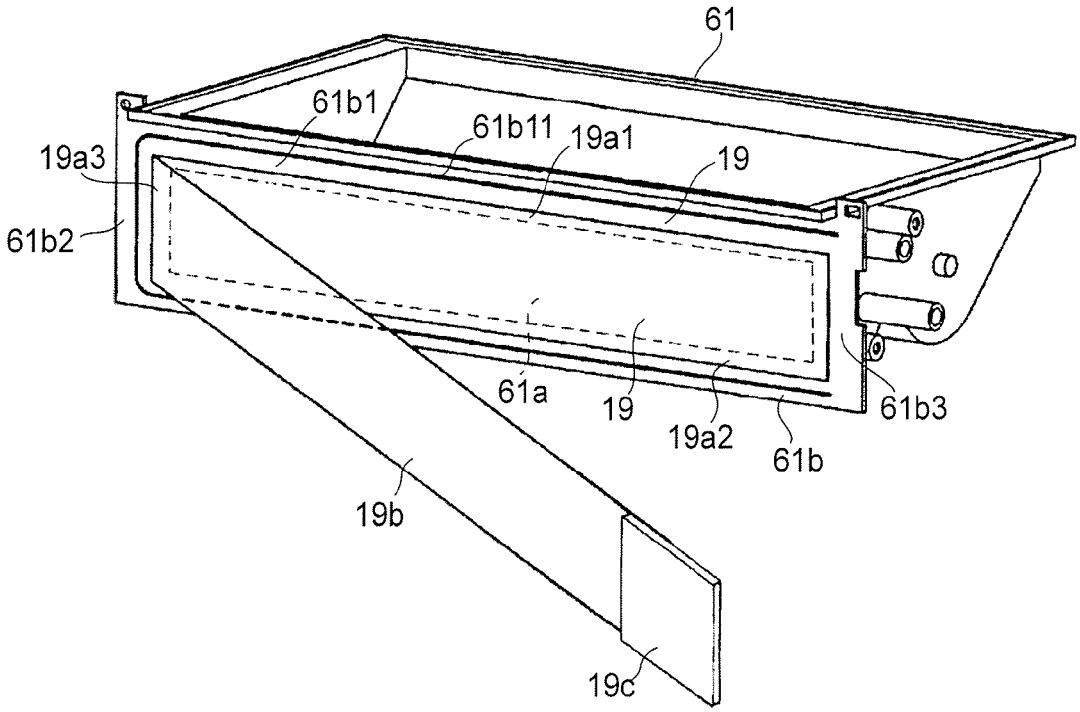
FIG. 18 is a schematic drawing of the developing unit, in the second embodiment, after the attachment of the toner sealing member to its developer storage unit.
Figure 19:
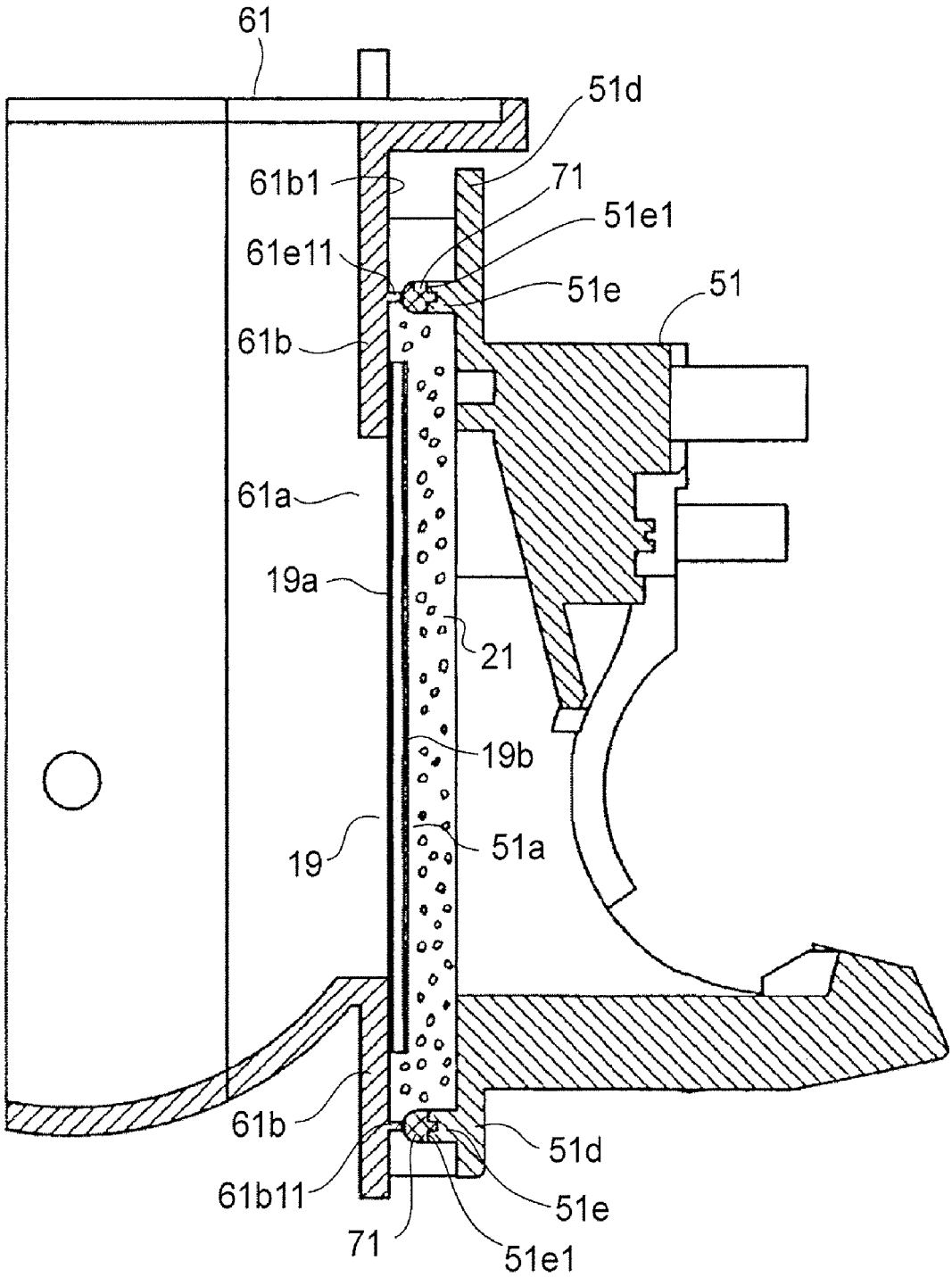
FIG. 19 is a cross-sectional view of the roughly the center of the development unit, in terms of the lengthwise direction of the development unit, in the second embodiment.
Figure 20:
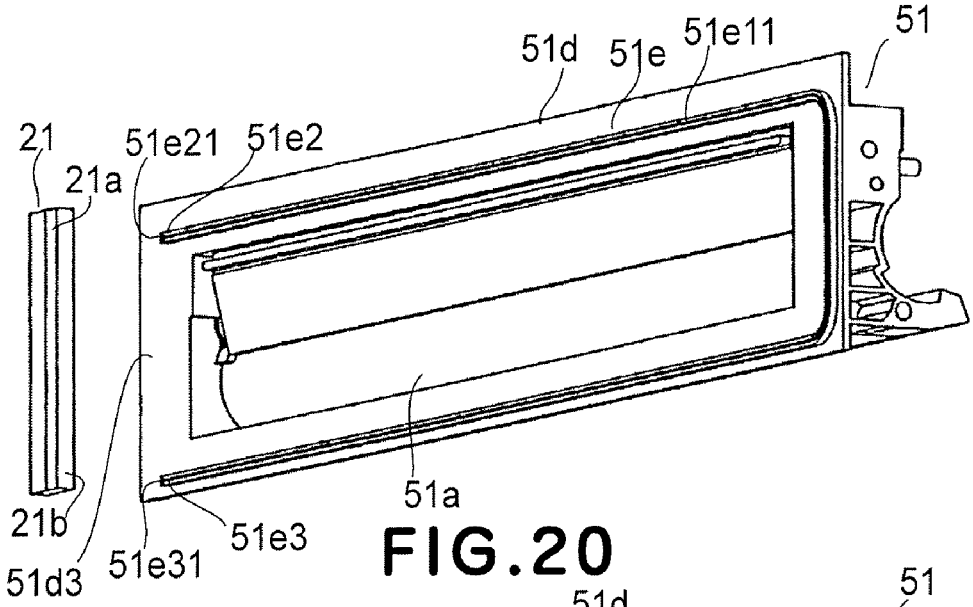
FIG. 20 is a perspective view of the development unit in the second embodiment prior to the attachment of the elastic sealing member to the developing means frame.
Figure 21:
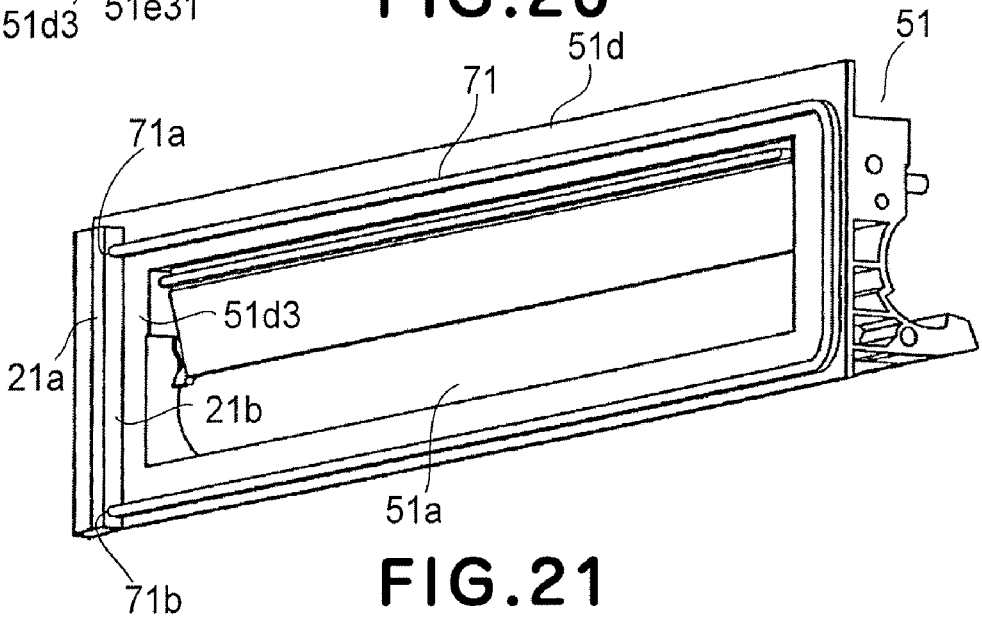
FIG. 21 is a perspective view of the development unit in the second embodiment after the attachment of the elastic sealing member to the developing means frame.

FIG. 17 is a drawing of the developer storage frame 61 and a developer storage frame sealing member 19 (which hereafter will be referred to simply as sealing member) before the sealing member 19 is attached to the developer storage frame 61. FIG. 18 is a drawing of the developer storage frame 61 and a developer storage frame sealing member 19 after the sealing member 19 is attached to the developer storage frame 61. FIG. 19 is a cross-sectional view of the roughly center portion of the development unit A, in terms of the lengthwise direction of the development unit A. FIG. 20 is a drawing of the developing means frame 51 and an elastic sealing member 21 before the elastic sealing member 21 is attached to the developing means frame 51. FIG. 21 is a drawing of the developing means frame 51 and an elastic sealing member 21 after the elastic sealing member 21 is attached to the developing means frame 51.

In order to prevent the toner in the development unit A of the cartridge C from leaking during the distribution of the cartridge C, the opening 61*a* of the developer storage frame 61 is sealed by thermally welding the edge portions of the sealing portion 19*a* of the sealing member 19 to the flange 61*b* of the developer storage frame 61, or adhering the edge portions of the sealing portion 19*a* of the sealing member 19 to the flange 61*b* of the developer storage frame 61 with the use of two-sided adhesive tape, or the like bonding means (FIGS. 17 and 18). The sealing member 19 is positioned so that the edge portions of the sealing portion 19*a* is placed between the opening 61*a* and rib 61*b*11 of the developer storage frame 61. Further, the longer edge portions 19*a*1 and 19*a*2 of the sealing portion 19*a* of the sealing member 19 and the shorter edge portion 19*a*3 of the sealing portion 19*a* of the sealing member 19 are adhered to the surface 61*b*1 (FIG. 18). The extension portion 19*b* of the sealing member 19, which extends from the sealing portion 19*a*, is folded back at the lengthwise end 61*b*2 of the flange 61*b*, is overlaid on the sealing portion 19*a* across the entire length of the sealing portion 19*a*, from the lengthwise end 61*b*2 to the lengthwise end 61*b*3, that is, the other lengthwise end of the flange 61*b*, and is extended outward of the development unit A through the gap provided between the corresponding ends of the flanges 61*b* and 51*d* of the developer storage frame 61 and developing means frame 51, respectively (FIG. 19). To the outward end of the extension portion 19*b*, a tab 19*c* which a user grasps when pulling out the sealing member 19 is attached.

Figure 22:
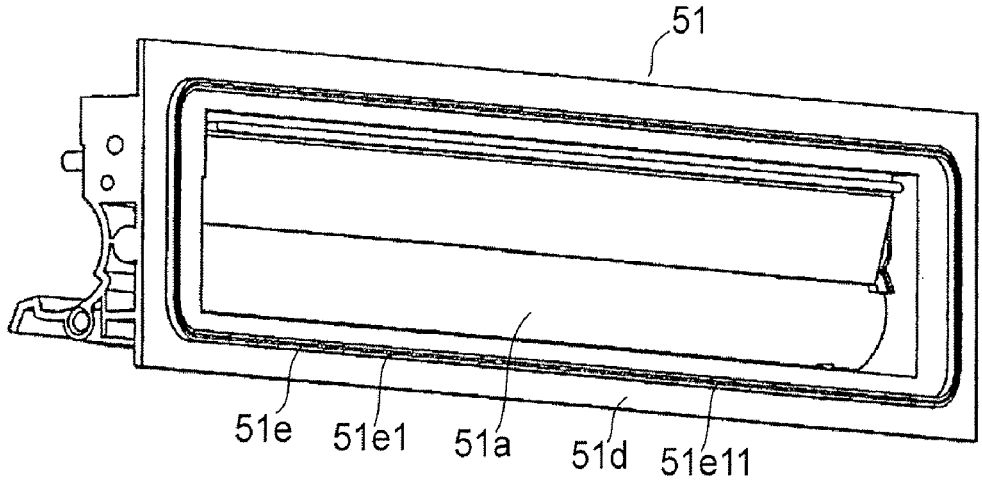
FIG. 22 is a perspective view of the developing means frame of the development unit in the third embodiment, as seen from the developer storage frame side.

Referring to FIGS. 21 and 22, the developing means frame 51 is provided with an elastic sealing member 21, which is adhered to the lengthwise end 51*d*3 of the developing means frame 51, with the use of two-sided adhesive tape. The elastic sealing member 21 is formed of polyurethane or the like. The area of the elastic sealing member 21, which comes into contact with the sealing member 19, is coated with a specific member 21*a*. This member 21*a* is very high in the slipperiness relative to the sealing member 19. Referring to FIG. 19, the elastic sealing member 21 adhered to the developing means frame 51 remains compressed between the developing means frame 51 and the lengthwise end portion 61*b*3 of the developer storage frame 61. Thus, the elastic sealing member 21, along with the extension portion 19*b* of the sealing member 19, keeps sealed the gap between the developing means frame 51 and developer storage frame 61, through which the extension portion 19*b* of the sealing member 19 is placed. Therefore, the toner in the development unit A is prevented from leaking during the distribution of the cartridge C.

The sealing member 19 is to be pulled out by a user before the cartridge C is mounted into the apparatus main assembly D. As the sealing member 19 is pulled out, the openings 61*a* and 51*a* become connected, making it possible for the toner in the developer storage frame 61 to be supplied to the development roller 20 in the developing means frame 51 through the opening 61*a* and 51*a*.

Referring to FIG. 20, the flange 51*d* is provided with the rib 51*e* as an elastomer support, which extends in a manner to surround the opening 51*a*, except for the lengthwise end portion 51*d*3 to which the elastic sealing member 21 is adhered. To this elastomer support 51*e*, the liquid elastomer 71 is applied. The elastomer application surface 51*e*1 of the elastomer support 51*e* is provided with a groove 51*c*11 as is the elastomer application surface 51*e*1 in the first embodiment. The elastic sealing member 21 is adhered to the lengthwise end portion 51*d*3, with the surface 21*b* of the elastic sealing member 21 placed in contact with the end surfaces 51*d*21 and 51*e*31 of the lengthwise ends 51*e*2 and 51*e*3, respectively, of the sealing member 21. Next, referring to FIG. 21, the liquid elastomer 71 is applied to the elastomer application surface 51*e*1, using the dispenser 96 (FIG. 12). At the same time, liquid elastomer is applied to the lengthwise ends 51*e*2 and 51*e*3 of the elastomer support rib 51*e* to ensure that there will be no gap between the surface 21*b* of the elastic member 21 and the lengthwise ends 51*e*2 and 52*e*3. Then, the liquid elastomer 71 is solidified by cooling; the liquid elastomer 71 is turned into the elastomer 71.

Referring to FIG. 18, the surface 61*b*1 of the flange 61 is provided with the rib 61*b*11, which corresponds in position to the elastomer 71.

Referring to FIG. 19, as the developing means frame 51 and developer storage frame 61 are joined so that they are allowed to move relative to each other, the elastomer 71 of the developing means frame 51 comes into contact with the end surface of the rib 61*b*11, sealing thereby between the flanges 51 and 61, except for the area which corresponds in position to the elastic sealing member 21. Therefore, it is possible to prevent the toner in the development unit A from leaking through the joint between the flanges 51 and 61, except through the area corresponding to the elastic sealing member 21.

According to this embodiment, even in the case of a development unit A provided with the toner sealing member 19, the same functions and operations as those obtained in the first embodiment can be obtained by widening, as much as possible, the range which the elastomer 71 seals.

Embodiment 3

Next, the development unit in another embodiment of the present invention will be described.

Figure 23:
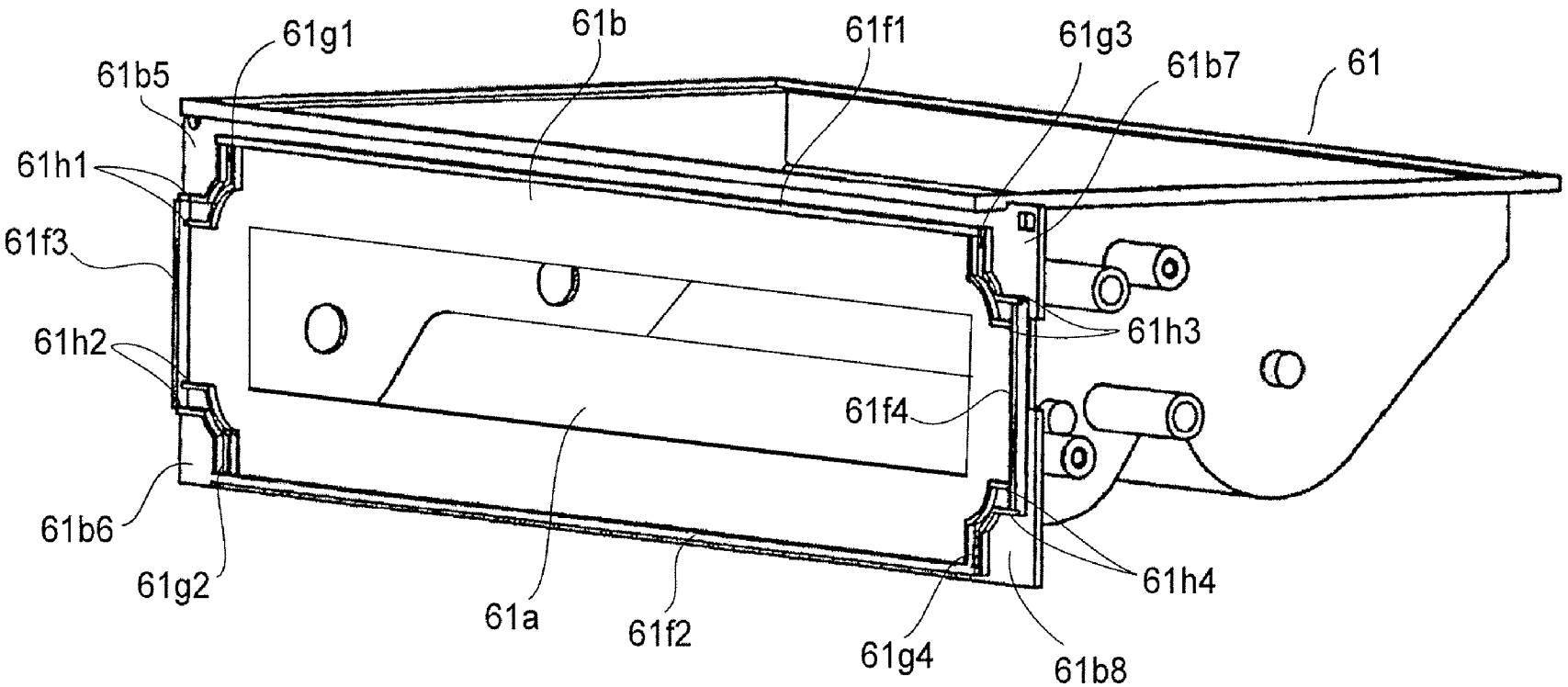
FIG. 23 is a perspective view of the developer storage frame of the development unit in the third embodiment, as seen from the developing means frame side.
Figure 24:
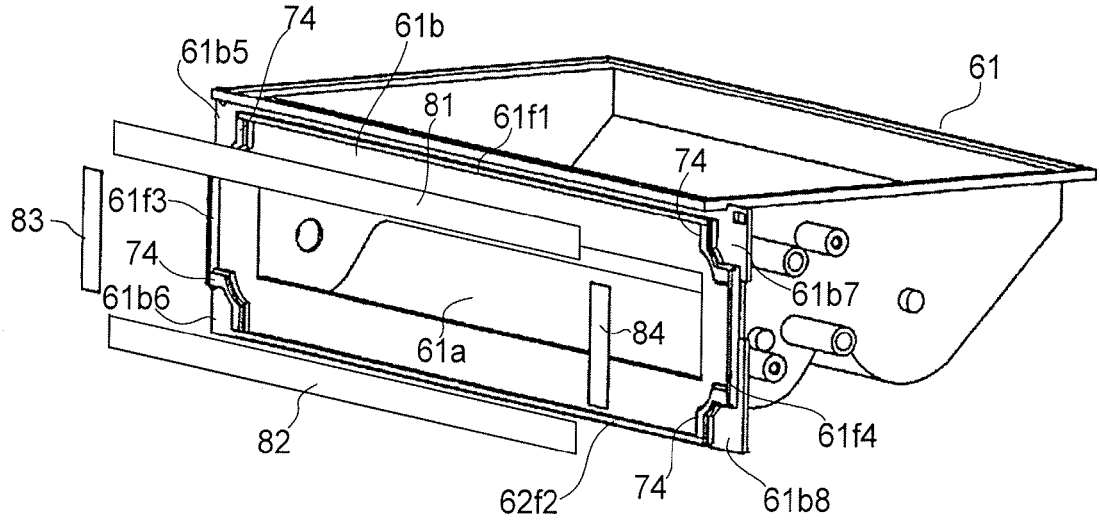
FIG. 24 is a perspective view of the developer storage frame of the development unit in the third embodiment prior to the attachment of the elastic sealing member to the developer storage frame.
Figure 25:
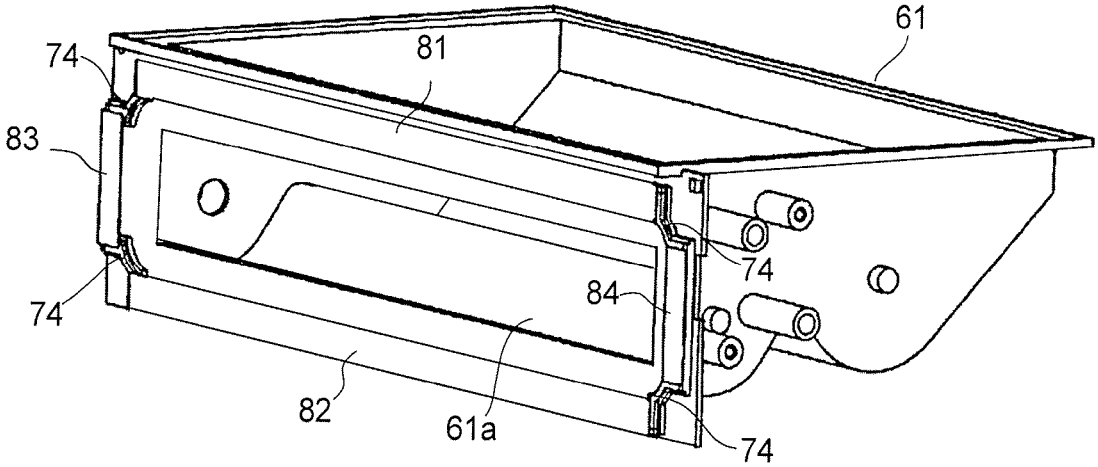
FIG. 25 is a perspective view of the developer storage frame of the development unit in the third embodiment after the attachment of the elastic sealing member to the developer storage frame.
Figure 26:
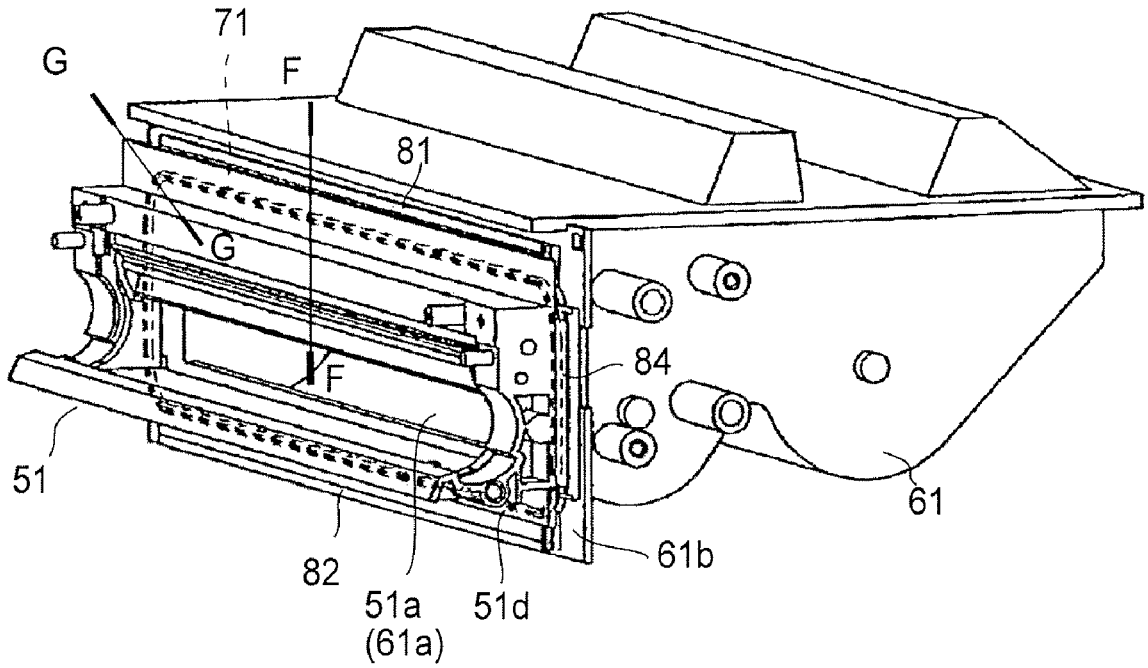
FIG. 26 collectively shows a perspective view and cross-sections of the developer storage frame and developing means frame of the development unit in the third embodiment, which have been joined by their flanges.
Figure 26:
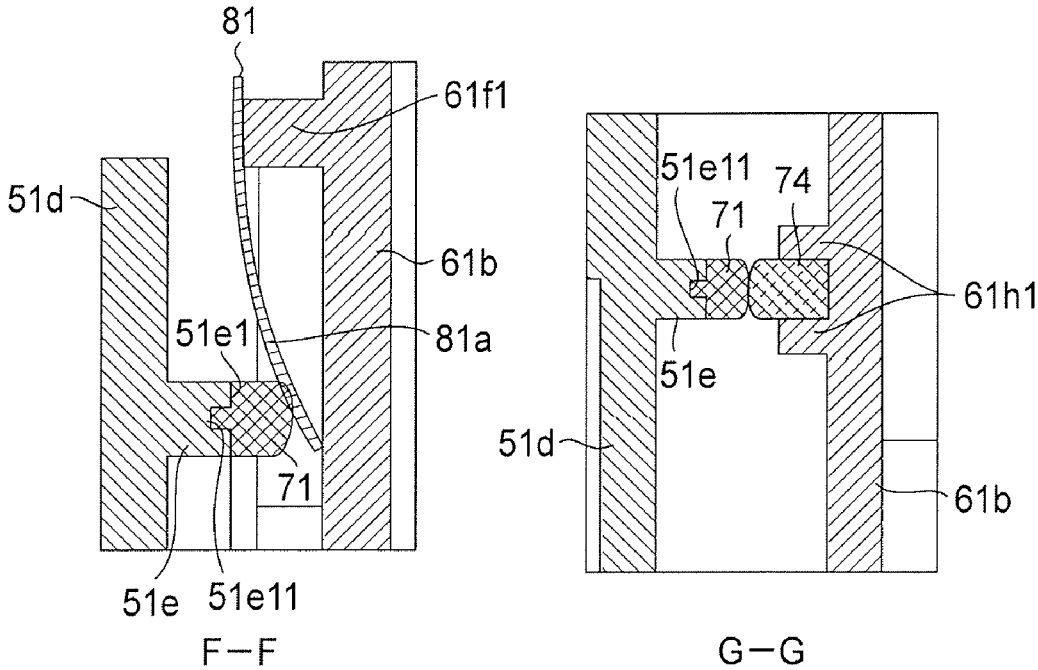

FIG. 22 is a perspective view of the developing means frame 51 as seen from the developer storage frame 61 side. FIG. 23 is a perspective view of the developer storage frame 61 as seen from the developing means frame 51 side. FIG. 24 is a perspective view of the developer storage frame 61 prior to the attachment of the elastic sealing members 81, 82, 83, and 84 to the developer storage frame 61. FIG. 25 is a perspective view of the developer storage frame 61 after the attachment of the elastic sealing members 81, 82, 83, and 84 to the developer storage frame 61. FIG. 26 is a perspective view of the developing means frame 51 and developer storage frame 61, which have been joined by their flanges 51*d* and 61*b*.

Referring to FIG. 22, the flange 51*d* is provided with an elastomer support rib 51*e* to which liquid elastomer 71 is applied. The elastomer support rib 51*e* extends in a manner to surround the opening 51*a*. The elastomer application surface 51*e*1 of the elastomer support rib 51*e* is provided with a groove 51*e*11 as is the elastomer application surface 51*e*1 in the first embodiment. Referring to FIG. 26, the liquid elastomer 71 is applied to the elastomer application surface 51*e*1 using the dispenser 96 (FIG. 12) (elastomer application step). Then, the liquid elastomer 71 is solidified by cooling.

Referring to FIG. 23, the four corners of the flange 61*b* of the developer storage frame 61 have four grooves 61*g*1, 61*g*2, 61*g*3, and 61*g*4, which correspond in position to the outward areas of the four corners (corner areas) 61*b*5, 61*b*6, 61*b*7, and 61*b*8 of the opening 61*a*. The grooves 61*g*1, 61*g*2, 61*g*3, and 61*g*4 are positioned so that their positions coincide with the portions of the elastomer 71, which are on the outward areas of the four corners (corner areas) of the opening 51*a* of the developing means frame 51. Further, the grooves 61*g*1, 61*g*2, 61*g*3, and 61*g*4 are surrounded by ribs 61*h*1, 61*h*2, 61*h*3, and 61*h*4, which protrude toward the developing means frame 51.

The straight edge portions of the flange 61*b* of the developer storage frame 61, that is, the edge portions other than the abovementioned portions which correspond in position to the four corners of the opening 61*a*, are provided with ribs 61*f*1, 61*f*2, 61*f*3, and 61*f*4, which are positioned so that they are on the outward side of the portions of the elastomer 71, which are formed on the straight edge portions of the flange 51*d*, that is, the edge portions other than the edge portions which correspond in position to the four corners of the opening 51*a*. The 61*f*1, 61*f*2, 61*f*3, and 61*f*4 protrude by a height greater than the height by which the ribs 61*h*1, 61*h*2, 61*h*3, and 61*h*4 protrude.

Referring to FIGS. 24 and 25, the elastic members 81, 82, 83, and 84 are attached to the top surfaces of the ribs 61*f*1, 61*f*2, 61*f*3, and 61*f*4, respectively (elastic member attachment step). As for the examples of the means for attaching the elastic members 81, 82, 83, and 84, they may be attached using two-sided adhesive tape, or may be thermally welded. The elastic members 81, 82, 83, and 84 are in the form of a sheet, and are formed of metal or resin.

Into the grooves 61*g*1, 61*g*2, 61*g*3, and 61*g*4, liquid elastomer 71 is injected using the dispenser 96 (FIG. 12) (FIGS. 24 and 25), by such an amount that the body of the injected liquid elastomer 71 protrudes slightly higher than the elastic members 81, 82, 83, and 84, and also, that it airtightly fills the gaps between the adjacent two elastic members among the elastic members 81, 82, 83, and 84. Then, the liquid elastomer 71 is solidified by cooling.

Referring to FIG. 26, the developing means frame 51 and developer storage frame 61 are joined by their flanges 51*d* and 61*b*. That is, the portions of the elastomer 71, which correspond in position to the straight edges of the flanges 51*d* and 61*b* (enlarged cross-sectional view at line F-F), are placed in airtight contact with the third sealing areas, that is, the free edge portions 81*a*, 82*a*, 83*a*, and 84*a* (opposite portions from portions by which elastic members are attached to developer storage frame 61) of the elastic members 81, 82, 83, and 84 (elastic member contact step). In this step, at the corners of the flanges 51*d* and 61*b* (enlarged cross-sectional view at line G-G), the elastomers 71 and 74, with which the developing means frame 51 and developer storage frame 61 are provided, respectively, come into airtight contact with each other. Thus, the developing means frame 51 and developer storage frame 61 are joined by the flanges 51*d* and 61*b*, with the joint between the developing means frame 51 and developer storage frame 61 sealed by the elastic members 81, 82, 83, and 84, and elastomers 71 and 74 so that the toner does not leak.

This embodiment makes it possible to keep the pressure D low, even if the amount by which the elastomers 71 and 74 need to be compressed increases due to the variations in the measurements of the developing means frame 51 and/or developer storage frame 61. That is, the provision of the elastic members 81, 82, 83, and 84 in the form of a sheet reduces the effects which the variations in the measurements of the developing means frame 51 and/or developer storage frame 61 have on the reactive force generated in the elastomers 71 and 74. Therefore, the pressure D is kept small.

In this embodiment, the elastomer 71 is placed on the elastomer support rib 51*e*. Instead, however, the elastomer 71 may be placed on the top surfaces (surfaces on developer means frame 51 side) of the third contact areas 81*a*, 82*a*, 83*a*, and 83*d* of the elastic members 81, 82, 83, and 84, respectively, attached to the developer storage frame 61. In such a case, the elastomer 71 placed on the third contact areas 81*a*, 82*a*, 83*a*, and 84*a* is in airtight contact with the elastomer application surface 51*e*1 of the elastomer support rib 51*e* (cross-sectional view at F-F).

Also in this embodiment, not only is the elastomer 71 placed on the elastomer support rib 51*e*, but also, the elastomer 74 is placed on the corner areas of the flange 61*d*. In addition, the elastic members 81, 82, 83, and 84 are attached to the straight edges portions of the flange 61. Instead, however, the elastomer 71 may be attached to the developer storage frame 61 by providing the developer storage frame 61 with an elastomer support rib, whereas the elastic members 81, 82, 83, and 84 may be attached to the straight edge portions of the flange 51.

Further, the elastic members 81, 82, 83, and 84 may be integrally formed with the developer storage frame 61 or developing means frame 51.

Figure 27:
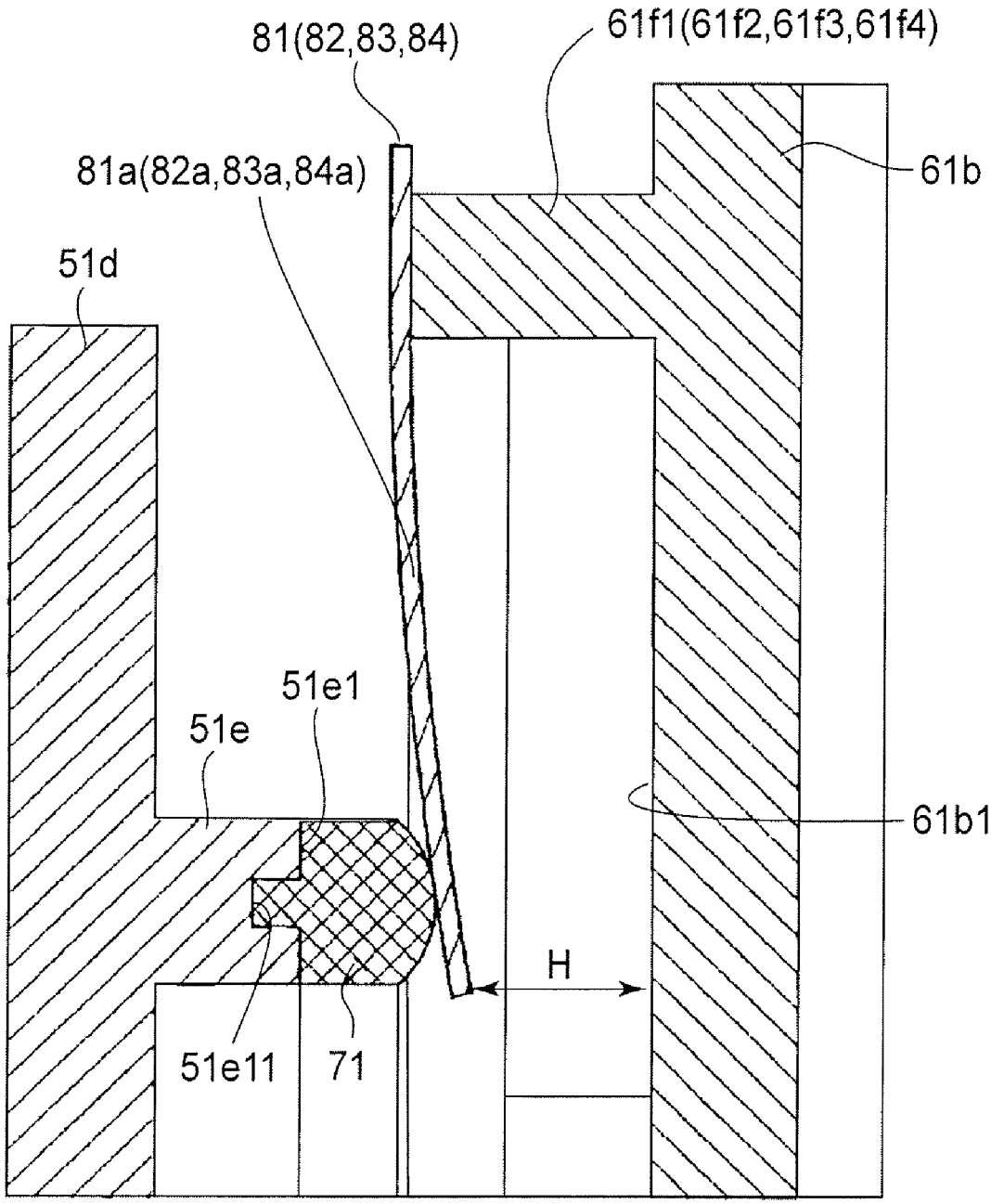
FIG. 27 is a drawing showing one of the modified versions of the development unit in the third embodiment.

FIG. 27 is a drawing of a modified version of the development unit A in this embodiment. More specifically, FIG. 27 is a cross-sectional view of the joint between the flanges 51*d* and 61*b* of the developing means frame 51 and developer storage frame 61, respectively, showing the state of the airtight contact between the elastomer 71 and each of the third contact areas 81*a*, 82*a*, 83*a*, and 84*a*.

In this modification, the developing means frame 51 and developer storage frame 61 are designed so that even after the developing means frame 51 and developer storage frame 61 are joined so that they are allowed to move relative to each other, and the third contact areas 81*a*, 82*a*, 83*a*, and 84*a* make airtight contact with the elastomer 71, a gap H will be present between the surface 61*b*1 of the developer storage frame 61 and each of the elastic members 81, 82, 83, and 84.

In the modified version of the development unit A in this embodiment, the third contact areas 81*a*, 82*a*, 83*a*, and 84*a* do not make contact with the surface 61*b*1 of the developer storage frame 61. Therefore, the reactive force generated in the elastomer 71 in this modified version is smaller than that in the unmodified version of this embodiment, and therefore, the pressure D in this modified version is smaller than that in the unmodified version in this embodiment.

Figure 28:
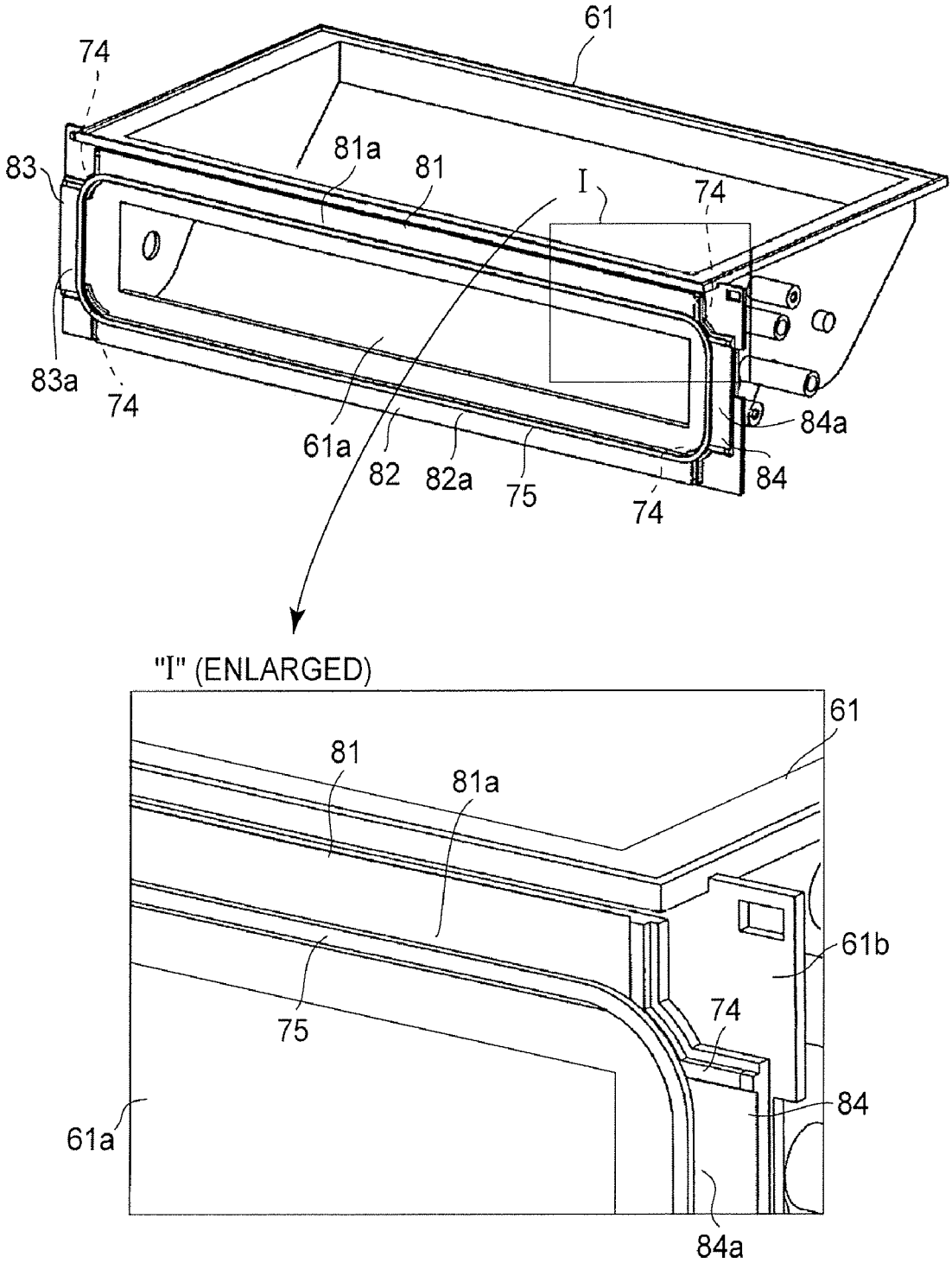
FIG. 28 is a drawing including an enlarged section showing another of the modified versions of the development unit in the third embodiment.
Figure 29:
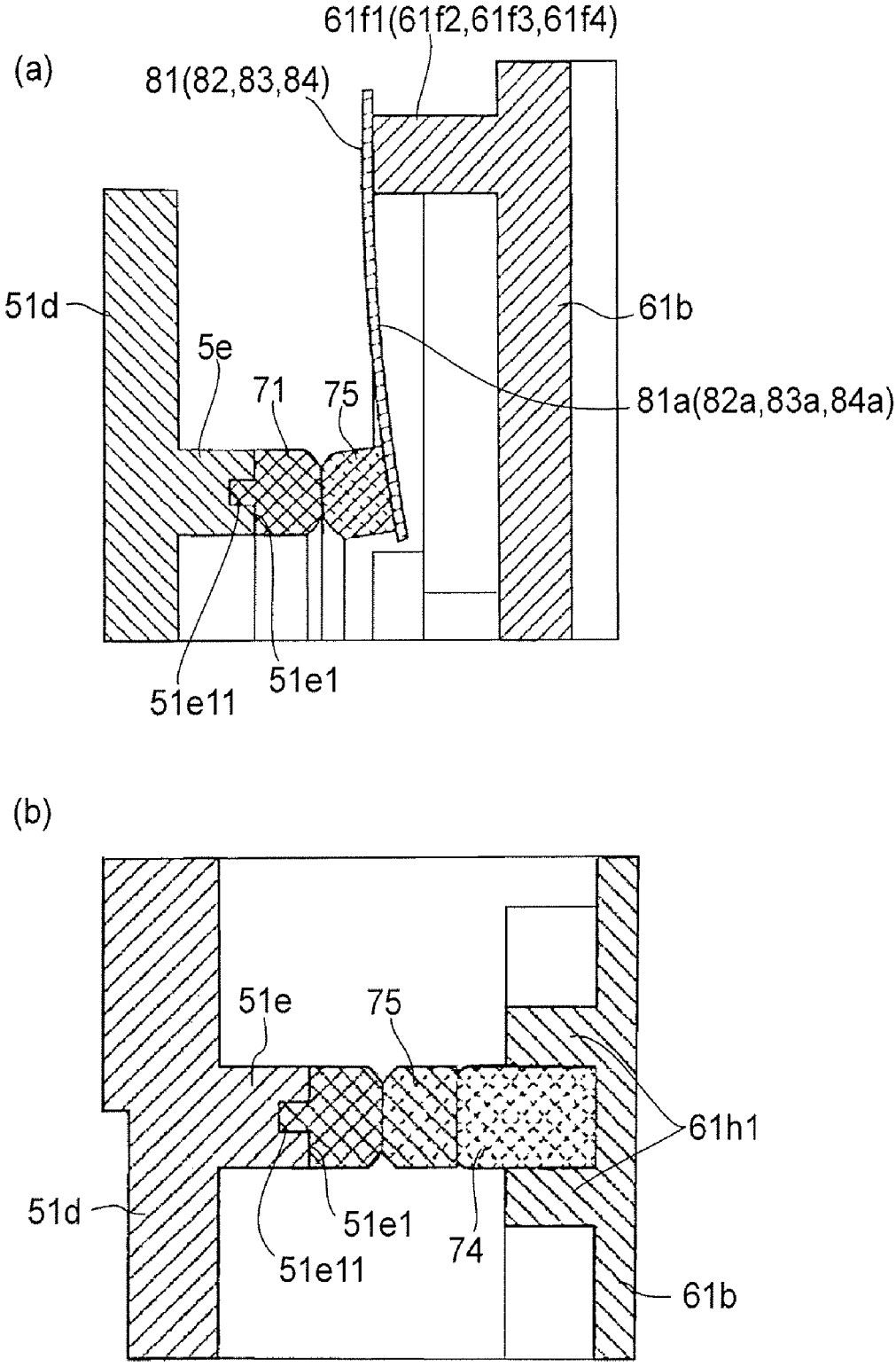
FIGS. 29(*a*) and 29(*b*) are schematic sectional views of the development unit shown in FIG. 28, the solidified elastomers of the developing means frame and developer storage frame of which have been airtightly placed in contact with each other.

FIGS. 28 and 29 are drawings of the modified version of the development unit A in this embodiment. FIG. 28 is a perspective view of the developing means frame 51 as seen from the developer storage frame 61 side. FIG. 29 collectively shows cross-sectional views of the joint between the developing means frame 51 and developer storage frame 61, showing the state of contact between the elastomers 71 and 75, in the gap between the developing means frame 51 and developer storage frame 61. In FIG. 29, FIG. 29(*a*) is an enlarged cross-sectional view of the joint between the developing means frame 51 and developer storage frame 61, at a plane corresponding to the line F-F in FIG. 26, and FIG. 29(*b*) is an enlarged cross-sectional view of the joint between the developing means frame 51 and developer storage frame 61, at a plane corresponding to the line G-G in FIG. 26.

In this modified version of the development unit A, the developer storage frame 61 is provided with an elastomer 75, which is formed in a manner to encircle the opening 61*a* and cover the third contact areas 81*a*, 82*a*, 83*a*, and 84*a* and the top surface (surface on developing means frame 51 side) of the elastomer 74 attached to the corner portions of the flange 61*b*.

That is, liquid elastomer 71 is applied to the third contact areas 81*a*, 82*a*, 83*a*, and 84*a*, and the top surfaces of the solidified elastomers 74 located at the four corners, one for one, of the flange 61, using the dispenser 96 (FIG. 12). As the liquid elastomer 71 solidifies, it turns into the elastomer 75 as described above. Thereafter, the developing means frame 51 and developer storage frame 61 are joined by the flanges 51*d* and 61*b*. As the two frames 51 and 61 are joined, the elastomers 75 and 71 airtightly contact with each other (FIGS. 29(*a*) and 29(*b*)).

In this modified version of the development unit A in this embodiment, the elastomers 71 and 75 attached to the flanges 51*d* and 61*b* of the developing means frame 51 and developer storage frame 61, respectively, are made to airtightly contact with each other. Therefore, this modified version of the development unit A is far smaller in the amount of the reactive force generated by the elastomers. Therefore, it is far smaller in the amount of the pressure D.

Embodiment 4

Next, the method for applying liquid elastomer will be described.

In this embodiment, the method for applying the liquid elastomer 71 will be described. This method can also be used for applying the liquid elastomer other than the liquid elastomer 71, that is, the liquid elastomers 72, 73, 74, and 75.

Figure 30:
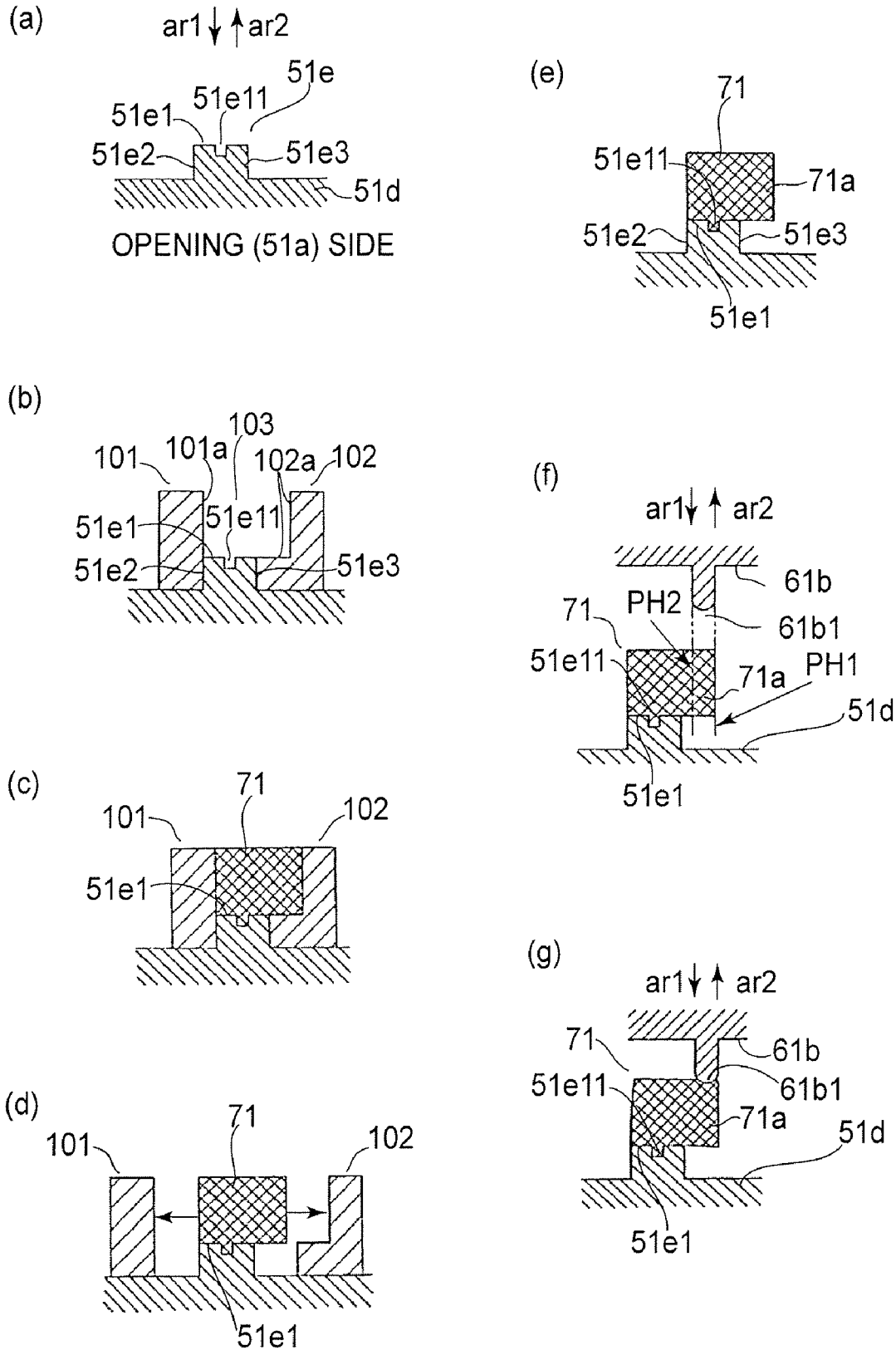
FIGS. 30(*a*) through 30(*g*) are schematic drawings showing an example of the procedure for applying liquid elastomer, in the fourth embodiment.

FIGS. 30(*a*)-30(*g*) are schematic drawings showing one of the procedures for applying the liquid elastomer 71.

First, a pair of liquid elastomer application assist plates 101 and 102 (FIG. 30(*b*)) are set up so that they are placed airtight in contact with the lateral surfaces 51*e*2 and 51*e*3 of the elastomer support rib 51*e*1 (FIG. 30 (*a*)). The assist plate 101, which is on the opening 51*a* side of the elastomer support rib 51*e*, is the same in length as the elastomer support rib 51*e*, and has an elastomer application assist surface 101*a*, which extends straight toward the developer storage frame 61 as if it were an extension of the lateral surface 51*e*2 of the elastomer support rib 51*e*.

The liquid elastomer application assist plate 102, which is placed on the opposite side of the elastomer support rib 51*e* from the opening 51*a*, is provided with a liquid elastomer application assist surface 102*a*, which is made up of two surfaces. One of the surfaces is level with the liquid elastomer application surface 51*e*1, and is on the opposite side of the liquid elastomer application surface 51*e*1 from the opening 51*a*, whereas the other surface is parallel to the lateral surface 51*e*3 and extends straight toward the developer storage frame 61. The dispenser 96 is moved all the way along the top edges of the liquid elastomer application assist plates 101 and 102, while being kept right above the space 103 surrounded by the elastomer support rib 51*e*, and elastomer application assist surfaces 101*a* and 102*a*, in a manner to coat the top surface 51*e*1 of the elastomer support rib 51*e* with the liquid elastomer 71 (liquid elastomer application step). As a result, the space 103 is filled with the liquid elastomer 71 (FIG. 30(*c*)).

After the solidification of the liquid elastomer 71, the liquid elastomer application assist plates 101 and 102 are separated from the elastomer support rib 51*e* by being moved in the direction roughly parallel to the liquid elastomer application surface 51*e*1 (FIG. 30(*d*)), ending thereby the liquid elastomer application step. The reason why the liquid elastomer application assist plates 101 and 102 are separated in the direction roughly parallel with the liquid elastomer application surface 51*e*1 is to minimize the amount of the force which acts in the direction to dislodge the coated and solidified elastomer 71 from the elastomer support rib 51*e* when the plates 101 and 102 are moved away from the elastomer 71. The elastomer 71 remains adhered to the liquid elastomer application surface 51*e*1 of the elastomer support rib 51*e* by its own adhesiveness. As the liquid elastomer application assist plates 101 and 102 are moved away, the elastomer 71 emerges, the lateral surface 51*e*2 side of which is level with the lateral surface 51*e*2, whereas the lateral surface 51*e*3 of which extends beyond the lateral surface 51*e*3; the elastomer 71 has a protrusion 71*a* (FIG. 30(*e*)). In other words, the protrusion 71*a* protrudes in the direction intersectional to the circumference of the flange 51*d*. This intersectional direction is the left-right direction of FIG. 30, as seen from the direction perpendicular to the sheet of paper on which FIG. 30 is drawn. Further, the protrusion 71*a* is not in contact with the liquid elastomer application surface 51*e*1.

The developer storage frame 61 has a rib 61*b*1, which perpendicularly projects from the flange 61*b*. The rib 61*b*1 is where the elastomer 71 contacts to airtightly seal the development unit A. The rib 61*b*1 corresponds in position to the protrusion 71*a* (FIG. 30(*f*)). The rib 61*b*1 is positioned so that even if it is extended in the direction (indicated by double-dot chain lines PH1 and PH2) parallel with the directions ar1 and ar2 in which the developing means frame 51 is movable, it does not overlap with the elastomer support rib 51*e*. That is, in terms of the abovementioned intersectional direction, the point at which the elastomer 71 is in contact with the flange 61*b* is different from the point at which the elastomer 71 is in contact with the flange 51*d*. Further, when the developing means frame 51 and developer storage frame 61 are in contact with each other by the flanges 51*d* and 61*b*, respectively, the elastomer 71 is in contact with the rib 61*b*1, remaining in the state in which the elastomer 71 may be said be compressed by the rib 61*b*1. When the elastomer 71 is in this state, reactive force is generated in the protrusion 71*a* by the compression. However, there is nothing to back up the protrusion 71*a* on the side (developing means frame 51 side) toward which the protrusion 71*a* deforms by being pressed by the rib 61*b*1. Therefore, this reactive force is smaller than the reactive force which the elastomer 71 would have generated, if the protrusion 71*a* were backed up. In other words, this modified version of the development unit A is smaller in the value of "amount of reactive force/amount of compression" than the unmodified version of the development unit A in this embodiment.

The elastomer 71 is high in conformance. Therefore, it is small in the amount of compressive force necessary to be applied thereto to make it serve as an effective sealing member. In addition, this modified version of the development unit A in this embodiment is small in the amount of variation of the reactive force resulting from the variation in the amount of the compressive force. Therefore, it is smaller in the amount of the reactive force generated by the elastomer 71, being therefore smaller in the amount of the pressure D.

Figure 31:
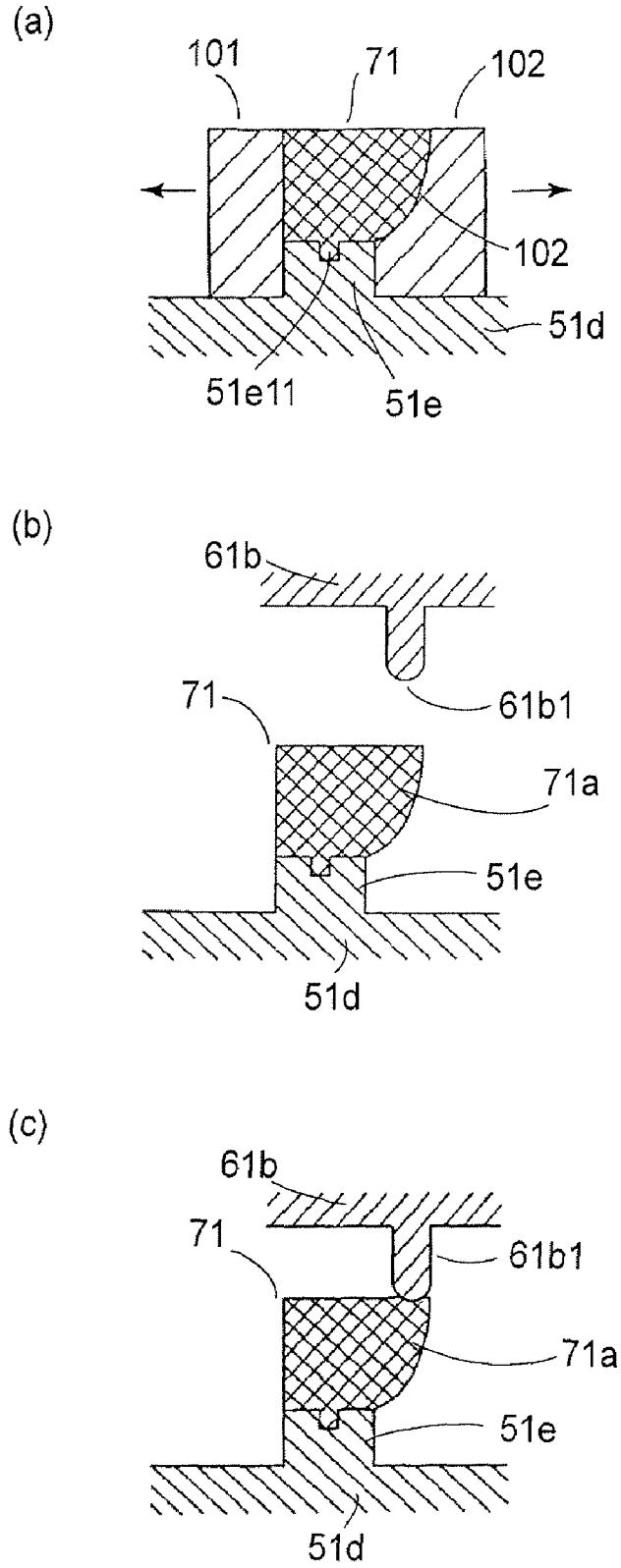
FIGS. 31(*a*), 31(*b*), and 31(*c*) are schematic cross-sectional views of another solidified elastomer in the fourth embodiment, showing an elastomer shape different from the one shown in FIG. 30.
Figure 32:
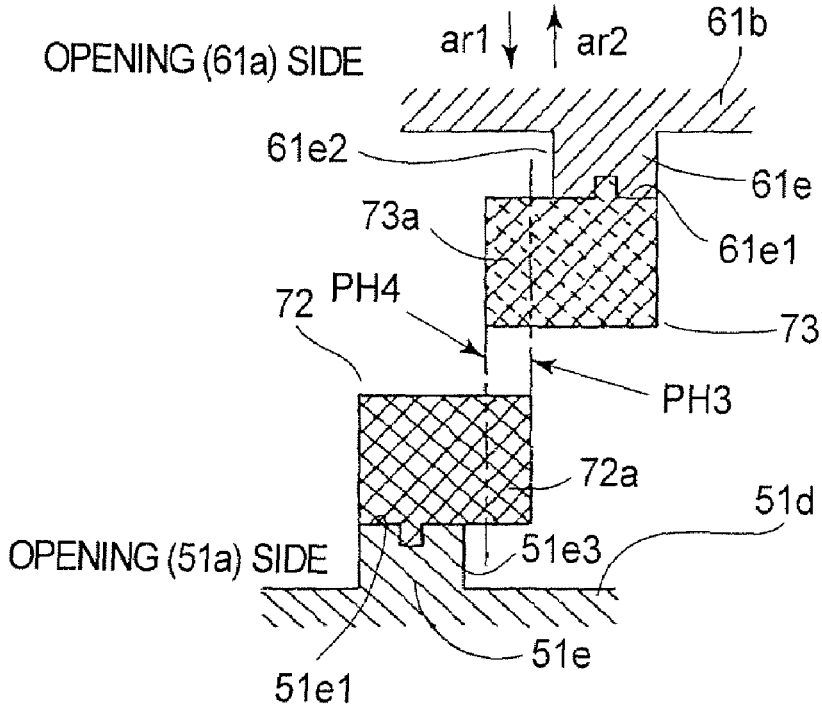
FIG. 32 collectively shows cross-sectional views of the solid elastomers, with which the developer storage frame and developing means frame are provided, showing solid elastomers different in cross section from those shown in FIGS. 30 and 32.
Figure 32:
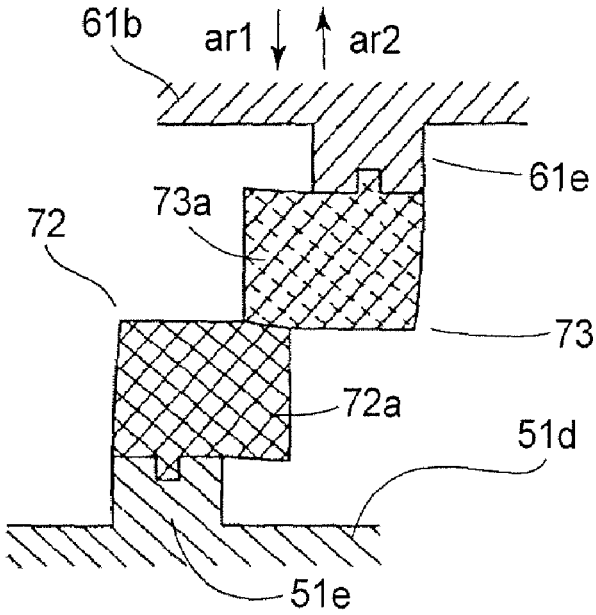

In this embodiment, the elastomer 71 formed by solidifying the liquid elastomer 71 after its application was rectangular in cross section. However, it is not mandatory that the elastomer 71 is rectangular in cross section. FIGS. 31, 32(*b*) and 32(*c*) show another shape that is acceptable as the cross-sectional shape for the elastomer 71.

FIG. 31(*a*) shows the first of the shapes acceptable as the cross-sectional shape for the elastomer 71. In this case, the surface 102*a* of the liquid elastomer application assist plate 102 is concavely curved so that its farthest end portion from the elastomer support rib 51*e* is roughly parallel with the lateral surfaces of the elastomer support rib 51*e*. That is, a liquid elastomer application assist plate 102 having the liquid elastomer application assist surface 102*a* shown in FIG. 31(*a*) may be used to apply liquid elastomer to the elastomer support rib 51*e* to form a protrusion 71*a*, shown in FIG. 31(*b*), which convexly curves, in terms of cross section, across the surface which connects the top and bottom surfaces. Therefore, the amount of the deformation (FIG. 31(*c*)) which occurs to this protrusion 71*a* as it is pressed by the rib 61*b*1 is smaller that which occurs to the protrusion 71*a* in the preceding modified version of the development unit A, being therefore smaller in the value of "amount of reactive force/amount of compressive force" than the protrusion 71*a* in the preceding modified version of the development unit A. Therefore, it is far smaller in the amount of the variation of the reactive force attributable to the variation in the amount of the compressive force. Further, it is smaller in the amount of the resistance which the liquid elastomer application assist plate 102 is subjected when it is separated from the solidified elastomer 71 (protrusion 71*a*).

FIGS. 32(*a*) and 32(*c*) are schematic drawings showing another example of the shape usable as the cross-sectional shape for the elastomers 72 and 73.

Referring to FIG. 32(*a*), the liquid elastomer 72 is applied to the flange 51*d* (liquid elastomer application step). The resultant solid elastomer 72 has a protrusion 72*a*, which extends beyond the edge of the liquid elastomer application surface 51*e*1 of the elastomer support rib 51*e*, on the lateral surface 51*e*2 side. Further, the liquid elastomer 73 is applied to the flange 61*b* (liquid elastomer application step). The resultant solid elastomer 73 has a protrusion 73*a*, which extends beyond the edge of the liquid elastomer application surface 61*e*1 of the elastomer support rib 61*e*, on the lateral surface 61*e*2 side. In other words, the protrusion 73*a* protrudes in the direction which is intersectional to the direction of the periphery of the flange 61*b*. This intersectional direction is the left-right direction of FIG. 32, as seen from the direction perpendicular to the sheet of paper on which FIG. 32 is drawn. These protrusions 72*a* and 73*a* are positioned so that even if they are extended in the direction parallel with the directions ar1 and ar2 (indicated by double-dot chain lines PH1 and PH2 in FIG. 32(*a*)) in which the developing means frame 51 is movable, they will not overlap with the elastomer support ribs 61*e* and 51*e*, respectively. That is, the protrusions 72*a* and 73*a* are positioned so that they do not align with the liquid elastomer application surfaces 61*e*1 and 51*e*1 of the elastomer support ribs 61*e* and 51*e*, respectively. In other words, in terms of the abovementioned intersectional direction, the location of the interface (bonding) between the elastomer 72 and flange 51*d* is different from the location of the interface (bonding) between the elastomer 73 and flange 61*b*. Further, the protrusions 72*a* and 73*a* are formed so that they do not come into contact with either of the developing means frame 51 and developer storage frame 61. The developing means frame 51 and developer storage frame 61 are joined by the flanges 51*d* and 61*b*. As the developing means frame 51 and developer storage frame 61 are joined, the protrusions 72*a* and 73*a* of the elastomers 72 and 73, respectively, come into contact with each other (elastomer contact step). After the occurrence of the contact between the elastomers 72 and 73, the elastomers 72 and 73 is kept in airtight contact with each other, being therefore compressed by each other. Therefore, this compression generates reactive force in the protrusions 72*a* and 73. However, neither the protrusion 72*a* nor the protrusion 73*a* are backed up from the sides toward which they deform (developing means frame 51 side and developer storage frame 61 side, respectively). In other words, what occurs here is that two elastic members compress each other. Therefore, the value of "amount of reactive force/amount of compressive force" in this modified version of this embodiment is even smaller than that in the preceding modified versions of this embodiment. Therefore, this modified versions is even smaller in the amount of variation in the amount of the reactive force attributable to the variation in the amount of the compressive force, being therefore smaller in the amount of the pressure D.

Embodiment 5

In terms of image forming apparatus structure, this embodiment is similar to the first embodiment described above. Therefore, only the differences of this embodiment from the first embodiment will be described.

(1) Structure of Sealing Means Between Developing Means Frame 51 and Developer Storage Frame 61

Figure 33:
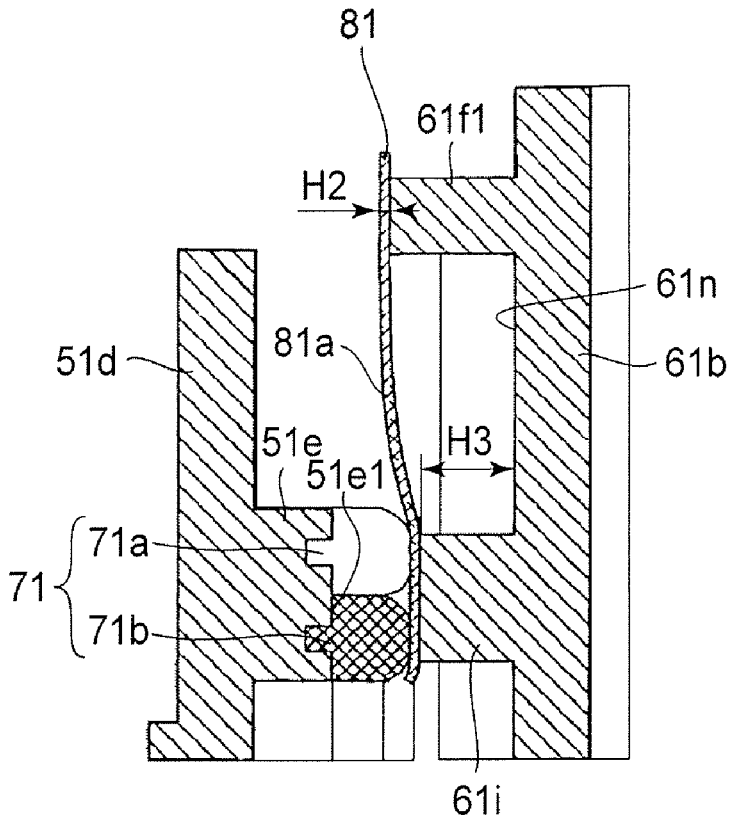
FIG. 33 is a perspective view including an enlarged section of the developer storage frame and developing means frame of the development unit in the fifth embodiment, which have been joined by their flanges in such a manner that the two frames are movable relative to each other.
Figure 33:
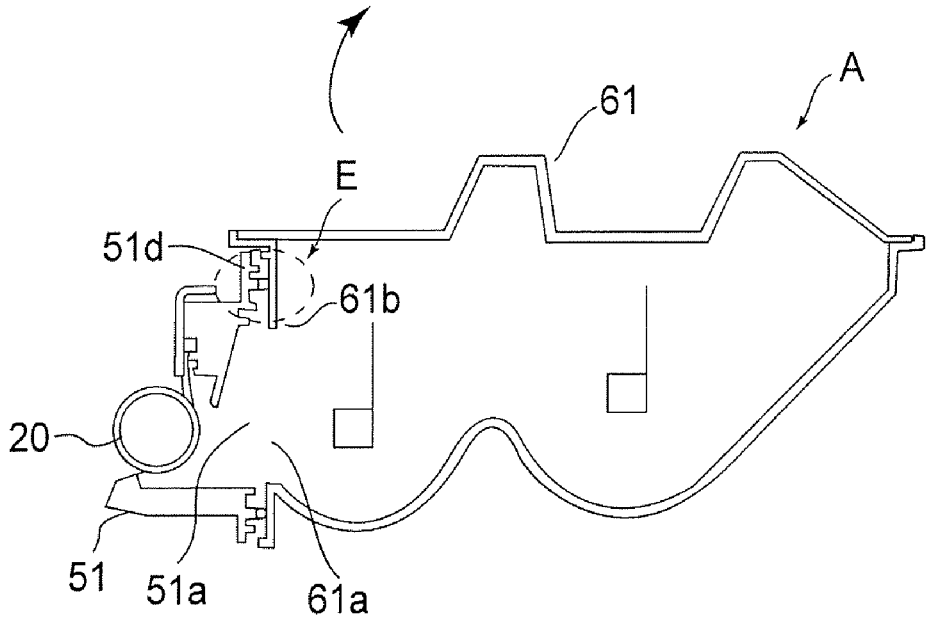
Figure 34:
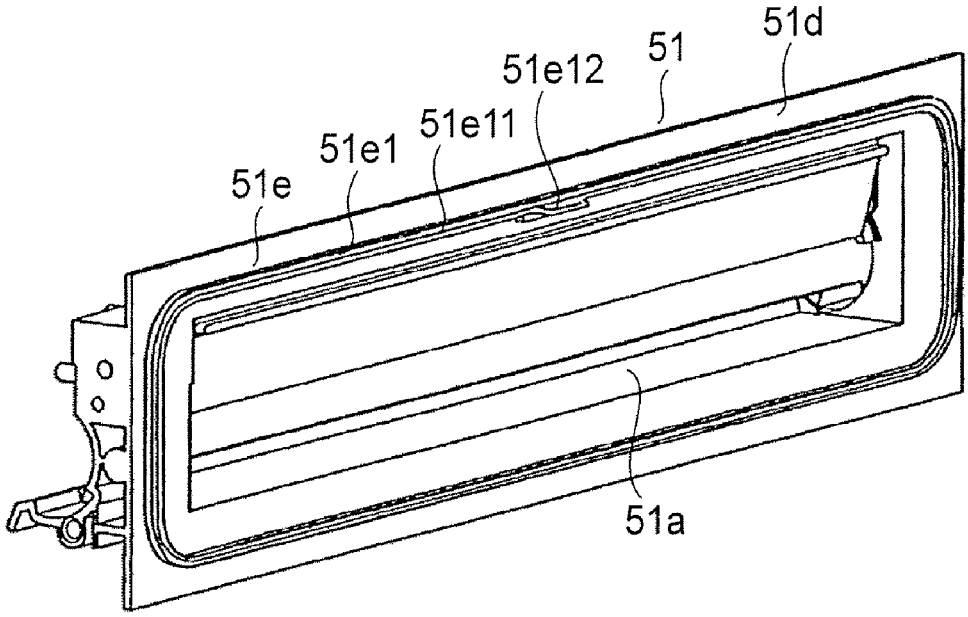
FIG. 34 is a perspective view of the developing means frame, as seen from the developer storage frame side.
Figure 35:
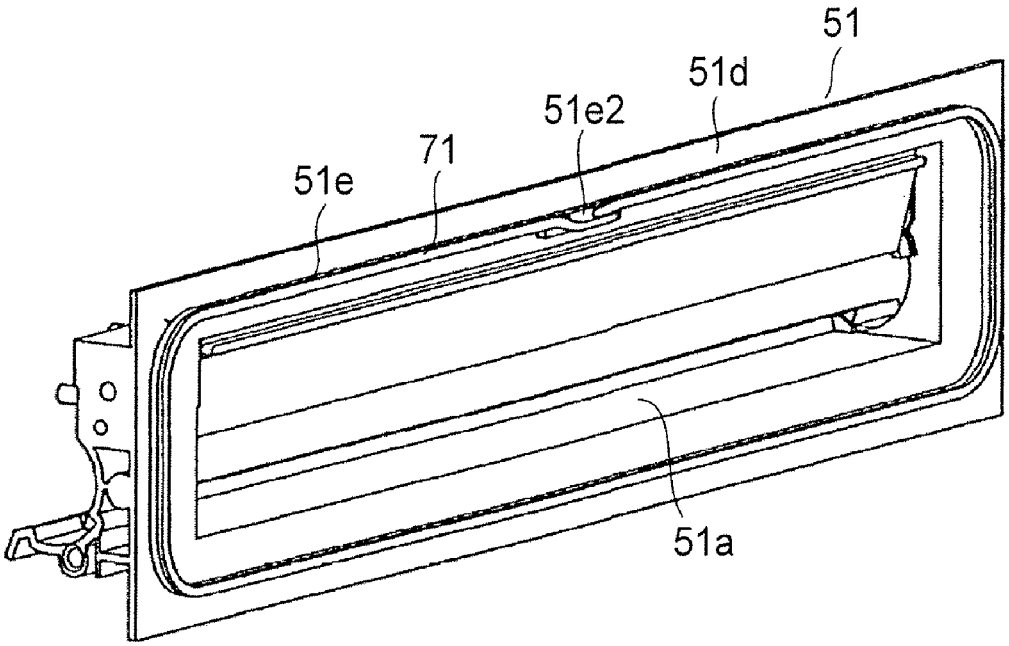
FIG. 35 is a perspective view of the developing means frame coated with elastomer, as seen from the developer storage frame side.

FIG. 33 is a cross-sectional view of the developing means frame 51 and developer storage frame 61 joined by their flanges so that they are movable relative to each other. FIG. 34 is a perspective view of the developing means frame 51 as seen from the developer storage frame 61 side. FIG. 35 is a perspective view of the developing means frame 51 provided (coated) with the elastomer 71, as seen from the developer storage frame 61 side.

Next, the method for assembling the developing means frame 51 and developer storage frame 61 will be described.

First, the developing means frame 51 shown in FIG. 34 is prepared (developing means frame preparation step). The developing means frame 51 has the second opening 51*a*, and a flange 51*d* as the second connective portion which surrounds the second opening 51*a*. Incidentally, the flange 51*d* does not need to be uniform in structure throughout its entire range around the second opening 51*a*, as did not the flange 51 in the first embodiment. The flange 51*d* is provided with an elastomer support rib 51*e* to which adhesive liquid elastomer 71 (elastic high-polymer) is applied. The elastomer support rib 51*e* is extended in a manner to surround the opening 51*a*, forming a rectangular frame. The elastomer supporting rib 51*e* is rendered flat at the top, to provide the elastomer support rib 51*e* with a surface to which liquid elastomer 71 is applicable. The top surface 51*e*1 of the elastomer support rib 51*e* is provided with a groove 51*e*11, which extends in a manner to surround the opening 51*a*. Further, the flange 51*d* is provided with a connective portion 51*e*12 where the lengthwise end of the elastomer 71, which corresponds in position to the point at which the application of liquid elastomer 71 is started, and the other lengthwise end of the elastomer 71, which corresponds in position to the point at which the application of the liquid elastomer 71 is ended, are connected to each other. The connective portion 51*e*12 is rendered wider than the top surface 51*e*1.

Referring to FIG. 12, the dispenser 96 is moved along the entirely of the elastomer support rib 51*e* in the direction indicated by an arrow mark, starting from the connective portion 51*e*12. As the dispenser 96 is moved, the heated liquid elastomer 71 is applied to the top surface 51*e*1 of the elastomer support rib 51$e$ (liquid elastomer application step). Then, the applied liquid elastomer 71 is solidified by cooling. Referring to FIG. 35, as the liquid elastomer 71 is applied to the top surface 51$e$1 of the elastomer support rib 51$e$, it flows into the groove 51$e$11, increasing thereby the contact area between the elastomer support rib 51$e$ and the elastomer 71 (enlarged cross-sectional views at lines H-H and G-G in FIGS. 33 and 40, respectively). That is, providing the flange 51$d$ with the groove 51$e$11 increases the strength of the bond between the elastomer 71 and liquid elastomer application surface 51$e$1. Hereafter, the top surface 51$c$1 of the elastomer support rib 51$e$ will be referred to as elastomer application surface 51$e$1. Further, the solidified elastomer 71 will be referred to simply as elastomer 71.

Figure 36:
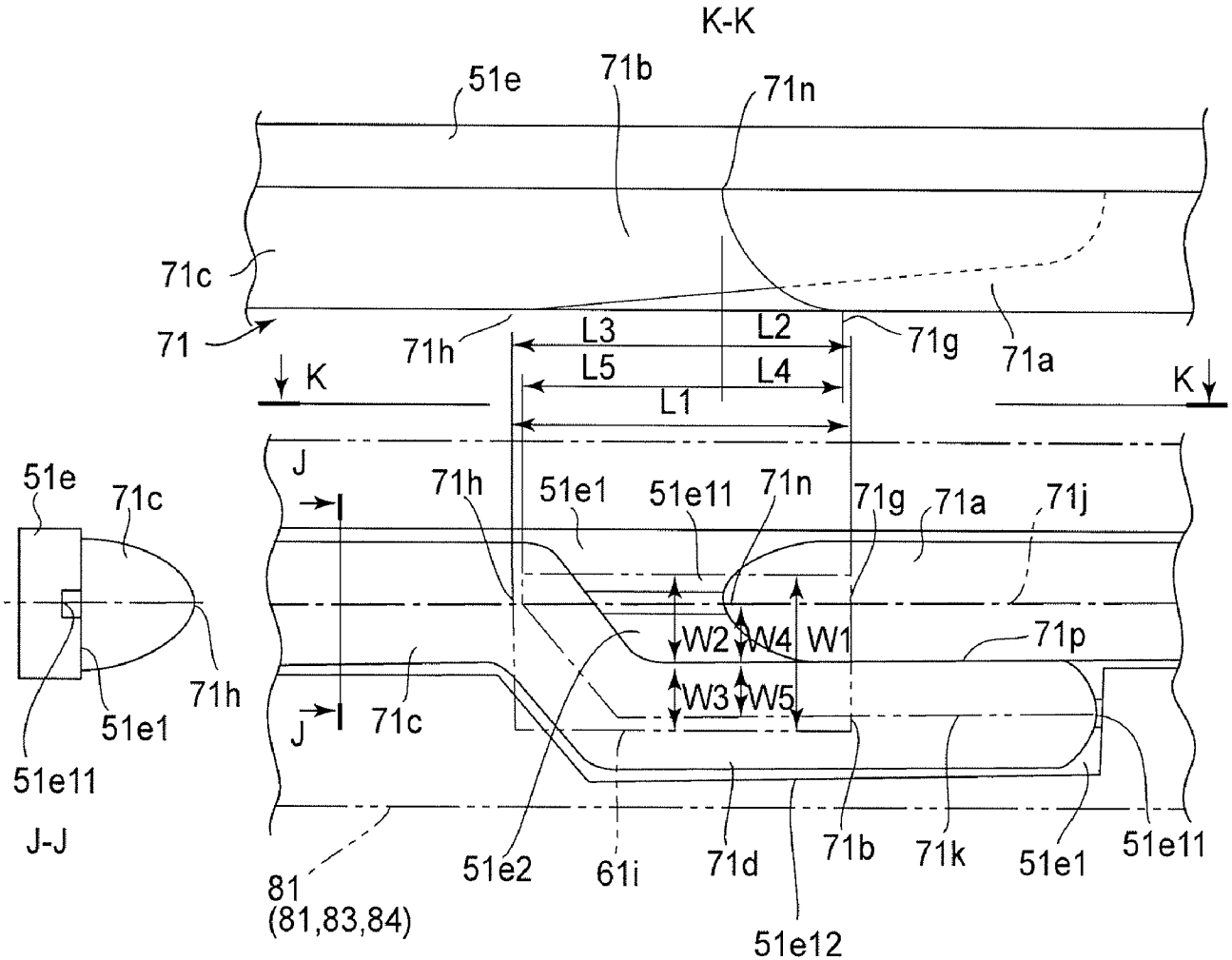
FIG. 36 is a schematic drawing of the joint between the lengthwise end portion of the solidified elastomer, which corresponds in position to the liquid elastomer application start point, and the lengthwise end of the solidified elastomer, which corresponds in position to the liquid elastomer application end point, on the elastomer support rib of the developer storage frame.

FIG. 36 is a schematic drawing of the portion of the elastomer 71, which corresponds in position to the connective portion 51$e$1 of the elastomer support rib 51$e$.

On the connective portion 51$e$12, the lengthwise end of the elastomer 71, which corresponds in position to the point at which the application of liquid elastomer 71 is started, and the other lengthwise end of the elastomer 71, which corresponds in position to the point at which the application of the liquid elastomer 71 is ended, are connected to each other in such a manner that the two lengthwise ends overlap in terms of the width direction of the connective portion 51$e$12. The elastomer 71 is roughly semicircular in cross section (cross section at plane indicated by arrow marks J and J). The lengthwise end of the elastomer 71, which corresponds in position to the point at which the application of liquid elastomer 71 is started, and the other lengthwise end of the elastomer 71, which corresponds in position to the point at which the application of the liquid elastomer 71 is ended, are arcuate in contour (cross section at plane indicated by arrow marks K and K).

Figure 37:
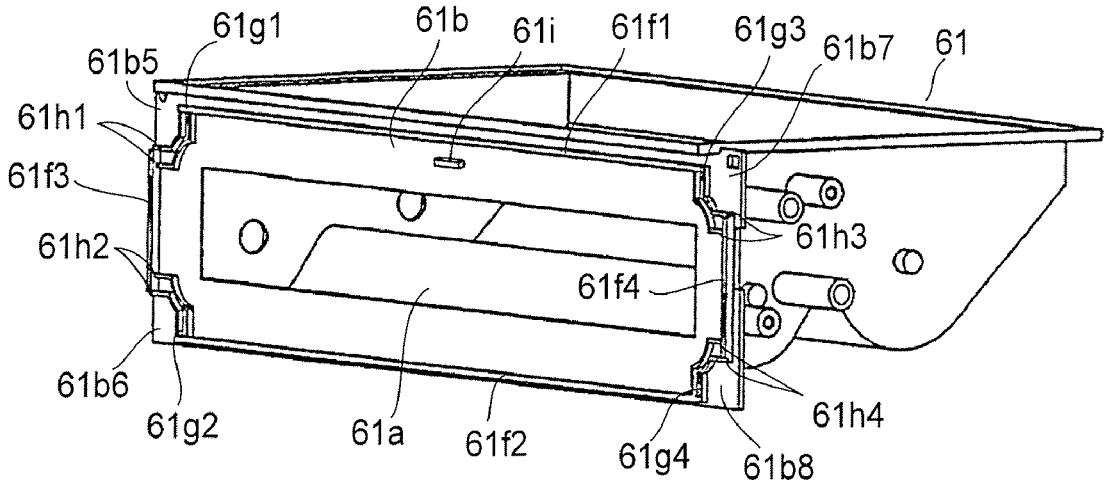
FIG. 37 is a perspective view of the developer storage frame, as seen from the developing means frame side.
Figure 38:
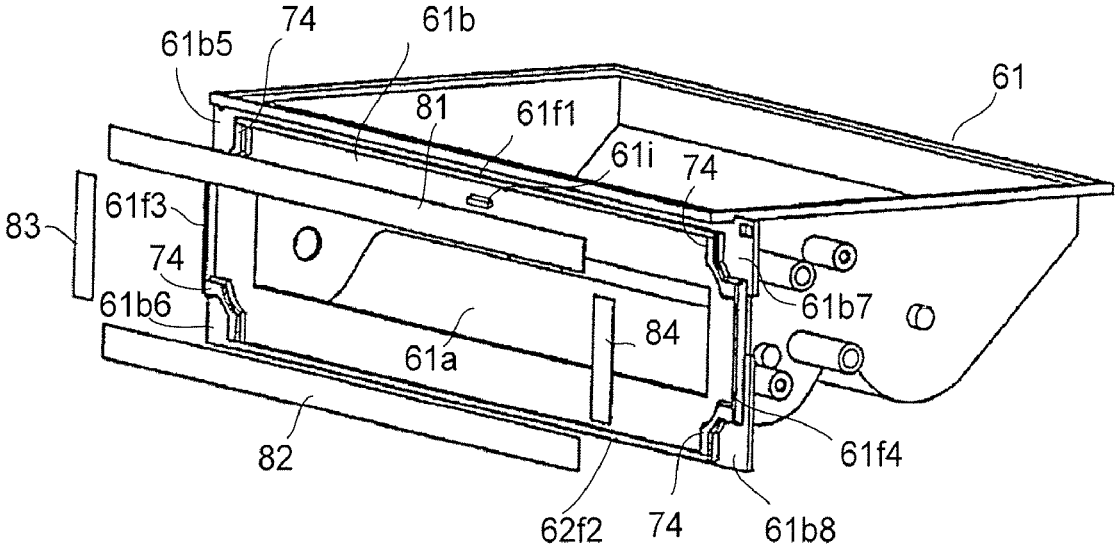
FIG. 38 is a perspective view of the developer storage frame and elastic member prior to the attachment of the elastic member to the developer storage frame.
Figure 39:
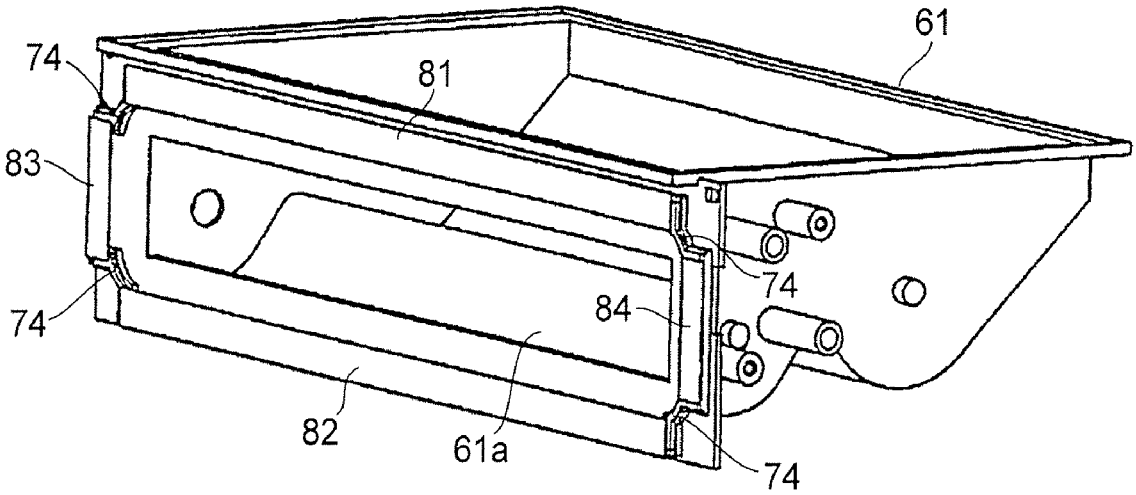
FIG. 39 is a perspective view of the developer storage frame and elastic member after the attachment of the elastic member to the developer storage frame.

FIG. 37 is a perspective view of he developer storage frame 61 as seen from the developing means frame 51 side. FIG. 38 is a perspective view of the developer storage frame 61 prior to the attachment of the elastic sealing members 81, 82, 83, and 84 to the developer storage frame 61. FIG. 39 is a perspective view of the developer storage frame 61 after the attachment of the elastic sealing members 81, 82, 83, and 84 to the developer storage frame 61.

Next, the developer storage frame 61 shown in FIG. 37 is prepared (development storage frame preparation step). The developer storage frame 61 has a flange 61$b$ as the first connection portion. The four corners of the flange 61$b$ have four grooves 61$g$1, 61$g$2, 61$g$3, and 61$g$4, which correspond in position to the outward areas of the four corners (corner areas) 61$b$5, 61$b$6, 61$b$7, and 61$b$8 of the opening 61$a$. The grooves 61$g$1, 61$g$2, 61$g$3, and 61$g$4 are positioned so that their positions coincide with the portions of the elastomer 71, which are on the outward areas of the four corners of the opening 51$a$ of the developing means frame 51. Further, the grooves 61$g$1, 61$g$2, 61$g$3, and 61$g$4 are surrounded by ribs 61$h$1, 61$h$2, 61$h$3, and 61$h$4, which protrude toward the developing means frame 51.

The developer storage frame 61 has ribs 61$f$1, 61$f$2, 61$f$3, and 61$f$4, which are positioned so that they are on the outward side of the straight edge portions of the opening 61$a$, that is, the portions other than the portions corresponding to the four corner of the opening 61$a$. Further, the ribs 61$f$1, 61$f$2, 61$f$3, and 61$f$4 are on the outward side of the portions of the elastomer 71, which are placed (coated) on the straight portions, that is, the portions other than the portions which correspond in position to the four corners of the opening 51$a$ of the developing means frame 51. The ribs 61$f$1, 61$f$2, 61$f$3, and 61$f$4 protrude toward the developing means frame 51, by a height greater than the height by which the ribs 61$h$1, 61$h$2, 61$h$3, and 61$h$4 of the groove 61$g$1, 61$g$2, 61$g$3, and 61$g$4, respectively, protrude.

To the top surfaces of the ribs 61$f$1, 61$f$2, 61$f$3, and 61$f$4, the elastic members 81, 82, 83, and 84 are attached, respectively (elastic member attachment step) by their long edges portion. As for the examples of the means for attaching the elastic members 81, 82, 83, and 84, they may be attached using two-sided adhesive tape, or may be thermally welded (FIGS. 38 and 39). The elastic members 81, 82, 83, and 84 are in the form of a sheet, and are formed of metal or resin.

Into the grooves 61$g$1, 61$g$2, 61$g$3, and 61$g$4, the liquid elastomer 74 is injected using the dispenser 96 (FIG. 12) (FIGS. 38 and 39), so that the resultant body of the liquid elastomer 74 is slightly taller than the elastic members 81, 82, 83, and 84, and airtightly fill the gap between the adjacent two elastic members among the elastic members 81, 82, 83, and 84. Thereafter, the body of injected liquid elastomer 74 is solidified by cooling.

Further, the flange 61$b$ of the developer storage frame 61 has a rib 61$i$ as a pressure applying member, which protrudes toward the developing means frame 51 from the portion of the flange 61$b$, which corresponds in position to the aforementioned connective portion 51$e$12 of the flange 51$d$. Next, referring to FIGS. 33, 37, and 40, the rib 61$i$ will be described in detail.

Figure 40:
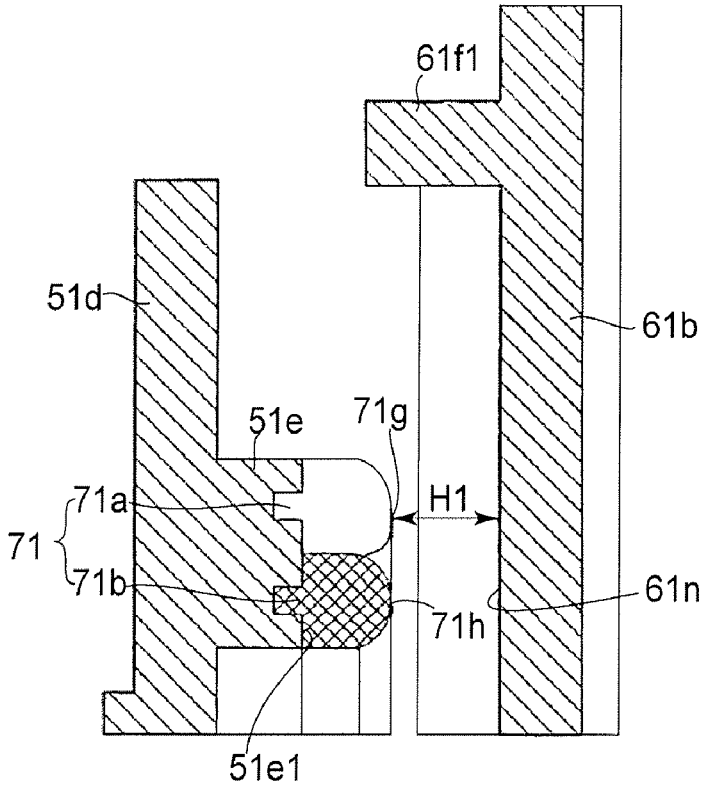
FIG. 40 is a schematic sectional drawing of the joint between the developer storage frame provided with the elastomer, and developing means frame which is not provided with a rib and the elastic member.

FIG. 40 is a cross-sectional view of the joint between the developer storage frame 61 which does not have the rib 61$i$ and elastic members 81, 82, 83, and 84, and the developing means frame 51 (and therefore, elastomer 71 is not deformed).

i) A height H3 (enlarged cross-sectional view of area E in FIG. 33) by which the rib 61$i$ protrudes toward the developing means frame 51 side satisfies the following relationship:

$$H3 \geqq H1 - H2.$$

Referring to FIG. 40, the symbol H1 stands for the distance from the developer storage frame 61 to the elastomer 71 after the joining of the developing means frame 51 and developer storage frame 61, that is, the distance from the surface 61$n$ of the flange 61$b$ of the developer storage frame 61, which is provided with the rib 61$i$, to the tips 71$g$ and 71$h$ of the lengthwise ends 71$a$ and 71$b$ of the elastomer 71. The symbol H2 stands for the thickness of the elastic member 81 (FIG. 33).

ii) The length L1 (FIG. 36) of the rib 61$i$, that is, the dimension of the 61$i$ in terms of the lengthwise direction of the developing means frame 51, satisfies the following relationship:

$$L1 = L2 + L3.$$

A symbol L2 stands for the distance from the liquid elastomer application start point 71$n$ for the formation of the elastomer 71 to a preset point beyond the highest point 71$g$ of the lengthwise end portion 71$a$, that is, the end portion which corresponds to the liquid elastomer application start point 71$n$. A symbol L3 stands for the distance from the liquid elastomer application start point 71$n$ to another preset point beyond the highest point 71$h$ of the lengthwise end portion 71$b$, which corresponds to the liquid elastomer application end point.

Thus, L2 and L4, and L3 and L5, satisfy the following relationship:

$$L2 \geqq L4$$

$$L3 \geqq L5.$$

A symbol L4 stands for the distance from the liquid elastomer application start point 71*n* to the point corresponding to the highest point 71*g* of the lengthwise end 71*a* corresponding to the liquid elastomer application start point 71*n*. A symbol L5 stands for the distance from the liquid elastomer application start point 71*n* to the point corresponding to the highest point 71*h* of the other lengthwise end of the elastomer 71, which corresponds to the liquid elastomer application start point 71*n*.

iii) The width W1 (FIG. 36) of the rib 61*i*, that is, the dimension of the rib 61*i* in terms of the width direction of the rib 61*i*, satisfies the following relationship:

$$W1=W2+W3$$

A symbol W2 stands for the distance from the extension 71*p* of the plane of the contact area between the lengthwise end portions 71*a* and 71*b*, which correspond to the liquid elastomer application starting and ending points, and a preset point beyond the center line 71*j* of the lengthwise end portion 71*a*, in terms of the width direction of the elastomer 71. A symbol W3 stands for the distance from the abovementioned extension 71*p* to a preset point beyond the center line 71*k* of the lengthwise end portion 71*b*, in terms of the width direction of the elastomer 71.

Therefore, W2 and W4, and W3 and W5, satisfy the following relationship.

$$W2 \geqq W4$$

$$W3 \geqq W5$$

A symbol W4 stands for the distance from the extension 71*p* to the center line 71*j* of the lengthwise end portion 71*a*, in terms of the width direction of the elastomer 71. A symbol W5 stands for the distance from the extension 71*p* to the center line 71*k* of the lengthwise end portion 71*b*, in terms of the width direction of the elastomer 71.

Referring to FIG. 36, the application of the liquid elastomer 71 leaves a gap (recess) 51*e*2 between the application start portion 71*a* of the elastomer 71, and the application end portion 71*b* of the elastomer 71, that is, where the application start and end portions 71*a* and 72, respectively, are connected to each other). Referring to FIG. 37, the rib 61*i* is shaped and sized so that it can completely cover the recess 51*e*2.

Figure 42:
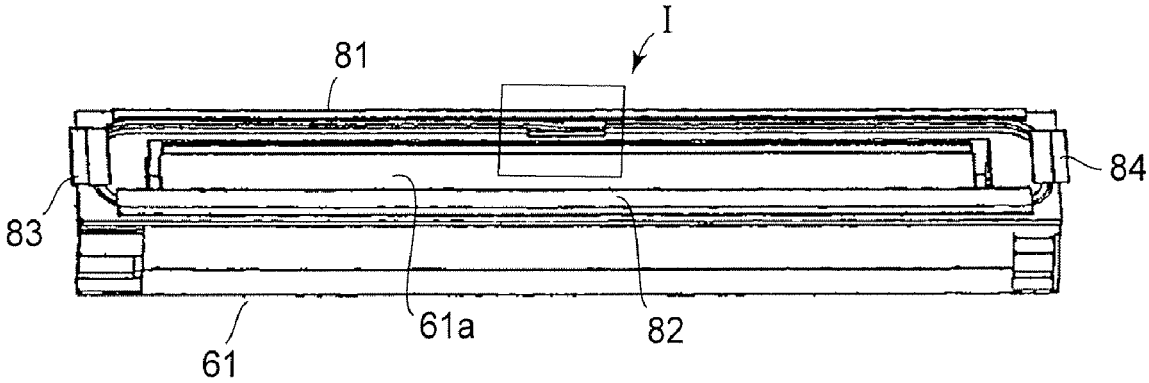
FIG. 42 is a perspective view including an enlarged section of the developing means frame joined with the developer storage frame, showing the state of the lengthwise end portion of the solidified elastomer, which corresponds in position to the liquid elastomer application start point, and the lengthwise end of the solidified elastomer, which corresponds in position to the liquid elastomer application end point.
Figure 42:
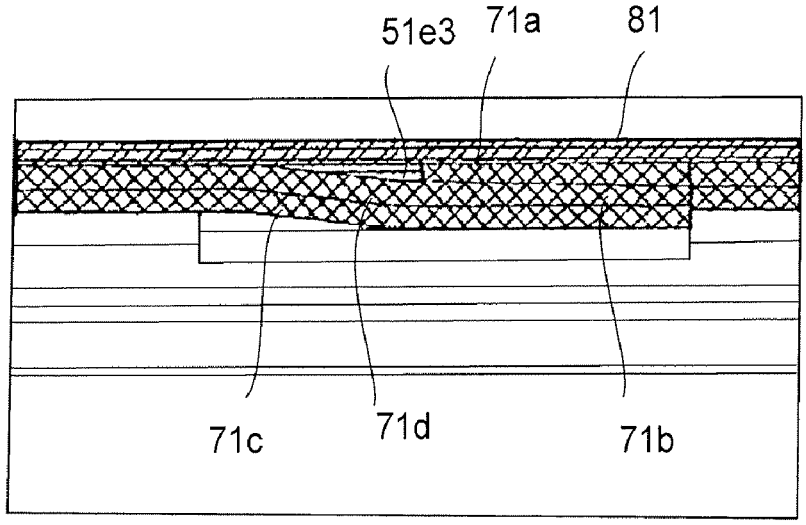
Figure 44:
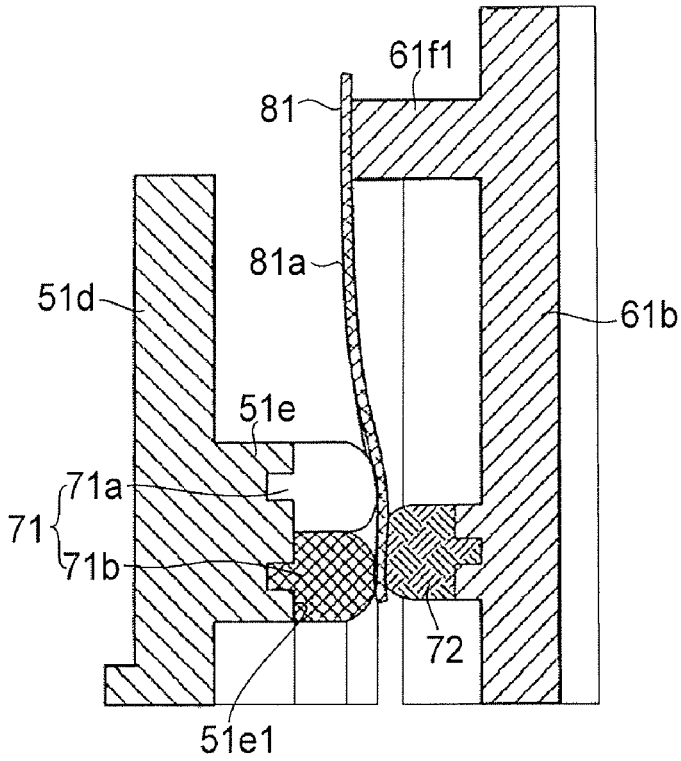
FIG. 44 is a schematic cross-sectional view of the joint between the flange of the developer storage frame having the solidified elastomer instead of the rib, and the flange of the developing means frame having the solidified elastomer.

FIG. 44 is a perspective view of the developing means frame 51 and developer storage frame 61 joined (connected) by their flanges 51*d* and 61*b* in such a manner that they are movable relative to each other. FIG. 33 is a cross-sectional view of the joint between the developing means frame 51 and developer storage frame 61, showing the state of their connection. FIG. 42 is a schematic drawing showing the state of the joint between the elastomer application start and end portions 71*a* and 71*b* of the elastomer 71 of the developing means frame 51 after the joining of the two frames 51 and 61.

Figure 41:
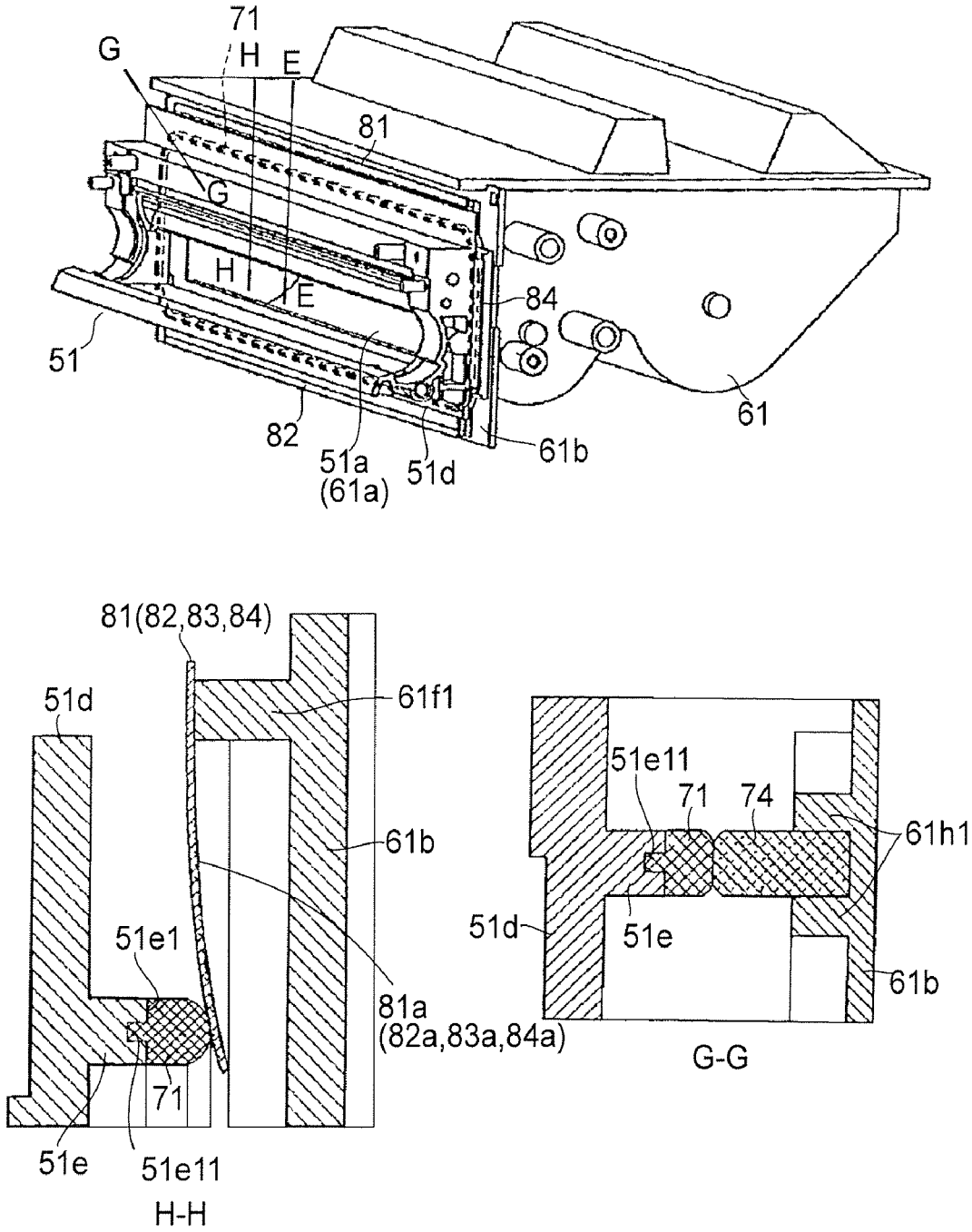
FIG. 41 collectively shows a perspective view and cross-sections of the developer storage frame and developing means frame of the development unit, which have been joined by their flanges in such a manner that the two frames are movable relative to each other.

Referring to the enlarged cross-sectional view of the joint portion at the H-H line in the perspective view, in FIG. 41, as the developing means frame 51 and developer storage frame 61 are joined, the elastomer 71 coated on the developing means frame 51 makes contact with the elastic members 81, 82, 83, and 84, around the openings 51*a* and 61*a*. More specifically, the elastomer 71 makes airtight contact with the third contact areas, that is, the free edge portions 81*a*, 82*a*, 83*a*, 84*a* (end portions opposite to anchored portions in terms of width direction) of the elastic members 81, 82, 83, and 84, respectively (elastic member contact step).

Further, the third free edge portion 81*a* (connective portion) of the elastic member 81 is airtightly pressed upon the elastomer 71 of the developing means frame 51 by the rib 61*i* of the developer storage frame 61 (enlarged cross-sectional view of portion E in FIG. 33, at line E-E in FIG. 41). That is, upon the start and end portions 71*a* and 71*b* of the elastomer 71, the third connective portion 81*a* (free edge portion) is airtightly pressed by the rib 61*i*. It should be noted here that before the rib 61*i* and third connective portion 81*a* come into contact with each other, a gap 51*e*3 is present, or is likely to be created, between the portions 71*c* and 71*d* of the recess 51*e*2, and the third connective area 81*a*. However, as the rib 61*i* and third connective area 81*a* come into contact with each other, the third connective area 81*a* is pressed toward the recess 51*e*2. Thus, the third connective area 81*a* is pressed upon the portions 71*c* and 71*d* in a manner fill the gap 51*e*3 (FIG. 42). Further, the elastomers 71 and 74 with which the developing means frame 51 and developer storage frame 61 are provided, respectively, are pressed upon each other (cross-sectional view at line G-G). Therefore, the joint between the flanges 51*d* and 61*b* is sealed by the elastomers 71 and 74. Therefore, the toner stored in the developer storage frame 61 is prevented from leaking through the joint between the flanges 51*d* and 61*b*.

The elastomer 71 is high in conformance. Therefore, the amount of compressive force which must be applied to make the elastomer 71 to effectively perform as a sealing member is relatively small. That is, when the elastomer 71 is used to seal between the flanges 51*d* and 61*b*, the amount by which the elastomer 71 need to be compressed is relatively small. Therefore, when the elastomer 71 is used as the sealing member to seal between the flanges 51*d* and 61*b*, the amount of the reactive force generated by the sealing member (elastomer 71) is relatively small. In other words, the usage of the elastomer 71 as the sealing member between the flanges 51*d* and 61*b* makes it possible to reduce the amount of the pressure (which hereafter will be referred to as pressure D) which applies to the peripheral surface of the photosensitive drum 10 through the rings 26*a* and 26*b* fitted around the lengthwise ends of the development roller 20, one for one. To sum up, the pressure D can be kept low by sealing between the flanges 51*d* and 61*b* by placing the elastomer 71 between the flanges 51*d* and 61*b*.

The reduction in the pressure D reduces the amount by which the photosensitive drum 10 is frictionally worn, amount by which the shaft 15 which rotatably supports the photosensitive drum 10 is frictionally worn, and amount by which the development roller 20 is frictionally worn, and amount by which the bearing 16 which rotatably supports the development roller 20 is frictionally worn. It also reduces the amount by which the rings 26*a* and 26*b*, which are kept pressed upon the peripheral surface of the photosensitive drum 10, are frictional worn, and the amount by which the portions of the peripheral surface of the photosensitive drum 10, which correspond in position to the rings 26*a* and 26*b*, are frictionally worn. Thus, the reduction in the pressure D can extends lives of the abovementioned components 10, 15, 16, 20, 26*a*, 26*b*, 27*a*, and 27*b*.

Moreover, the reduction in the pressure D reduces the amount by which heat is frictionally generated in the contact area between the photosensitive drum 10 and shaft 15, and the amount by which heat is frictionally generated in the contact area between the photosensitive drum 10 and bearing 16, as the photosensitive drum 10 is rotated. The reduction in the amount of the pressure D also reduces the amount by which heat is frictionally generated in the contact area between the development roller 20 and bearing 27*a*, and the contact area between the development roller 20 and bearing 27*b*, as the development roller 20 is rotated. Further, it reduces the amount by which heat is frictionally generated in the contact area between the peripheral surface of the photosensitive drum 10 and ring 26*a*, and contact area between the peripheral surface of the photosensitive drum 10 and ring 26*b*, as the photosensitive drum 10 and development roller 20 are rotated. Thus, the reduction in the pressure D makes it possible to reduce the number of fans necessary to be placed in the apparatus main assembly D, making it therefore possible to reduce the amount of electric power consumed by the fans.

Further, the reduction in the pressure D reduces the amount by which the development roller 20 deforms by being kept pressed toward the photosensitive drum 10. Thus, the reduction in the pressure D makes it less likely for an image, which is nonuniform in density, to be formed due to the deformation of the development roller 20 attributable to the abovementioned contact pressure between the development roller 20 and photosensitive drum 10; the reduction in the pressure D can improve the image forming apparatus in image quality.

Incidentally, the developing means frame 51 and/or developer storage frame 61 are not perfectly uniform in measurements. Therefore, the amount by which the sealing member for sealing the joint between the developing means frame 51 and developer storage frame 61 must be compressed to airtightly seal the joint varies. However, using the elastomers 71 and 74 as the sealing members minimizes the effects of the nonuniformity in the measurements of the developing means frame 51 and/or developer storage frame 61; it can keep the pressure D low. Moreover, providing the developer storage frame 61 with the elastic members 81, 82, 83, and 84, in addition to using the elastomers 71 and 74, further reduces the effects of the nonuniformity in the measurements of the developing means frame 51 and/or developer storage frame 61 upon the amount of reactive force which the elastomers 71 and 74 generate. Therefore, it can keep the pressure D low in spite of the nonuniformity in the measurements of the developing means frame 51 and developer storage frame 61.

Also in this embodiment, not only is the elastomer 71 placed (coated) on the elastomer support rib 51*e*, but also, the elastomer 74 is placed on the corner areas of the flange 61*d*. In addition, the elastic members 81, 82, 83, and 84 are attached to the straight edges portions of the flange 61. Instead, however, the elastomer 71 may be attached to the developer storage frame 61 by providing the developer storage frame 61 with an elastomer support rib, whereas the elastic members 81, 82, 83, and 84 may be attached to the straight edge portions of the flange 51.

Further, the elastic members 81, 82, 83, and 84 may be the third connective portions integrally formed with the developer storage frame 61 or developing means frame 51.

Figure 43:
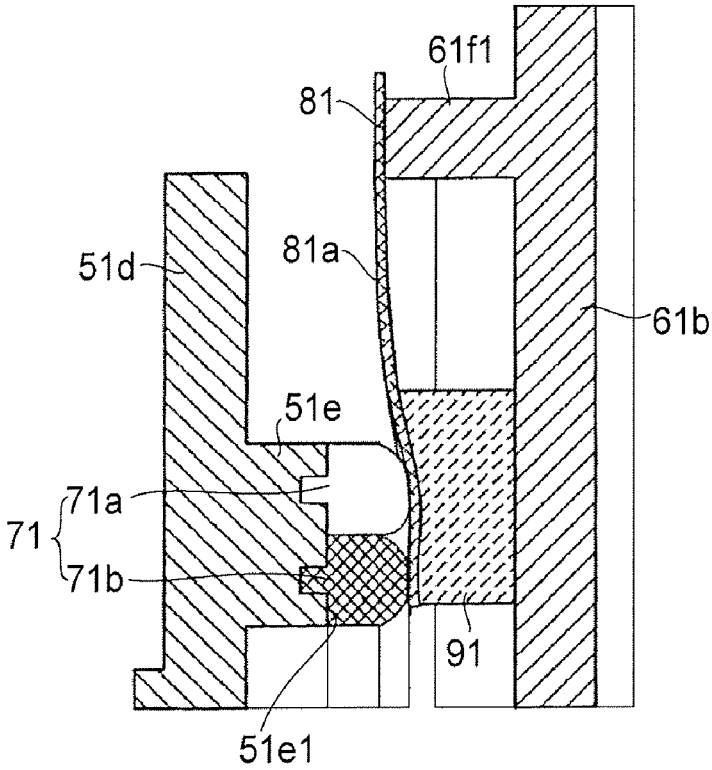
FIG. 43 is a schematic cross-sectional view of the joint between the flange of the developer storage frame having a foamed member, instead of the rib, and the flange of the developing means frame having the solidified elastomer.

In this embodiment, the third connective area 81*a* of the elastic member 81 is airtightly pressed on the elastomer 71 of the developing means frame 51 by the rib 61*i* of the developer storage frame 61. However, the rib 61*i* may be replaced with a pressing member formed of foamed substance or elastomer. FIG. 43 is a cross-sectional view of the joint between the flange 61*b* of the developer storage frame 61 having a member formed of a foamed substance, instead of the rib 61*i*, and the flange 51*d* having the elastomer 71. FIG. 44 is a cross-sectional view of the joint between the flange 61*b* of the developer storage frame 61 having the elastomer 72, instead of the rib 61*i*, and the flange 51*d* having the elastomer 71. The usage of an elastic pressing member 91 formed of a foamed substance, in place of the rigid rib 61*i*, in combination with the elastomer 72, can reduce the effects of the nonuniformity in the measurements of the developing means frame 51 and/or developer storage frame 61, upon the amount by which the elastomers 71 and 72 generate reactive force. Therefore, it can keep the pressure D low. The elastic pressing member 91 formed of a foamed substance, and elastomer 71, may be attached to the flange 61*b* side of the third connective area 81*a*, instead of the flange 61*b* of the developer storage frame 61. Such an arrangement is just as effective as the arrangement in this embodiment.

(2) Modified Method for Assembling the Developing Means Frame 51 and Developer Storage Frame 61

In this embodiment, the elastomer 71 is formed on either frame 51 or 61 by applying liquid elastomer 71 thereto. However, the elastomer 71 may be formed on the elastic member 81 by applying liquid elastomer 71 to the elastic member 81 (liquid elastomer application step). Incidentally, applying liquid elastomer 71 to the frames 51 and/or 61 is better in terms of assembly operation efficiency than applying liquid elastomer 71 to the elastic member 81. There are essentially two different methods for applying liquid elastomer 71 to the elastic member 81: a method (pre-attachment liquid elastomer application method) in which the elastomer 71 is applied to the elastic member 81 before the elastic member 81 is attached to the frame 51 or 61, and a method (post-attachment liquid elastomer application method) in which the elastomer 71 is applied to the elastic member 81 after the elastic member is attached to frame 51 or 61. Of the two different steps, the former is superior in assembly operation efficiency to the latter. Incidentally, after the completion the former, or the method in which the liquid elastomer 71 is applied before the attachment of the elastic member 81, the elastomer 71 attached to the elastic member 81 is placed in contact with the frame 51 or 61 (frame joining step), or the elastic member 81 to which the elastomer 71 has been attached is attached to the frame 51 or 61. Further, after the liquid elastomer is applied to the elastic member 81 attached to the frame 51 or 61, the elastomer 71 is placed in contact with the frame 51 or 61.

Further, the elastomer 71 attached (coated) to the frame 51 or 61 is placed in contact with the elastic member 81 (elastic member contact step), and then, the elastic member 81 may be attached to the frame 51 or 61 (elastic member attachment step).

Incidentally, the unmodified method in this embodiment is superior in assembly operation efficiency to these modified versions of the assembly method in this embodiment.

(3) Miscellaneous

Further, in this embodiment, the liquid elastomers 71, 72, and 74 are solidified by cooling. However, the method for solidifying the liquid elastomers 71, 72, and 74 does not need to be limited to cooling. For example, they may be solidified by chemical reaction, that is, by mixing the liquid elastomers with another liquid.

Also in this embodiment, when assembling the development unit A, the developing means frame 51 and developer storage frame 61 can be joined simply by moving the developer storage frame 61 relatively the developing means frame 51 in a single direction. Therefore, this embodiment can improve the efficiency with which the development unit A is assembled.

Embodiment 6

Next, another example of the development unit A will be described.

The components in this embodiment, which are identical to the counterparts in the fifth embodiments, are given the same reference numerals and characters as those given to the counterparts, and will not be described. The development unit A in this embodiment also is integrally joined with the photosensitive member unit B to form a cartridge C, as is the development unit A in the first embodiment.

Figure 45:
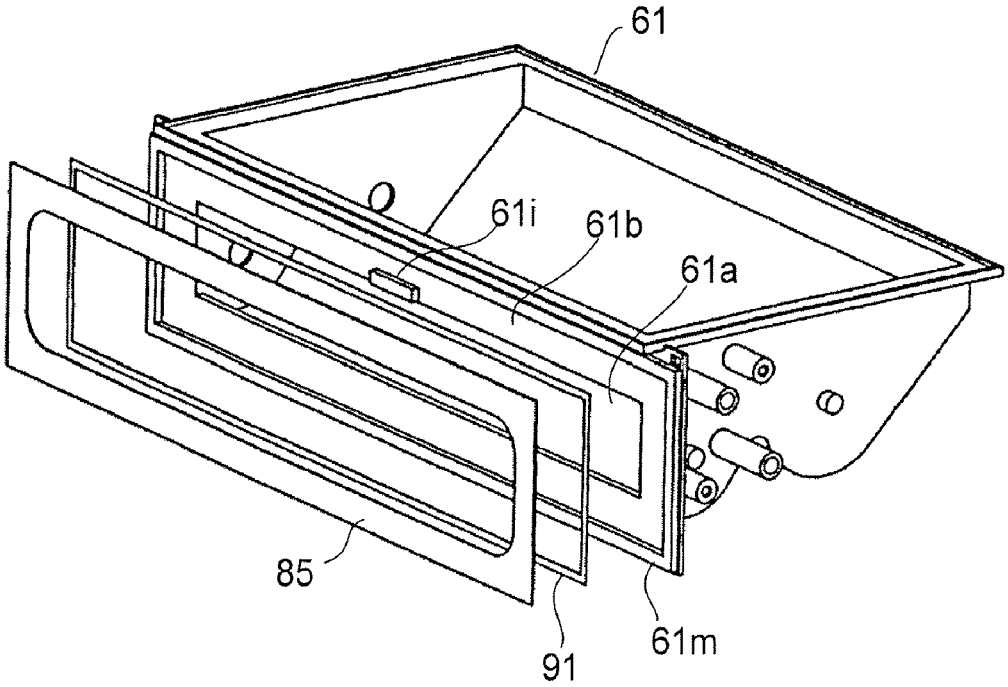
FIG. 45 is a drawing of the development unit in the sixth embodiment, showing its developer storage frame.
Figure 46:
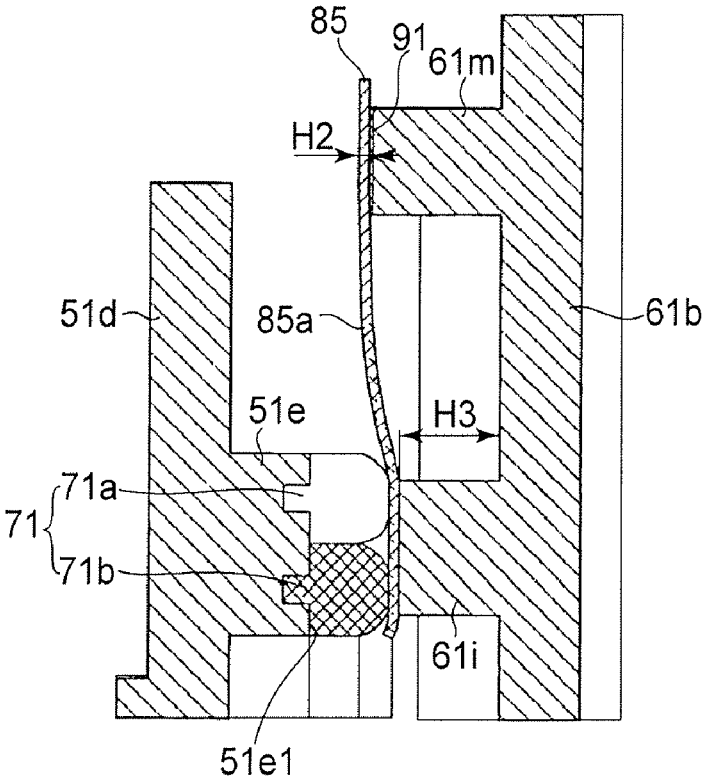
FIG. 46 is a schematic cross-sectional view of the joint between the developing means frame and developer storage frame of the development unit in the sixth embodiment, showing the relationship among the rib of the developer storage frame, elastic member, and the solidified elastomer of the developing means frame.

FIG. 45 is a drawing of the developer storage frame 6 of the development unit A in the sixth embodiment. FIG. 46 is a schematic drawing showing the relationship among the rib 61*i* of the developer storage frame 61, elastic member 85, and elastomer 71 of the developing means frame 51.

The developer storage frame 61 is provided with a rib 61*m* in the form of a rectangular frame, which extends along the edges of the flange 61*b*, and the elastic member 85 in the form of a rectangular frame, which is adhered to the rib 61*m* with the use of two-sided adhesive tape. Otherwise, the structure of the developer storage frame 61 in this embodiment is the same as that of the developer storage frame 61 in the first embodiment. This elastic member 84 is formed of sheet of an elastic (stretchable, shrinkable, and flexible) substance (for example, foamed substance, rubber, and the like). That is, in this embodiment, the flange 61*b* is provided with the rib 61*m* in the form of a rectangular frame, and the elastic member 85 is adhered to the rib 61*m* with the use of two-sided adhesive tape, instead of the ribs 61*h*1, 61*h*2, 61*h*3, and 61*h*4 and the elastomer 71, with which the flange 61*b* in the first embodiment is provided.

Therefore, the development unit A in this embodiment is the same in function and effect as the development unit A in the fifth embodiment.

According to the preceding embodiments, it is possible provide a developing apparatus capable of keeping satisfactorily sealed the joint between the first frame which stores developer, and the second frame which supports the developer bearing member, while controlling the amount of force applied from the first frame to the second frame, a process cartridge comprising such a developing apparatus, and an electrophotographic image forming apparatus in which such a process cartridge is removably mountable. Further, it is possible to simplify the process for assembling the developing apparatus.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 115611/2006 and 115612/2006 both filed Apr. 19, 2006 which are hereby incorporated by reference.

What is claimed is:

1. A developing apparatus usable with an electrophotographic image forming apparatus for forming an image on a recording material, said developing apparatus comprising:

a developer carrying member for developing a latent image formed on an electrophotographic photosensitive member with a developer;

a first frame for accommodating the developer, said first frame including a first opening for supplying the developer and a first connecting portion provided around said first opening;

a second frame containing said developer carrying member, a second opening for receiving a supply of the developer from said first opening and a second connecting portion provided around said second opening; and an elastomer for connecting said first connecting portion and said second connecting portion with each other with said first opening and said second opening being opposed to each other so as to permit movement of said first frame and said second frame and so as to prevent the developer from leaking between said first connecting portion and said second connecting portion.

2. An apparatus according to claim 1, wherein an elastic member is provided on one of said first connecting portion and said second connecting portion, and said elastomer is connected with said elastic member provided on said one of said first connecting portion and said second connecting portion.

3. An apparatus according to claim 2, wherein said elastic member is in the form of a sheet, and one end portion of said elastic member is connected with said one of said first connecting portion and said second connecting portion, and the other end portion of said elastic member is connected with said elastomer.

4. An apparatus according to claim 3, wherein the other end portion is contacted neither to said first frame nor to said second frame.

5. An apparatus according to claim 1, wherein said elastomer is connected with said first connecting portion and with said second connecting portion at respective positions which are different from each other with respect to a direction crossing with a circumferential direction of said first connecting portion and said second connecting portion.

6. An apparatus according to claim 1, wherein said elastomer comprises a first elastomer and a second elastomer, wherein said first elastomer is connected with said first connecting portion, said second elastomer is connected with said second connecting portion, and said first elastomer and said second elastomer are connected with each other.

7. An apparatus according to claim 6, wherein said first elastomer includes a first projected portion which is projected in a direction crossing with a circumferential direction of said first connecting portion and which is contacted neither to said first frame nor to said second frame, said second elastomer includes a second projected portion which is projected in a direction crossing with a circumferential direction of said second connecting portion and which is contacted neither to said first frame nor to said second frame, and said first projected portion and said second projected portion are connected with each other.

8. A process cartridge detachably mountable to a main assembly of an electrophotographic image forming apparatus for forming an image on a recording material, said process cartridge comprising:

an electrophotographic photosensitive member;

a developer carrying member for developing a latent image formed on said electrophotographic photosensitive member with a developer;

a first frame for accommodating the developer, said first frame including a first opening for supplying the developer and a first connecting portion provided around said first opening;

a second frame containing said developer carrying member, a second opening for receiving supply of the developer from said first opening and a second connecting portion provided around said second opening; and an elastomer for connecting said first connecting portion and said second connecting portion with each other with said first opening and said second opening being opposed to each other so as to permit movement of said first frame and said second frame and so as to prevent the developer from leaking between said first connecting portion and said second connecting portion.

9. A process cartridge according to claim 8, wherein an elastic member is provided on one of said first connecting portion and said second connecting portion, and said elastomer is connected with said elastic member provided on said one of said first connecting portion and said second connecting portion.

10. A process cartridge according to claim 9, wherein said elastic member is in the form of a sheet, and one end portion of said elastic member is connected with said one of said first connecting portion and said second connecting portion, and the other end portion of said elastic member is connected with said elastomer.

11. A process cartridge according to claim 10, wherein said other end portion is contacted neither to said first frame nor to said second frame.

12. A process cartridge according to claim 8, wherein said elastomer is connected with said first connecting portion and with said second connecting portion at respective positions which are different from each other with respect to a direction crossing with a circumferential direction of said first connecting portion and said second connecting portion.

13. A process cartridge according to claim 8, wherein said elastomer comprises a first elastomer and a second elastomer, wherein said first elastomer is connected with said first connecting portion, said second elastomer is connected with said second connecting portion, and said first elastomer and said second elastomer are connected with each other.

14. A process cartridge according to claim 13, wherein said first elastomer is connected with said first connecting portion and includes a first projected portion which is projected in a direction crossing with a circumferential direction of said first connecting portion and which is contacted neither to said first frame nor to said second frame, said second elastomer is connected with said second connecting portion and includes a second projected portion which is projected in a direction crossing with a circumferential direction of said second connecting portion and which is contacted neither to said first frame nor to said second frame, and said first projected portion and said second projected portion are connected with each other.

15. An electrophotographic image forming apparatus for forming an image on a recording material, said electrophotographic image forming apparatus comprising:

a process cartridge including an electrophotographic photosensitive member; a developer carrying member for developing a latent image formed on said electrophotographic photosensitive member with a developer; a first frame for accommodating the developer, said first frame including a first opening for supplying the developer and a first connecting portion provided around said first opening; a second frame containing said developer carrying member, a second opening for receiving a supply of the developer from said first opening and a second connecting portion provided around said second opening; an elastomer for connecting said first connecting portion and said second connecting portion with each other with said first opening and said second opening being opposed to each other so as to permit movement of said first frame and said second frame and so as to prevent the developer from leaking between said first connecting portion and said second connecting portion;

a mounting portion for detachably mounting said process cartridge; and feeding means for feeding the recording material.

16. An assembling method for assemblying a developing apparatus usable with an electrophotographic image forming apparatus for forming an image on a recording material, said method comprising:

a first preparing step of preparing a first frame for accommodating a developer, said first frame including a first opening for supplying the developer and a first connecting portion provided around said first opening;

a second preparing step of preparing a second frame containing a developer carrying member, a second opening for receiving a supply of the developer from said first opening and a second connecting portion provided around said second opening;

an application step of applying a liquid elastomer on one of said first connecting portion and said second connecting portion; and a connecting step of connecting said elastomer with the other one of said first connecting portion and said second connecting portion.

17. An assembling method for assemblying a developing apparatus usable with an electrophotographic image forming apparatus for forming an image on a recording material, said method comprising:

a first preparing step of preparing a first frame for accommodating a developer, said first frame including a first opening for supplying the developer and a first connecting portion provided around said first opening;

a second preparing step of preparing a second frame containing a developer carrying member, a second opening for receiving supply of the developer from said first opening and a second connecting portion provided around said second opening;

an application step of applying a liquid elastomer on one of said first connecting portion and said second connecting portion;

an elastic member mounting step of mounting an elastic member to the other one of said first connecting portion and said second connecting portion; and an elastic member connecting step of connecting said elastomer with said elastic member.

18. An assembling method for assemblying a developing apparatus usable with an electrophotographic image forming apparatus for forming an image on a recording material, said method comprising:

a first preparing step of preparing a first frame for accommodating a developer, said first frame including a first opening for supplying the developer and a first connecting portion provided around said first opening;

a second preparing step of preparing a second frame containing a developer carrying member, a second opening for receiving a supply of the developer from said first opening and a second connecting portion provided around said second opening;

a first application step of applying a first liquid elastomer on said first connecting portion;

a second application step of applying a second liquid elastomer on said second connecting portion; and an elastomer connecting step of connecting said first elastomer and said second elastomer with each other.

19. A method according to claim 18, wherein in said first application step, after an elastic member is mounted to said first frame, said first elastomer is applied on said elastic member.

20. A method according to claim 18, wherein in said second application step, after an elastic member is mounted on said second frame, said second elastomer is applied on said elastic member.

21. A developing apparatus usable with an electrophotographic image forming apparatus for forming an image on a recording material, said developing apparatus comprising:

a developer carrying member for developing a latent image formed on an electrophotographic photosensitive member with a developer;

a first frame for accommodating the developer, said first frame including a first opening for supplying the developer and a first connecting portion provided around said first opening;

a second frame containing said developer carrying member, a second opening for receiving a supply of the developer from said first opening and a second connecting portion provided around said second opening;

an elastic member in the form of a sheet provided on one of said first connecting portion and said second connecting portion;

an elastomer for connecting said one of said first connecting portion and said second connecting portion with said elastic member with said first opening and said second opening being opposed to each other so as to permit movement of said first frame and said second frame and so as to prevent the developer from leaking between said first connecting portion and said second connecting portion; and an urging member provided on said one of said first connecting portion and said second connecting portion, said urging member urging said elastic member toward a stepped portion of said elastomer.

22. An apparatus according to claim 21, wherein one end portion of said elastic member is mounted to said one of said first connecting portion and said second connecting portion, and the other end portion of said elastic member is connected with said elastomer.

23. An apparatus according to claim 22, wherein the other end portion is contacted neither to said first frame nor to said second frame.

24. An apparatus according to claim 21, wherein said elastomer is applied on the other of said first connecting portion and said second connecting portion.

25. An apparatus according to claim 21, wherein said urging member has an elasticity.

26. A process cartridge detachably mountable to a main assembly of an electrophotographic image forming apparatus for forming an image on a recording material, said process cartridge comprising:

an electrophotographic photosensitive member;

a developer carrying member for developing a latent image formed on said electrophotographic photosensitive member with a developer;

a first frame for accommodating the developer, said first frame including a first opening for supplying the developer and a first connecting portion provided around said first opening;

a second frame containing said developer carrying member, a second opening for receiving a supply of the developer from said first opening and a second connecting portion provided around said second opening;

an elastic member in the form of a sheet provided on one of said first connecting portion and said second connecting portion;

an elastomer for connecting said one of said first connecting portion and said second connecting portion with said elastic member with said first opening and said second opening being opposed to each other so as to permit movement of said first frame and said second frame and so as to prevent the developer from leaking between said first connecting portion and said second connecting portion; and an urging member provided on said one of said first connecting portion and said second connecting portion, said urging member urging said elastic member toward a stepped portion of said elastomer.

27. A process cartridge according to claim 26, wherein one end portion of said elastic member is mounted to said one of said first connecting portion and said second connecting portion, and the other end portion of said elastic member is connected with said elastomer.

28. A process cartridge according to claim 27, wherein the other end portion is contacted neither to said first frame nor to said second frame.

29. A process cartridge according to claim 26, wherein said elastomer is applied on the other one of said first connecting portion and said second connecting portion.

30. A process cartridge according to claim 26, wherein said urging member has an elasticity.

31. An electrophotographic image forming apparatus for forming an image on a recording material, said electrophotographic image forming apparatus comprising:

an electrophotographic photosensitive member; a developer carrying member for developing a latent image formed on said electrophotographic photosensitive member with a developer; a first frame for accommodating the developer, said first frame including a first opening for supplying the developer and a first connecting portion provided around said first opening; a second frame containing said developer carrying member, a second opening for receiving a supply of the developer from said first opening and a second connecting portion provided around said second opening; an elastic member in the form of a sheet provided on one of said first connecting portion and said second connecting portion; an elastomer for connecting said one of said first connecting portion and said second connecting portion with said elastic member with said first opening and said second opening being opposed to each other so as to permit movement of said first frame and said second frame and so as to prevent the developer from leaking between said first connecting portion and said second connecting portion; and an urging member provided on said one of said first connecting portion and said second connecting portion, said urging member urging said elastic member toward a stepped portion of said elastomer;

a mounting portion for detachably mounting said process cartridge; and feeding means for feeding the recording material.

32. An assembling method for assemblying a developing apparatus usable with an electrophotographic image forming apparatus for forming an image on a recording material, said method comprising:

a first preparing step of preparing a first frame for accommodating a developer, said first frame including a first opening for supplying the developer and a first connecting portion provided around said first opening;

a second preparing step of preparing a second frame containing a developer carrying member, a second opening for receiving a supply of the developer from said first opening and a second connecting portion provided around said second opening;

an application step of applying a liquid elastomer on one of said first connecting portion and said second connecting portion;

an elastic member mounting step of mounting an elastic member to the other one of said first connecting portion and said second connecting portion; and an elastic member connecting step of connecting said elastomer with said elastic member.

33. An assembling method for assemblying a developing apparatus usable with an electrophotographic image forming apparatus for forming an image on a recording material, said method comprising:

a first preparing step of preparing a first frame for accommodating a developer, said first frame including a first opening for supplying the developer and a first connecting portion provided around said first opening;

a second preparing step of preparing a second frame containing a developer carrying member, a second opening for receiving a supply of the developer from said first opening and a second connecting portion provided around said second opening;

an application step of applying a liquid elastomer on one of said first connecting portion and said second connecting portion;

an elastic member connecting step of connecting an elastic member with said elastomer; and an elastic member mounting step of mounting said elastic member to the other one of said first connecting portion and said second connecting portion.

34. An assembling method for assemblying a developing apparatus usable with an electrophotographic image forming apparatus for forming an image on a recording material, said method comprising:

a first preparing step of preparing a first frame for accommodating a developer, said first frame including a first opening for supplying the developer and a first connecting portion provided around said first opening;

a second preparing step of preparing a second frame containing a developer carrying member, a second opening for receiving a supply of the developer from said first opening and a second connecting portion provided around said second opening;

an application step of applying a liquid elastomer on one of said first connecting portion and said second connecting portion; and an elastic member connecting step of connecting said elastomer with an elastic member provided on the other one of said first connecting portion and said second connecting portion.

35. An assembling method for assemblying a developing apparatus usable with an electrophotographic image forming apparatus for forming an image on a recording material, said method comprising:

a first preparing step of preparing a first frame for accommodating a developer, said first frame including a first opening for supplying the developer and a first connecting portion provided around said first opening;

a second preparing step of preparing a second frame containing a developer carrying member, a second opening for receiving a supply of the developer from said first opening and a second connecting portion provided around said second opening;

an application step of applying a liquid elastomer to an elastic member provided on one of said first connecting portion and said second connecting portion; and a frame connecting step of connecting said elastomer with the other one of said first connecting portion and said second connecting portion.

36. An assembling method for assemblying a developing apparatus usable with an electrophotographic image forming apparatus for forming an image on a recording material, said method comprising:

a first preparing step of preparing a first frame for accommodating a developer, said first frame including a first opening for supplying the developer and a first connecting portion provided around said first opening;

a second preparing step of preparing a second frame containing a developer carrying member, a second opening for receiving a supply of the developer from said first opening and a second connecting portion provided around said second opening;

an elastic member application step of applying a liquid elastomer on an elastic member;

an elastic member mounting step of mounting said elastic member on one of said first connecting portion and said second connecting portion; and a frame connecting step of connecting said elastomer with the other one of said first connecting portion and said second connecting portion.

* * * * *